US006550759B2

(12) United States Patent
Kotaka et al.

(10) Patent No.: US 6,550,759 B2
(45) Date of Patent: Apr. 22, 2003

(54) PAPER FEEDER, AUXILIARY ROLLER, PAPER FEEDING METHOD USING THE SAME, AND RECORDING APPARATUS INCORPORATING THE SAME

(75) Inventors: Toshikazu Kotaka, Nagano (JP); Kazuhisa Kawakami, Nagano (JP); Kiyoto Komuro, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/790,718

(22) Filed: Feb. 23, 2001

(65) Prior Publication Data

US 2001/0028141 A1 Oct. 11, 2001

(30) Foreign Application Priority Data

Feb. 24, 2000 (JP) ..... P. 2000-047525
Apr. 20, 2000 (JP) ..... P. 2000-120020
Jun. 23, 2000 (JP) ..... P. 2000-189624

(51) Int. Cl.[7] ..... B65H 5/00

(52) U.S. Cl. ..... 271/10.11; 271/109; 271/121; 271/124; 271/127

(58) Field of Search ..... 271/10.11, 109, 271/117, 121, 3.08, 3.01, 124, 127, 902

(56) References Cited

U.S. PATENT DOCUMENTS 4,437,656 A * 3/1984 Onoda et al. ..... 271/127
5,594,486 A 1/1997 Kiyohara ..... 347/104
5,725,208 A 3/1998 Miyauchi ..... 271/10.09
5,863,036 A * 1/1999 Tanaka et al. ..... 271/121
5,934,664 A * 8/1999 Murayama et al. ..... 271/121
5,997,198 A * 12/1999 Murayama et al. ..... 271/121
6,000,689 A * 12/1999 Furuki et al. ..... 271/127
6,331,002 B1 * 12/2001 Yoshino et al. ..... 271/117

FOREIGN PATENT DOCUMENTS

EP 0279402 A2 8/1988
EP 0 816 107 A2 1/1998 ..... B41J/13/10
JP 11-79447 3/1999 ..... B65H/3/52

* cited by examiner

*Primary Examiner*—H. Grant Skaggs
(74) *Attorney, Agent, or Firm*—Sughrue Mion, PLLC

(57) ABSTRACT

An auxiliary roller is disposed in the proximity of sides of feed rollers and in the proximity upward from a separation pad. At the print time, the auxiliary roller is slightly projected toward the side of print sheet from roller faces of the feed rollers. The auxiliary roller is displaced as paper is displaced in a stack direction of the paper, and can be freely rotated. A hopper is moved up, paper is pressed against the feed rollers, and the separation pad abuts the feed rollers. Then, the feed rollers and a transport roller are rotated forward for feeding the paper to the transport roller. Further, the paper is sent from the transport roller at a distance equal to or greater than the length along the feeding path between the position of the front end of paper placed in a paper feed tray and the abutment center point of the separation pad and the feed rollers. Subsequently, the feed rollers and the transport roller stop, the hopper is moved down, and the separation pad is brought away from the feed rollers. Then, the transport roller is rotated reversely the rotation amount corresponding to the length or more for returning the paper.

42 Claims, 41 Drawing Sheets

PAPER FEEDER, AUXILIARY ROLLER, PAPER FEEDING METHOD USING THE SAME, AND RECORDING APPARATUS INCORPORATING THE SAME

BACKGROUND OF THE INVENTION

This invention relates to a paper feeding method using a feed roller for winding and feeding a recording material at the top from a storage section in which a plurality of recording materials are stacked on each other, a paper feeder used with the paper feeding method, and a recording apparatus comprising the paper feeder. The invention also relates to an auxiliary roller placed in the paper feeder.

Some recording apparatuses, for example, some printers comprise a detachable paper feed tray (paper tray). The paper feed tray is removed from the printer and a plurality of print sheets (cut sheets) stacked on each other are stored in the paper feed tray, then the paper feed tray is placed again in the printer. To place the paper feed tray in the printer, for example, the paper feed tray is inserted into the printer horizontally from the front of the printer to the depth thereof.

A feed roller is placed at a distance from the front end top print sheet on the attached paper feed tray. When print sheet is fed, it is displaced to the feed roller side by a hopper and is brought into contact with and pressed against the feed roller. Then, as the feed roller is rotated, the top print sheet is wound around the feed roller and is transported.

If a predetermined number or less of print sheets are place in the paper feed tray, the feed roller is placed at a position where it does not come in contact with the print sheet placed in the paper feed tray when the paper feed tray is placed in the printer. However, a larger number of print sheets than the predetermined number of sheets may be placed in the paper feed tray. If the paper feed tray is placed in the printer in this state, some print sheets may come in contact with the feed roller. Since the feed roller is joined to a drive motor, it is configured so as not easily to rotate freely. Therefore, if the paper feed tray is inserted into the printer and placed therein with a print sheet in contact with the feed roller, the sheet of the print sheet in contact with the feed roller may be blocked by the feed roller which does not rotate, and may be bent, wrinkled, or broken in some cases.

On the other hand, a separation pad is placed in the proximity of the downstream side in the paper transport direction of the paper feed tray. The separation pad is configured so that it can be advanced to or retreated from the feed roller.

When paper is fed (namely, when the top print sheet is taken out from the paper feed tray, is wound around the feed roller, and is fed into a transport roller downstream from the feed roller), the separation pad is pressed against the feed roller for clamping the fed print sheet with the feed roller, and if print sheets below the top sheet are about to be transported together with the top sheet, the separation pad separates the top print sheet from the print sheets therebelow. The print sheets below the top sheet separated stop on the separation pad (for example, in the vicinity of the contact center point between the separation pad and the feed roller; i.e., a nip point).

In contrast, at the print (record) time (namely, when printing is executed on transported a print sheet in a print (record) section), the separation pad is placed at a distance from the feed roller for lightening transport resistance (back tension) imposed on the transport roller placed downstream from the feed roller and improving the transport accuracy and the record quality.

However, the rear end part of the top print sheet is still wound around the feed roller during the printing, thus if the top print sheet is transported with the separation pad at a distance from the feed roller, the print sheets below the top sheet on the separation pad may be dragged with the top sheet and be transported to the print section overlapping the top sheet.

Particularly, in a printer having a feeding path shaped roughly like U on side view, which will be hereinafter referred to simply as U-shaped feeding path, where fed print sheet makes almost half a round of the feed roller and is sent in an opposite direction to the direction in which the print sheet is taken out from the paper feed tray, the U-shaped feeding path essentially has a large back tension and to lighten the back tension as much as possible, the feed roller is also rotated together with the transport roller at the print time. Thus, if printing on the top print sheet proceeds and the rear end part of the top sheet is released from being wound around the feed roller, the print sheets below the top sheet on the separation pad may come in contact with the rotating feed roller and be fed.

To prevent such overlap sheet feeding, an auxiliary roller (idle roller) coming in contact with the separation pad at a distance from the feed roller can be placed, thereby sandwiching the top print sheet and the print sheets below the top sheet on the separation pad between the auxiliary roller and the separation pad.

However, if the top print sheet is sandwiched between the auxiliary roller and the separation pad there is a problem of an increase in back tension because of the resistance. Particularly, the U-shaped feeding path described above essentially h as a large back tension and thus it is not preferred that the back tension produced by the auxiliary roller is added.

SUMMARY OF THE INVENTION

It is therefore an object of the invention to prevent overlap sheet feeding of print sheets without increasing back tension.

In order to achieve the above object, according to the present invention, there is provided a method of feeding a recording material, comprising the steps of:

providing a feeder, which includes:

- a storage section, in which a plurality of recording materials are stacked;
- a feed roller, for feeding a top one of the recording materials in the storage section by rotating forwardly;
- a transport roller, for transporting the fed recording material by rotating forwardly, the transport roller being rotatable reversely;
- an abutment driver, for moving the storage section between an abutment position and a separated position, the abutment position at which the recording materials are abutted onto the feed roller, the separated position being separated from the feed roller; and
- a separator, provided with an abutment part, the separator being movable between an abutment position and a separated position, the abutment position at which the abutment part is abutted onto the feed roller to separate the top one of the recording material from a subsequent recording material, the separated position at which the abutment part is separated from the feed roller;

moving the abutment driver and the separator to the respective abutment position;

rotating the feed roller and the transport roller forwardly until a leading end of the fed recording material fitted on the transport roller is transported therefrom by a first predetermined length which is not less than a feeding path length between a leading end of the recording material stacked in the storage section and an abutment center point of the separator and the feed roller;

stopping the rotations of the feed roller and the transport roller;

moving the abutment driver and the separator to the respective separated positions; and rotating the transport roller reversely by a predetermined rotation amount which corresponds to a second predetermined length which is not less than the first predetermined length.

In this configuration, the rotations of the feed roller and the transport roller are stopped, the separator is at the abutment position and thus the top recording material is fed and on the other hand, the subsequent recording materials stop in the vicinity of the abutment center point of the separator and the feed roller.

Subsequently, as the transport roller is reversely rotated, the top recording material is returned through the feed roller to the storage section. The subsequent recording materials in the vicinity of the abutment center point of the separator and the feed roller are returned together with the top recording material by the intimate contact force between the recording materials (frictional force, electrostatic force, etc.,) as the top recording material is returned by the transport roller. Since the second length is not less than the first length, the subsequent recording materials are naturally returned to the storage section.

Therefore, even if recording is executed while the top recording material is transported after the subsequent recording materials are returned, the subsequent recording materials are not on the separator but in the storage section at the separated position, so that overlap feeding of the subsequent recording materials can be prevented reliably.

Preferably, the second predetermined length is a length in which the first predetermined length is added to a bendable amount of the recording material at a feeding path between the feed roller and the transport roller.

To return the top recording material by reversely rotating the transport roller, the top recording material may be bent in the feeding path between the transport roller and the feed roller. However, in this configuration, even if the recording material is bent, the subsequent recording materials can be returned to the storage section reliably.

In addition, if the top recording material is returned, the fitting of the top recording material with the transport roller is not released and the top recording material is returned reliably, and thereby the subsequent recording materials can be returned to the storage section reliably.

According to the invention, in order to obtain the same advantageous effects, there is also provided a feeder for feeding a recording material, comprising:

a storage section, in which a plurality of recording materials are stacked;

a feed roller, for feeding a top one of the recording materials in the storage section by rotating forwardly, the feed roller being rotatable reversely;

a transport roller, for transporting the fed recording material by rotating forwardly, the transport roller being rotatable reversely;

an abutment driver, for moving the storage section between an abutment position and a separated position, the abutment position at which the recording materials are abutted onto the feed roller, the separated position being separated from the feed roller;

a first separator, provided with a first abutment part, the separator being movable between an abutment position and a separated position, the abutment position at which the first abutment part is abutted onto the feed roller to separate the top one of the recording material from a subsequent recording material, the separated position at which the first abutment part is separated from the feed roller; and a controller for controlling the feed roller, the transport roller, the abutment driver and the first separator such that:

the abutment driver and the separator are moved to the respective abutment position;

the feed roller and the transport roller are rotated forwardly until a leading end of the fed recording material fitted on the transport roller is transported therefrom by a first predetermined length which is not less than a feeding path length between a leading end of the recording material stacked in the storage section, and an abutment center point of the first separator and the feed roller;

the rotations of the feed roller and the transport roller are stopped;

the abutment driver and the separator are moved to the respective separated positions; and the transport roller is rotated reversely by a predetermined rotation amount which corresponds to a second predetermined length which is not less than the first predetermined length.

Preferably, the feeder further comprises:

a second separator, disposed at a downstream side of the first separator which is disposed at a downstream side of the storage section, the second separator provided with a second abutment part on which the fed recording material is abutted, the second abutment part being separated from the feed roller; and a first auxiliary roller, being rotatable freely and abutable onto the second abutment part, an abutment center point between the first auxiliary roller and the second abutment part being disposed at a downstream side of the abutment center point of the first separator and the feed roller.

Here, an angle defined between a leading end of the recording material and the second abutment part, when the leading end is abutted onto the second abutment part, is larger than an angle defined between the leading end of the recording material and the first abutment part, when the leading end is abutted onto the first abutment part in the separated position. While recording is performed, the first abutment part is moved to the separated position, and the first auxiliary roller abuts onto the second abutment part to separate the top recording material from the subsequent recording material.

In this configuration, overlap feeding of the subsequent recording materials at the time of recoding on the recording material is blocked at the second abutment part, so that it is made possible to prevent overlap feeding of the recording materials still more reliably, as described in detail below:

At the recording time, since the top recording material undergoing recording is not sandwiched between the feed roller and the first separator, so that back tension can be reduced and the record quality can be improved.

Since the first separator assumes the separated position at the recording time as described above, it is feared that the subsequent recording materials may be fed overlapping the top recording material by the intimate contact force with the top recording material (frictional force, electrostatic force, etc.,) at the recording time. However, the first auxiliary roller presses the second abutment part for clamping the recording material, whereby overlap recording material feeding is prevented.

Further, the load (contact resistance) when the tip of the recording material abuts the second abutment part becomes larger than the load (contact resistance) when the tip of the recording material abuts the first abutment part. Thus, the press force for the first auxiliary roller to press the second abutment part may be small. That is, the first auxiliary roller presses the second abutment part by the press force smaller than that when it presses the first abutment part, whereby it is made possible to prevent overlap recording material feeding. Consequently, the back tension produced by sandwiching the recording material between the first auxiliary roller and the second abutment part can be made smaller than the back tension produced by sandwiching the recording material between the first auxiliary roller and the first abutment part. Thus, while overlap recording material feeding is prevented, the back tension can also be reduced.

Further, since the abutment center point of the first auxiliary roller abutting the second abutment part is positioned downstream in the feeding direction from the abutment center point of the first abutment part and the feed roller, the subsequent recording materials being fed overlapping the top recording material downstream in the feeding direction from the first abutment part can be stopped at the second abutment part reliably.

In the invention, the term "abut (abutment)" also contains to apply press force for abutment, namely, to press against.

Preferably, the first auxiliary roller is separated from the second abutment part while the recording material is fed to the transport roller.

In this configuration, contact resistance with the recording material does not occur and the recording material can be fed smoothly.

Preferably, the feeder further comprises a second auxiliary roller disposed such that a roller face thereof is protruded from a roller face of the feed roller toward the storage section, while the recording is performed.

In this configuration, the second auxiliary roller is placed above the storage section and has the roller face projected to the recording material side from the roller face of the feed roller at the time of recording on the fed recording material. Therefore, the top recording material wound around the feed roller and the subsequent recording materials being fed overlapping the top recording material are separated from the feed roller by the second auxiliary roller. The top recording material is wound around the feed roller and is sent to the transport roller at the recording time and thus again comes in contact with the feed roller and is transported. On the other hand, the subsequent recording materials are separated by the first separator and the tip of the recording material abuts the first or second abutment part, but the subsequent recording materials are separated from the feed roller by the upstream auxiliary roller, whereby the tip is urged to the first and second abutment parts placed facing the feed roller. Accordingly, overlap recording material feeding can be prevented still more effectively.

Preferably, the feeder further comprises an urging member for urging the first auxiliary roller toward the second abutment part.

In this the configuration, the urging member for pressing the first auxiliary roller against the second abutment part is disposed in the proximity of the first auxiliary roller, so that it is made possible to impose load directly on the first auxiliary roller and therefore it is made possible to impose proper load with a small error and with no loss.

Preferably, the urging member is a spring member.

In this the configuration, it is made possible to arbitrarily and easily change the load imposed on the first auxiliary roller by replacing the spring and it is made possible to press the first auxiliary roller against the second abutment part with the most appropriate load. That is, if the press force is provided only by the own weight of the auxiliary roller holder for supporting the first auxiliary roller, etc., the press force cannot easily be changed. However, in this configuration, the load can be easily changed by replacing the spring and it is made possible to press the first auxiliary roller against the second abutment part with the most appropriate load in response to the friction coefficients of the second abutment part and the recording material and considering back tension.

Since the spring is lightweight, it is made possible to reduce the weight of the record feeder as compared with the case where the urging member is implemented as a weight, etc. Therefore, particularly, if shock of drop, etc., is added, trouble of damage, disassembly, etc., does not occur and excellent shock resistance can be provided.

According to the invention, there is also provided a recording apparatus comprising the paper feeder discussed above;

According to the invention, there is also provided a feeder, comprising:

- a detachable storage section in which a plurality of recording materials are stacked;
- a feed roller, for feeding a top one of the recording materials in the attached storage section; and
- an auxiliary roller being rotatable freely, the auxiliary roller disposed such that a roller face thereof is protruded from a roller face of the feed roller toward the attached storage section, the auxiliary roller being movable in accordance with a displacement of the recording material in the stacking direction thereof.

In this configuration, when the storage section is attached, if the amount of the recording materials is small (for example, equal to or less than the stipulated amount), the recording material comes in contact with the auxiliary roller as the recording material is displaced in the stack direction; if the amount of the recording materials is large (for example, greater than the stipulated amount), the recording material comes in contact with the auxiliary roller as the recording material is not displaced in the stack direction. In the latter case, the recording material may come in contact with the feed roller.

Even in the latter case, according to the configuration, the freely rotatable auxiliary roller has the roller face projected to the recording material side from the roller face of the feed roller, so that the recording material first comes in contact with the auxiliary roller rather than the feed roller. The auxiliary roller, which is freely rotatable, guides the recording material in the attachment direction while it is rotated as the recording material comes in contact with the auxiliary roller. Thus, bending, wrinkling, and breaking the recording material as the recording material comes in direct contact with the feed roller not rotating can be prevented.

Preferably, the auxiliary roller is disposed in the vicinity of a side end portion of the feed roller.

In this configuration, the effect of preventing the feed roller from being bent as the recording material comes in direct contact with the feed roller is still more increased.

According to the invention, there is also provided a recording apparatus comprising the paper feeder discussed the above.

According to the invention, there is also provided a feeder, comprising:

a storage section in which a plurality of recording materials are stacked;

a feed roller, for feeding a top one of the recording materials in the storage section;

a transport roller, for transporting the recording material fed by the feed roller while recording is performed;

a separator, being movable between an abutment position and a separated position with respect to the feed roller, the separator being moved to the abutment position to separate the top recording material from a subsequent recording material when the feed roller feeds the top recording material toward the transport roller, the separator being moved to the separated position while the recording is performed; and at least one auxiliary roller, disposed at an upstream side of the separator, the auxiliary roller being abutted onto the fed recording material to guide the top recording material toward the separator, after separating the subsequent recording material from the top recording material.

In this configuration, the auxiliary roller is placed upstream from the separator. The auxiliary roller comes in contact with the fed recording material for bringing the subsequent recording materials being about to be fed overlapping the top recording material away from the feed roller and guides in the direction of the separator. Therefore, if the separator is brought away from the feed roller and is placed facing the roller face of the feed roller at the recording time, the subsequent recording materials are brought away from the feed roller and come in contact with the separator. Consequently, overlap feeding of the subsequent recording materials is prevented by the frictional resistance between the subsequent recording materials and the separator.

In the paper feeder with the feed roller rotating at the recording time (for example, the paper feeder having a U-shaped feeding path), even if the top recording material is detached from the feed roller, the subsequent recording materials do not come in contact with the feed roller and thus overlap feeding of the subsequent recording materials is also prevented.

Further, the auxiliary roller is placed upstream from the separator and does not clamp the recording material with the separator, so that the back tension imposed on the transport roller positioned downstream from the feed roller can be reduced. Particularly, the back tension can be reduced still more effectively in the paper feeder having a U-shaped feeding path.

Preferably, a roller face of the auxiliary roller is protruded from a roller face of the feed roller toward the storage section, while the recording is performed.

At the recording time, the top recording material is wound around the feed roller, but the subsequent recording materials are separated by the separator and are not wound. According to the configuration, the auxiliary roller has the roller face projected from the roller face of the feed roller at the recording time and on the other hand, the separator is placed facing roller face of the feed roller downstream from the auxiliary roller. Therefore, the subsequent recording materials are brought away from the feed roller by the projected auxiliary roller and comes in contact with the separator downstream from the roller. Accordingly, similar advantages can be provided.

Preferably, the auxiliary roller is retreatable from a position in which the roller face thereof is protruded from the roller face of the feed roller.

In this configuration, at the feeding time, if the stacked recording materials are displaced toward the feed roller by a hopper, etc., placed in the storage section and are brought into contact with and are pressed against the feed roller, thereby starting paper feed, as the auxiliary roller is retreated, the recording materials are brought into contact with and are pressed against the feed roller and paper feed is enabled.

Preferably, the auxiliary roller abuts onto the recording material elastically.

In this configuration, the auxiliary roller comes in elastic contact with the recording material, so that vibration of the recording material caused by transport at the recording time can be absorbed and the recording material can be kept from becoming wrinkled and can be protected.

Preferably, a plurality of auxiliary rollers are arranged in a widthwise direction of the recording material while being supported rotatably.

In this configuration, the rolling motion of the recording material caused by transport at the recording time can be absorbed flexibly and the recording material can be protected accordingly.

Preferably, the auxiliary roller is disposed in the vicinity of a side end portion of the feed roller.

In this configuration, the effect of preventing overlap feeding of the subsequent recording materials is still more increased.

According to the invention, there is also provided a recording apparatus comprising the paper feeder discussed the above.

According to the invention, there is also provided An auxiliary roller, provided in a feeder which comprises: a detachable storage section in which a plurality of recording materials are stacked; and a feed roller, for feeding a top one of the recording materials in the attached storage section.

Here, the auxiliary roller is rotatable freely. The auxiliary roller is disposed such that a roller face thereof is protruded from a roller face of the feed roller toward the attached storage section. The auxiliary roller is movable in accordance with a displacement of the recording material in the stacking direction thereof.

According to the invention, there is also provided an auxiliary roller, provided in a feeder which comprises: a storage section in which a plurality of recording materials are stacked; a feed roller, for feeding a top one of the recording materials in the storage section; a transport roller, for transporting the recording material fed by the feed roller while recording is performed; and a separator, being movable between an abutment position and a separated position with respect to the feed roller, the separator being moved to the abutment position to separate the top recording material from a subsequent recording material when the feed roller feeds the top recording material toward the transport roller, the separator being moved to the separated position while the recording is performed.

Here, the auxiliary roller is disposed at an upstream side of the separator. The auxiliary roller is abutted onto the fed recording material to guide the top recording material toward the separator, after separating the subsequent recording material from the top recording material.

According to the invention, there is also provided a feeder for feeding a recording material, comprising:

a storage section, in which a plurality of recording materials are stacked;

a feed roller, for feeding a top one of the recording materials in the storage section by rotating forwardly, the feed roller being rotatable reversely;

a transport roller, for transporting the fed recording material by rotating forwardly, the transport roller being rotatable reversely;

an abutment driver, for moving the storage section between an abutment position and a separated position, the abutment position at which the recording materials are abutted onto the feed roller, the separated position being separated from the feed roller;

a first separator, provided with a first abutment part, the separator being movable between an abutment position and a separated position, the abutment position at which the first abutment part is abutted onto the feed roller to separate the top one of the recording material from a subsequent recording material, the separated position at which the first abutment part is separated from the feed roller;

a second separator, disposed at a downstream side of the first separator which is disposed at a downstream side of the storage section, the second separator provided with a second abutment part on which the fed recording material is abutted, the second abutment part being separated from the feed roller; and a first auxiliary roller, being rotatable freely and abutable onto the second abutment part, an abutment center point between the first auxiliary roller and the second abutment part being disposed at a downstream side of the abutment center point of the first separator and the feed roller.

Here, an angle defined between a leading end of the recording material and the second abutment part, when the leading end is abutted onto the second abutment part, is larger than an angle defined between the leading end of the recording material and the first abutment part, when the leading end is abutted onto the first abutment part in the separated position. The first auxiliary roller abuts onto the second abutment part to separate the top recording material from the subsequent recording material, while recording is performed.

In this configuration, overlap feeding of the subsequent recording materials at the time of recording on the recording material is blocked at the second abutment part, so that it is made possible to prevent overlap feeding of the recording materials reliably.

That is, the feed roller is positioned above the storage section and comes in contact with the top recording material in the storage section, thereby taking out, winding, and feeding the recording material to the transport roller positioned in the opposite direction to the direction of taking out the recording material. Therefore, the recording material is fed from the storage section via the U-shaped feeding path to the transport roller.

At the time of feeding the recording material to the transport roller, the first separator assumes the abutment position and the recording material is sandwiched between the first abutment part and the feed roller, whereby the top recording material is separated from the subsequent recording materials and is fed by the feed roller. Therefore, at the feeding time, the top recording material is separated from the subsequent recording materials and is fed to the transport roller. On the other hand, at the time of recording on the fed recording material, the first separator assumes the separated position. Accordingly, at the recording time, the top recording material undergoing recording is not sandwiched between the feed roller and the first separator, so that back tension can be reduced and the record quality can be improved.

At the recording time, the first auxiliary roller presses the second abutment part of the second separator for clamping the recording material and separates the top recording material from the subsequent recording materials. Since the first separator assumes the separated position at the recording time as described above, it is feared that the subsequent recording materials may be fed overlapping the top recording material by the intimate contact force with the top recording material (frictional force, electrostatic force, etc.,) at the recording time. However, the first auxiliary roller presses the second abutment part for clamping the recording material, whereby overlap recording material feeding is prevented.

The second abutment part is placed so that the angle between the tip of the fed recording material and the second abutment part when the tip of the fed recording material abuts the second abutment part becomes larger than the angle between the tip of the fed recording material and the first abutment part when the tip of the fed recording material abuts the first abutment part at the separated position. Therefore, the load (contact resistance) when the tip of the recording material abuts the second abutment part becomes larger than the load (contact resistance) when the tip of the recording material abuts the first abutment part. Thus, the press force for the first auxiliary roller to press the second abutment part may be small. That is, the first auxiliary roller presses the second abutment part by the press force smaller than that when it presses the first abutment part, whereby it is made possible to prevent overlap recording material feeding. Consequently, the back tension produced by sandwiching the recording material between the first auxiliary roller and the second abutment part can be made smaller than the back tension produced by sandwiching the recording material between the first auxiliary roller and the first abutment part. Thus, while overlap recording material feeding is prevented, the back tension can also be reduced.

Further, the abutment center point of the first auxiliary roller abutting the second abutment part is positioned downstream in the feeding direction from the abutment center point of the first abutment part and the feed roller, so that the subsequent recording materials being fed overlapping the top recording material downstream in the feeding direction from the first abutment part can be stopped at the second abutment part reliably.

Preferably, the first auxiliary roller is separated from the second abutment part while the recording material is fed to the transport roller.

In this configuration, when the recording material is fed to the transport roller, the first auxiliary roller assumes the separated position from the second abutment part, so that contact resistance with the recording material does not occur and the recording material can be fed smoothly.

Preferably, the feeder further comprises an urging member for urging the first auxiliary roller toward the second abutment part.

In this configuration, the urging member for pressing the first auxiliary roller against the second abutment part is disposed in the proximity of the first auxiliary roller, so that it is made possible to impose load directly on the first auxiliary roller and therefore it is made possible to impose proper load with a small error and with no loss.

Preferably, the urging member is a spring member.

In this configuration, it is made possible to arbitrarily and easily change the load imposed on the first auxiliary roller by replacing the spring and it is made possible to press the first auxiliary roller against the second abutment part with the most appropriate load. That is, if the press force is provided only by the own weight of the auxiliary roller holder for supporting the first auxiliary roller, etc., the press force cannot easily be changed. However, according to the configuration, the load can be easily changed by replacing the spring and it is made possible to press the first auxiliary roller against the second abutment part with the most appropriate load in response to the friction coefficients of the second abutment part and the recording material and considering back tension.

Since the spring is lightweight, it is made possible to reduce the weight of the record feeder as compared with the case where the urging member is implemented as a weight, etc. Therefore, particularly, if shock of drop, etc., is added, trouble of damage, disassembly, etc., does not occur and excellent shock resistance can be provided.

Preferably, the feeder further comprises at least one second auxiliary roller disposed at an upstream side of the first separator, the second auxiliary roller being abutted onto the fed recording material to guide the top recording material toward the first separator, after separating the subsequent recording material from the top recording material.

Preferably, the second auxiliary roller is disposed such that a roller face thereof is protruded from a roller face of the feed roller toward the storage section, while the recording is performed.

In this configuration, the second auxiliary roller is placed above the storage section and has the roller face projected to the recording material side from the roller face of the feed roller at the time of recording on the fed recording material. Therefore, the top recording material wound around the feed roller and the subsequent recording materials being fed overlapping the top recording material are separated from the feed roller by the second auxiliary roller. The top recording material is wound around the feed roller and is sent to the transport roller at the recording time and thus again comes in contact with the feed roller and is transported. On the other hand, the subsequent recording materials are separated by the first separator and the tip of the recording material abuts the first or second abutment part, but the subsequent recording materials are separated from the feed roller by the second auxiliary roller, whereby the tip is urged to the first and second abutment parts placed facing the feed roller. Accordingly, overlap recording material feeding can be prevented still more effectively.

Preferably, the second auxiliary roller is retreatable from a position in which the roller face thereof is protruded from the roller face of the feed roller.

Preferably, the second auxiliary roller abuts onto the recording material elastically.

Preferably, a plurality of second auxiliary rollers are arranged in a widthwise direction of the recording material while being supported rotatably.

According to the invention, there is also provided a recording apparatus comprising the paper feeder discussed the above.

DETAILED DESCRIPTION OF THE PREFERRED EMBODIMENTS

Figure 1:
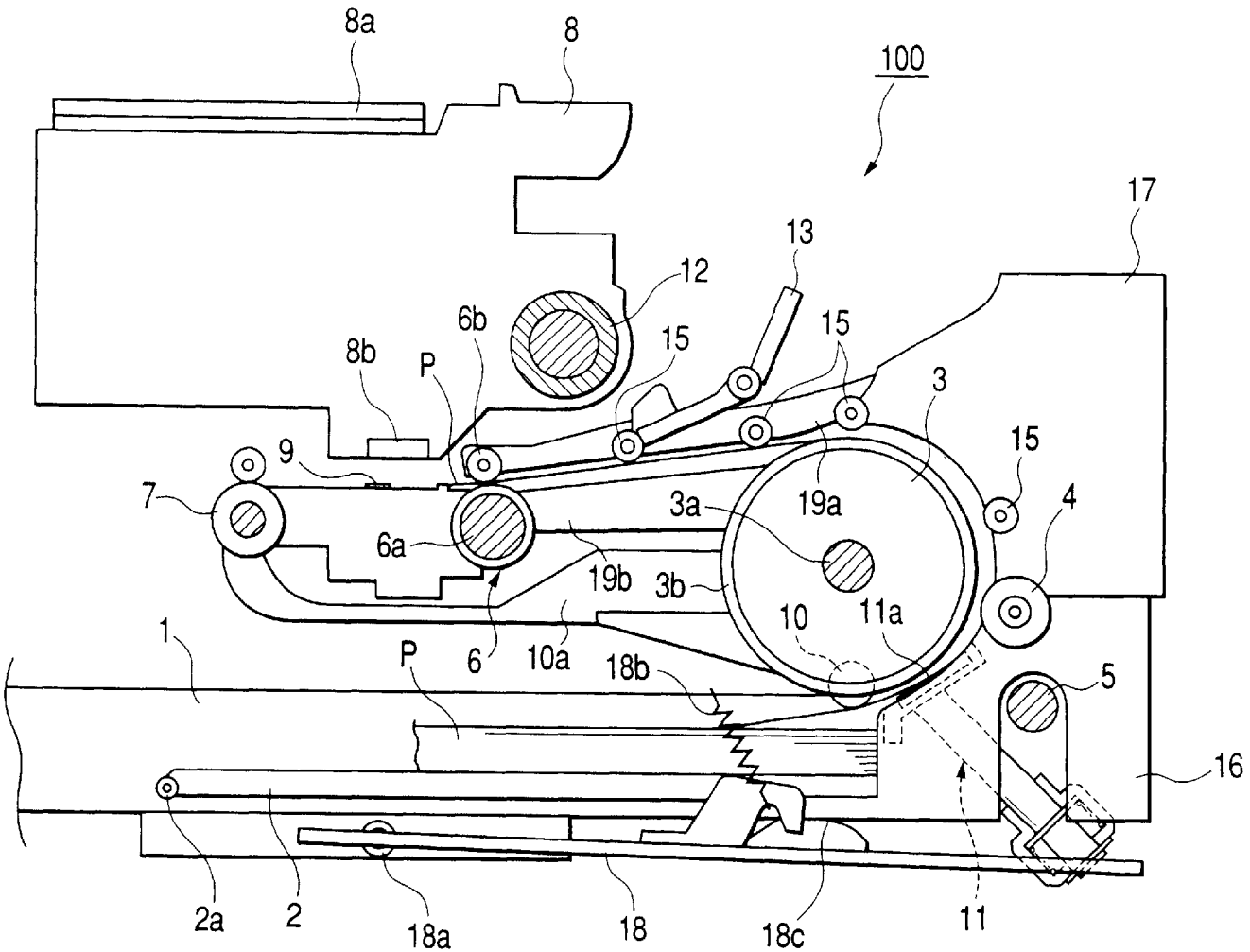
FIG. 1 is a schematic side view of an ink jet printer according to a first embodiment of the invention.
Figure 2:
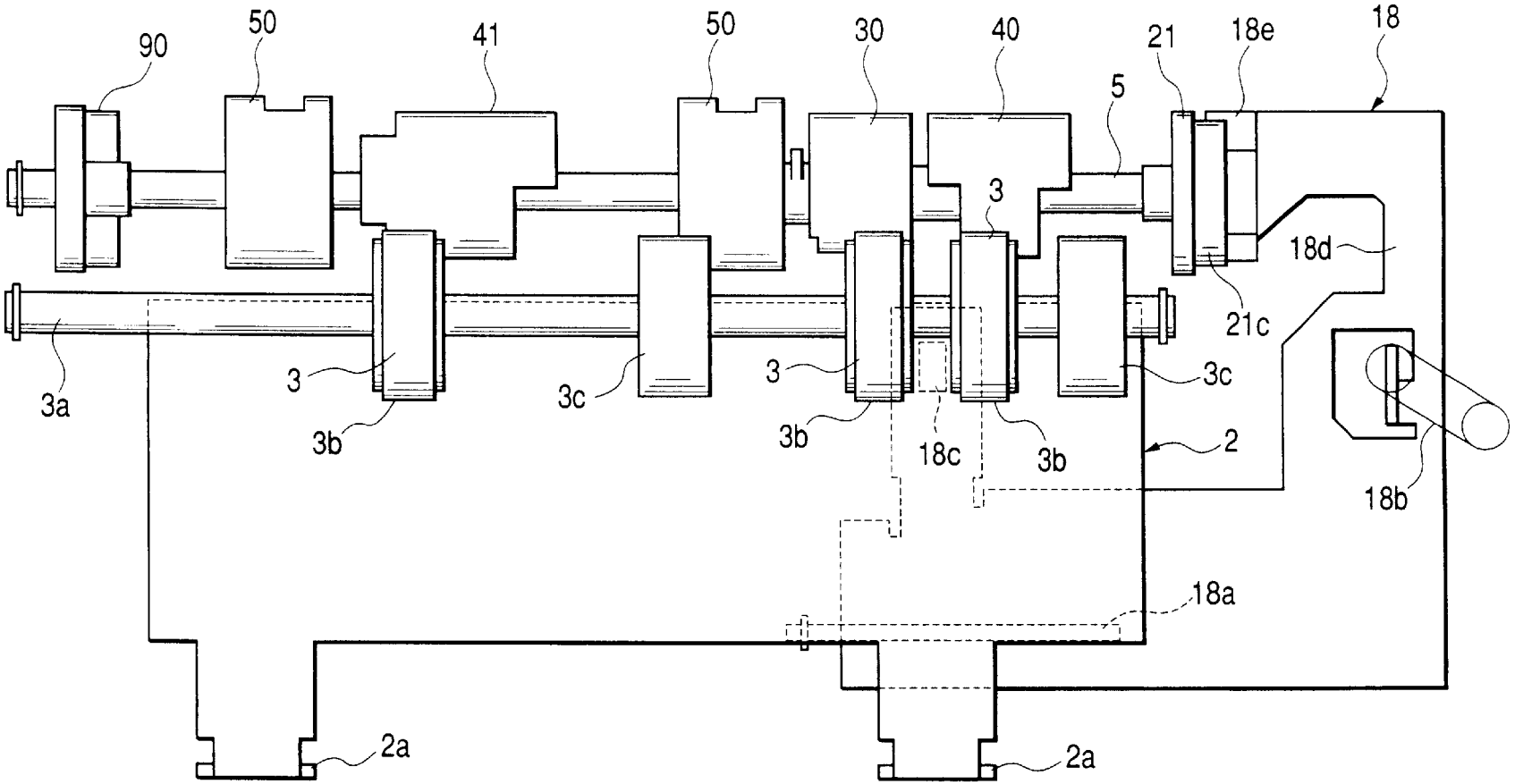
FIG. 2 is a plan view (top view) of the ink jet printer and mainly shows a hopper, a hopper holder, a control shaft, and feed rollers.
Figure 3:
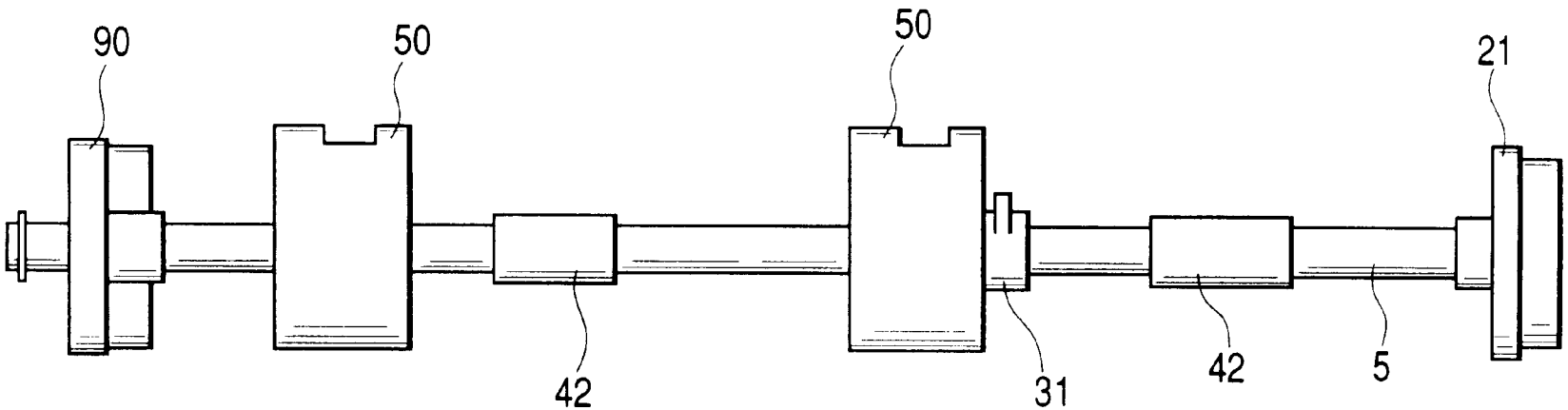
FIG. 3 is a plan view (top view) to show the control shaft.

Referring now to FIGS. 1 to 3, an ink jet printer serving as a recording apparatus according to a first embodiment of the invention will be outlined.

FIG. 1 is a schematic side view of an ink jet printer 100 according to the first embodiment. FIG. 2 is a plan view (top view) of the ink jet printer 100 and mainly shows a hopper 2, a hopper holder 18, a control shaft 5, and paper feed rollers 3. FIG. 3.is a plan view (top view) to show the control shaft 5.

The ink jet printer (simply, printer) 100 has a feeding path roughly shaped like U on side view as a feeding path of print sheet (cut sheet of paper, simply, paper) P serving as a recording material. A paper feed tray 1 serving as a storage section is placed at the start end of the feeding path and the paper feed rollers 3 and a transport roller (paper transport roller) 6 are placed on the feeding path. A carriage 8 and a paper discharge roller 7 are placed downstream from the paper feed roller 6.

The paper feed tray 1 has a structure capable of storing a plurality of sheets of paper P stacked on each other and is attached detachably to the printer 100 with the paper P stored in the paper feed tray 1. To attach the paper feed tray 1, it is inserted into the printer 100 almost horizontally from the front of the printer 100 (the left in FIG. 1) to the depth thereof (the right in FIG. 1).

As shown in FIG. 2, a plurality of the paper feed rollers 3 (in the embodiment, five) are attached to a paper feed roller shaft 3*a*. A rubber member 3*b* is attached to the face of each of some of the paper feed rollers 3 (in the embodiment, three) so that paper P is wound around the face for each feed. The rubber member 3*b* is not attached to the face of each of other paper feed rollers 3 (in the embodiment, two), which aid in feeding the paper P by the paper feed rollers 3 each having the rubber member 3*b*. The paper feed rollers 3 are rotated forward and reversely on the paper feed roller shaft 3*a* by a drive motor 500 shown in FIG. 42.

Figure 42:
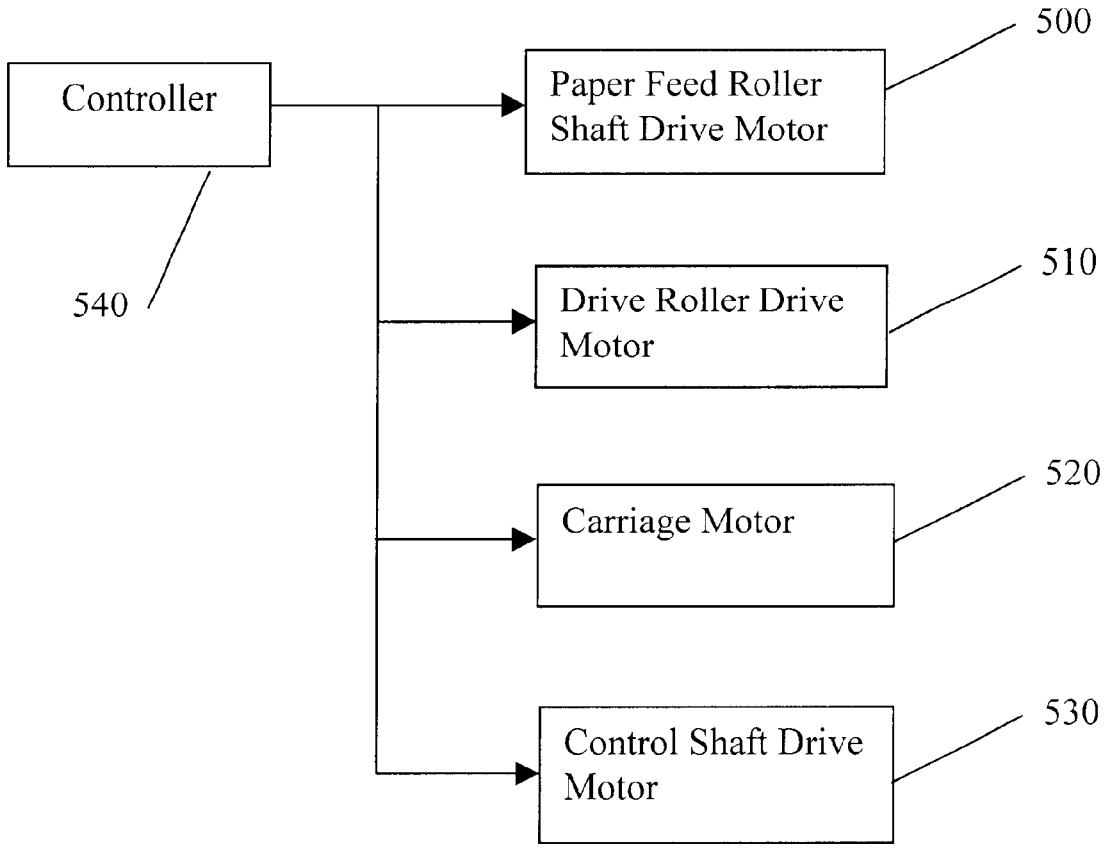
FIG. 42 is a block diagram of a controller and various drive motors of the printer.

The transport roller 6 comprises a drive roller 6*a* rotated by a drive motor 510 shown in FIG. 42 and a driven roller 6*b* pressed against the drive roller 6*a* and rotated accordingly. The transport roller 6 transports the paper P sandwiched between the drive roller 6*a* and the driven roller 6*b* in a subscanning direction (left in FIG. 1) at constant pitches.

The carriage 8 is reciprocated in a main scanning direction (face and back direction of the plane of FIG. 1) along a guide shaft 12 by a carriage motor 520 shown in FIG. 42. An ink cartridge 8*a* is attached detachably to the carriage 8 and ink in the ink cartridge 8*a* is sent to a recording head 8*b* placed on a face of the carriage 8 opposed to the paper P. The recording head 8*b* ejects ink through nozzle rows (not shown) formed on the face opposed to the paper P to the paper P transported onto a platen 9, thereby printing.

The control shaft 5 is disposed in parallel with the paper feed roller shaft 3*a* slantingly below the rear of the paper feed rollers 3. The control shaft 5 can be rotated forward and reversely by a drive motor 530 shown in FIG. 42 independently of the paper feed rollers 3, the transport roller 6, and the paper discharge roller 7. As shown in FIGS. 2 and 3, a slit wheel 90 for detecting a rotation reference position of the control shaft 5 is attached to the left end part of the control shaft 5. A slit (not shown) is made diametrically in the slit wheel 90 and an optical sensor (not shown) for allowing light to pass through the slit is placed close to the slit wheel 90. The position where light of the optical sensor passes through the center of the slit is the rotation reference position of the control shaft 5, which will be hereinafter referred to also as "position at rotation angle of zero degrees." As shown in FIG. 2, a hopper cam 21, driven roller units 40 and 41, a separation pad unit 30, and paper returner units 50 are placed along the control shaft 5. Also, a controller 540 (FIG. 42) respectively controls the feed roller 3, the transport roller 6, the carriage 8, and the control shaft 5 via the motors 500, 510, 520, and 530.

The hopper 2 and the hopper holder 18 serving as an abutment driver are placed below the paper feed tray 1. The hopper 2 is attached to the bottom of the paper feed tray 1 for forward and reverse rotation on a hopper shaft 2*a*, forming a part of the bottom of the paper feed tray 1. The hopper holder. 18 is placed below the hopper 2. Also shown in FIG. 2, the hopper holder 18 has a fulcrum shaft 18*a* and is attached to a main unit frame (not shown) of the printer 100 for forward and reverse rotation on the fulcrum shaft 18*a*. A spring 18*b* for urging the hopper holder 18 upward is attached to the right end part of the hopper holder 18 and a convex part 18*c* for pushing up the lower part of the hopper 2 is formed at the left end part.

As shown in FIG. 2, a hook-shaped arm 18*d* is extended to the right end part of the hopper holder 18 and a hopper cam follower part 18*e* is formed at the tip of the hopper holder 18. The hopper cam follower part 18*e* engages a hopper cam 21 (also see FIG. 3) fixed to the control shaft 5. As the hopper cam 21 is rotated with rotation of the control shaft 5, the hopper cam follower part 18*e* abuts the hopper cam 21 and the abutment is released, whereby the hopper holder 18 is rotated on the fulcrum shaft 18*a* and is displaced. As the hopper holder 18 is rotated and displaced, the hopper 2 is also rotated on the hopper shaft 2*a* and is displaced, whereby the paper P placed on the hopper 2 is pressed against the roller faces of the paper feed rollers 3 and pressing the paper P against the roller faces is released.

Thus, the convex part 18*c* as the force acting point for rotating and displacing the hopper 2 is placed between the fulcrum shaft 18*a* and as the rotation fulcrum of the hopper holder 18 and the hopper cam follower part 18*e* as the force application point. The force acting point is thus placed, whereby a rotation displacement amount error caused by the manufacturing tolerances of the hopper cam 21 and the hopper cam follower part 18*e* can be decreased at the force acting point and consequently, the displacement amount error of the hopper 2 can be made highly accurate all the more. The force applied to the force application point can be made smaller than that when the force application point is inside the force acting point and consequently, the motor for rotating the control shaft 5 can also be miniaturized and less consume power.

The hopper cam 21, the hopper cam follower part 18*e*, and the hopper holder 18 and the hopper 2 joined thereto will be described later in detail.

In the proximity of the paper feed rollers 3A, an upstream auxiliary roller 10 is placed for taking the sheets of paper below the top sheet overlapping thereon off the paper feed rollers 3. The upstream auxiliary roller 10 is attached to an auxiliary roller holder 10*a*. A drive motor is not joined to the upstream auxiliary roller 10 and as the paper P is fed, the upstream auxiliary roller 10 comes in contact with the paper P and rotates freely. The upstream auxiliary roller 10 will be described later in detail in second and third embodiments of the invention.

The separation pad unit 30 serving as a first separator, comprises a pad holder 11 and a separation pad 11*a* (see FIG. 2) is placed below the rear of the paper feed rollers 3. As shown in FIG. 3, a pad cam 31 fixed to the control shaft 5 (not shown in FIG. 1 or 2) is placed in the separation pad unit 30, and the pad holder 11 engages the pad cam 31. The pad holder 11 can be advanced to and retreated from the paper feed rollers 3 as the pad cam 31 is rotated with rotation of the control shaft 5, and the separation pad 11 a of the pad holder 11 is pressed against the roller faces of the paper feed rollers 3 and pressing the separation pad 11*a* against the roller faces is released. Letting the friction coefficient between the rubber member 3*b* and the paper P be $\mu 1$, the friction coefficient between the separation pad 11*a* and the paper P be $\mu 2$, and the friction coefficient between sheets of the paper P be $\mu 3$, wherein, $\mu 1 > \mu 2 > \mu 3$. The friction coefficient $\mu 2$ is set larger than the friction coefficient between a guide face of a paper guide member 16 (described later) and the paper P. The separation pad unit 30 comprising the pad holder 11 and the separation pad 11*a* will be described later in detail.

A plurality of paper feed driven rollers 4 (in the embodiment, three) are placed on the rear of the paper feed rollers 3. The paper feed driven rollers 4 are placed in the driven roller units 40 and 41 (see FIG. 2) and are disposed facing the paper feed rollers 3 each having the rubber member 3*b* (in the embodiment, three paper feed rollers). The driven roller unit 40 has two paper feed driven rollers 4 and the driven roller unit 41 has one paper feed driven roller 4. As shown in FIG. 3, driven roller cams 42 (not shown in FIG. 1 or 2) are fixed to the control shaft 5 and are placed in the driven roller units 40 and 41 and engages the paper feed driven rollers 4. The paper feed driven rollers 4 can be advanced to and retreated from the paper feed rollers 3 as the driven roller cams 42 are rotated with rotation of the control shaft 5, and the paper feed driven rollers 4 are pressed against the roller faces of the paper feed rollers 3 and pressing the paper feed driven rollers 4 against the roller faces is released. The driven roller unit 40 comprising the paper feed driven rollers 4 and the driven roller cams 42 will be described later in detail.

In the surroundings of the paper feed rollers 3, paper guide members 16 and 17 for guiding the paper P along the outer peripheral faces of the paper feed rollers 3 are placed at a given distance (for example, 2 mm) from the outer peripheral faces of the paper feed rollers 3 (outer peripheral faces of the rubber members 3*b*). A third paper guide member 19*a* and a fourth paper guide member 19*b* are placed above and below between the paper feed rollers 3 and the transport roller 6. A guide face of the third paper guide member 19*a* and a guide face of the fourth paper guide member 19*b* are placed at a given distance (for example, 2 mm) from each other and a feeding path is formed between the guide faces. A plurality of freely rotatable guide rollers 15 for smoothly feeding the paper P and preventing damage to the paper P are attached to the arcuate guide faces (inner peripheral faces) of the guide members 17 and 19*a*.

A paper detector 13 is attached between the paper feed rollers 3 and the transport roller 6 for detecting the tip and the termination of paper P. A detection signal of the paper detector 13 is given to a controller (not shown) and is used to sense the current position of the paper P, identify the size of the paper P, etc.

As shown in FIGS. 2 and 3, the paper returner units 50 (not shown in FIG. 1) are placed in the proximity of the sides of the separation pad unit 30 and the driven roller unit 41. The right paper returner unit 50 is placed almost at the center position in the width direction of normal paper (for example, A4-sized paper in portrait format) P printed on the printer 100.

A returner lever (not shown in FIGS. 1 to 3) and a returner cam fixed to the control shaft 5 (not shown in FIGS. 1 to 3), serving as a material returner are placed in each of the paper returner units 50. The returner lever engages the returner cam and is rotated and displaced as the returner cam is rotated with rotation of the control shaft 5, returning paper P to the paper feed tray 1. The paper returner units 50 each comprising the returner lever and the returner cams will be described later in detail.

The hopper 2; the hopper holder 18 and the hopper cam 21; the separation pad unit 30 and the pad cam 31; the paper returner units 50 and the returner cams; and the driven roller units 40 and the driven roller cams 42 described above will be discussed separately in detail and then the paper feed operation in the printer 100 in conjunction with the components will be discussed.

Figure 4A:
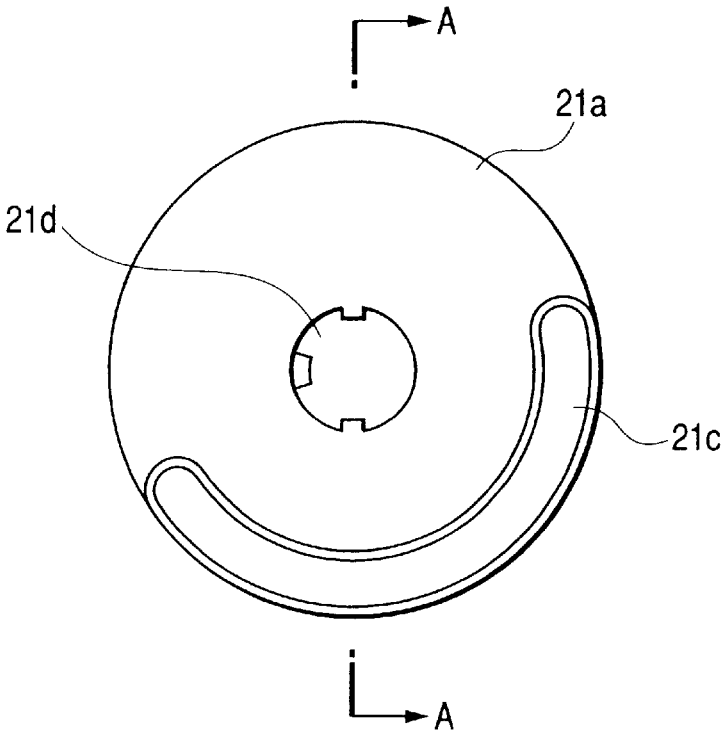
FIG. 4A is a side view of a hopper cam.
Figure 4B:
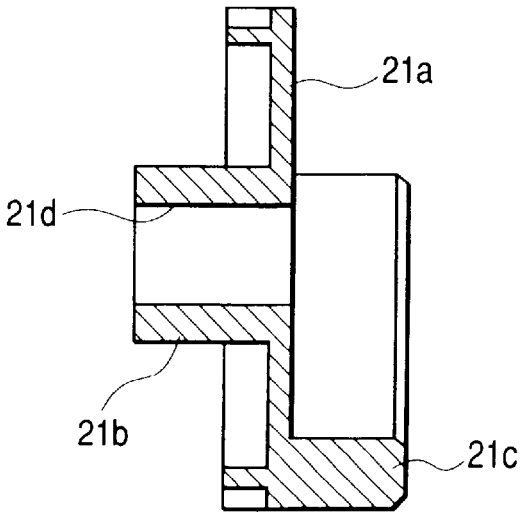
FIG. 4B is a sectional view taken on line A—A in FIG. 4A.

The specific configurations and operation of the hopper 2, the hopper holder 18, and the hopper cam 21 will be discussed. FIGS. 4A and 4B show the hopper cam 21; FIG. 4A is a side view of the hopper cam 21 and FIG. 4B is a sectional view taken on line A—A in FIG. 4A. The hopper cam 21 comprises a disc-like main body part 21*a* having a through hole 21*d* into which the control shaft 5 is inserted and fixed, a bearing part 21*b* of the control shaft 5, and a cam part 21*c*. The cam part 21*c* is formed integrally with the main body part 21*a* and is projected in a rotation axis direction like a circular arc along the outer peripheral portion of the disc face of the main body part 21*a*. The range in which the cam part 21*c* is formed is the angle range in which the hopper holder 18 maintains a lowered state (see FIG. 26).

As shown in FIG. 2, the hopper cam 21 is placed at a position where the cam part 21*c* engages (abuts) the hopper cam follower part 18*e* of the hopper holder 1.8 in the control shaft 5, and is rotated integrally with the control shaft 5.

Figure 5A:
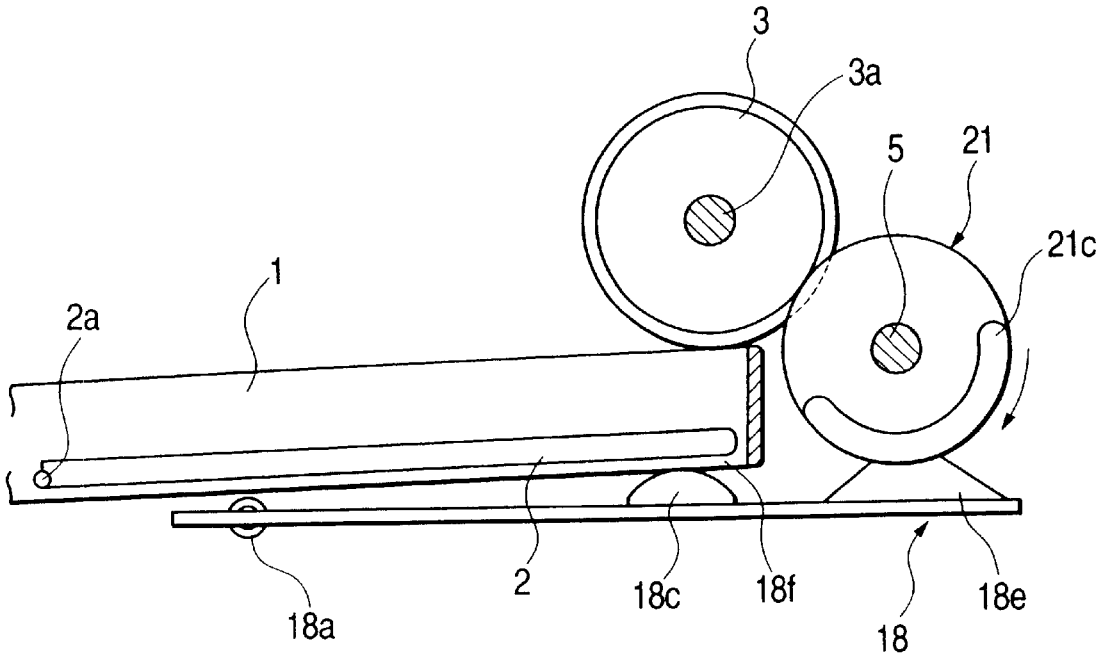
FIGS. 5A and 5B are drawings to show an operation flow of the hopper holder and the hopper with rotation of the hopper cam.

FIGS. 5 and 6 are drawings to show an operation flow of the hopper holder 18 and the hopper 2 with rotation of the hopper cam 21. FIG. 5A shows a state at the rotation reference position of the control shaft 5. The hopper cam follower part 18*e* has a front slope at the front (the left in FIG. 5) and a rear slope at the rear (the right in FIG. 5) and has at the top a concave curved face almost matching a curved face of the cam part 21*c*.

In the state shown in FIG. 5A, the outer peripheral face of the cam part 21*c* of the hopper cam 21 abuts the top (concave curved face) of the hopper cam follower part 18*e*, whereby the hopper holder 18 maintains a lowered state (almost horizontal state) against the urging force of the hopper spring 18*b* (not shown in FIG. 5 or 6; see FIGS. 1 and 2). The hopper 2 also maintains a lowered state (almost horizontal state) under its own weight and the weight of the paper P placed on the hopper 2. The hopper 2 and the hopper holder 18 are placed so that a slight gap 18*f* is formed between the hopper 2 and the convex part 18*c* of the hopper holder 21 in the state. The gap is provided so that rotation displacement of the hopper holder 18 is not instantly transmitted to the hopper 2 and so that vibration of the printer 100, etc., is not directly transmitted to the hopper 2.

Figure 5B:
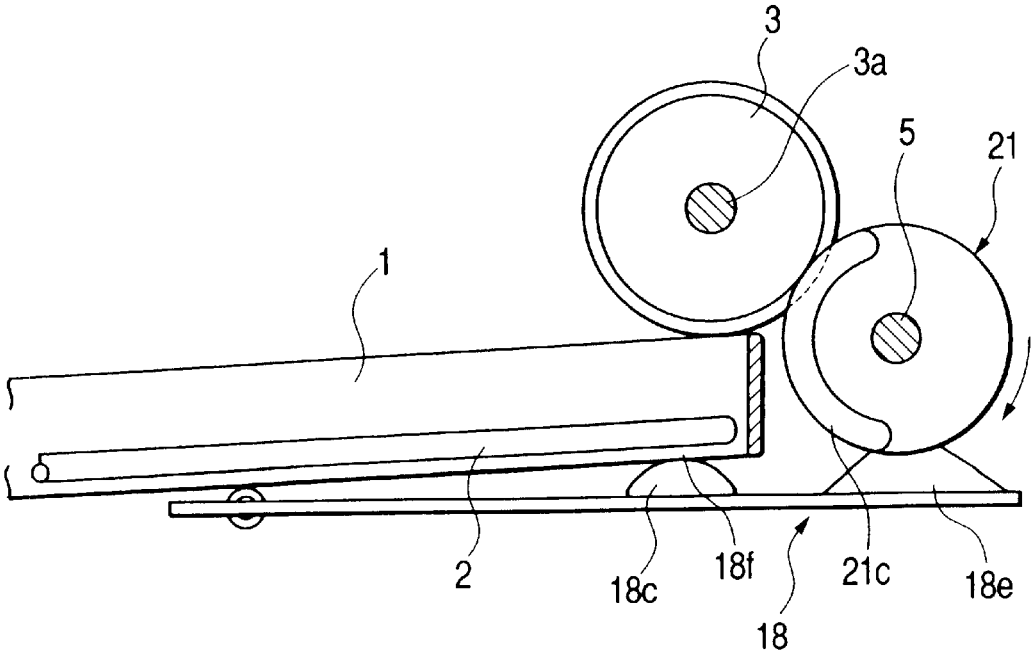
Figure 6A:
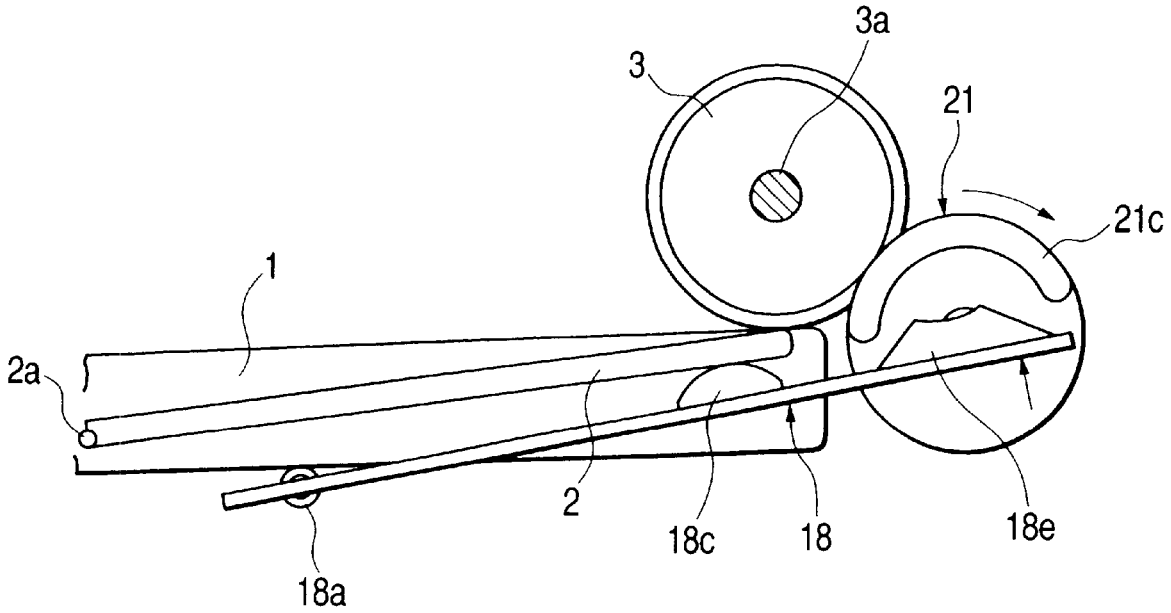
FIGS. 6A and 6B are drawings continued from FIGS. 5A and 5B.

FIG. 5B shows a state just before abutment of the cam part 21*c* and the hopper cam follower part 18*e* is released when the control shaft 5 is rotated clockwise from that state. FIG. 6A shows a state in which the control shaft 5 is further rotated clockwise. The abutment position of the rear end part of the cam part 21*c* is moved from the top of the hopper cam follower part 18*e* to the front slope with rotation of the hopper cam 21. Because of abutment against the front slope, the hopper holder 18 is slightly rotated counterclockwise on the fulcrum shaft 18*a* by the urging force of the hopper spring 18*b* and the convex part 18*c* starts to abut the hopper 2.

When the hopper cam 21 is further rotated, the abutment of the cam part 21*c* and the hopper cam follower part 18*e* is released. As the abutment is released, the hopper holder 18 is further rotated on the fulcrum shaft 18*a* counterclockwise by the urging force of the hopper spring 18*b*. Accordingly, the convex part 18*c*, pushes up the hopper 2, and the hopper 2 is rotated on the hopper shaft 2*a* counterclockwise and the front end part of the hopper 2 (right end part in FIG. 6) is moved up. Consequently, paper P (not shown in FIG. 6) placed on the hopper 2 is pressed against the roller faces of the paper feed rollers 3 (outer peripheral faces of the rubber members 3*b*). In this state, the paper feed rollers 3 start to rotate counterclockwise, the top sheet of the paper P is wound around the paper feed rollers 3, feeding the paper P is started, and the front end of the sheet of the paper P is sent to the position of the transport roller 6, as described later in detail.

Figure 6B:
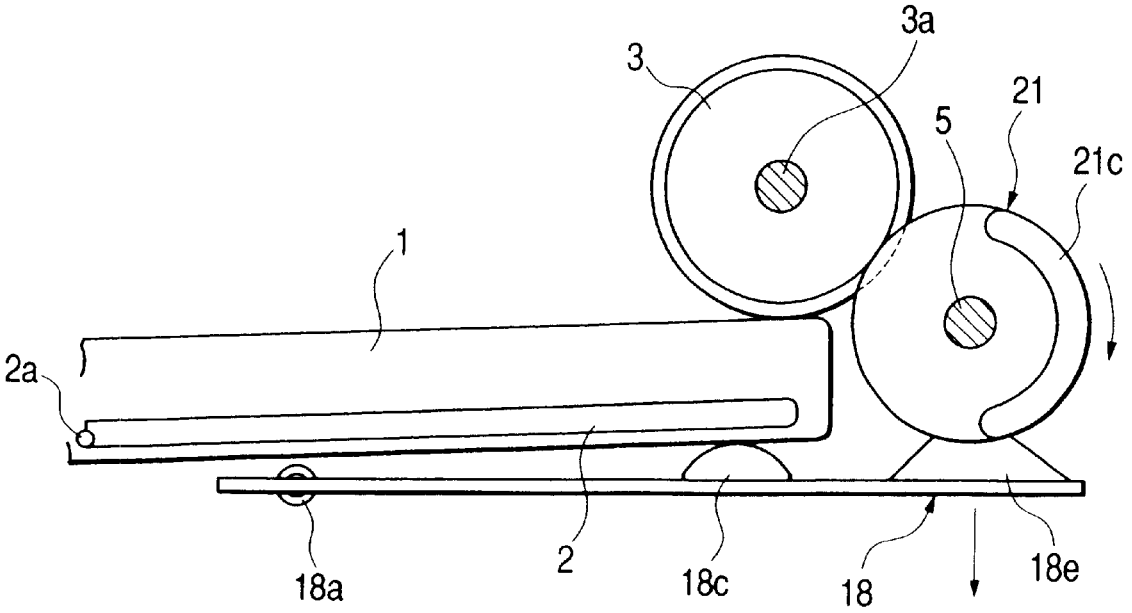

When feeding the paper P terminates, the control shaft 5 is again rotated clockwise and the front end part of the cam part 21*c* starts to abut the front slope of the hopper cam follower part 18*e* and then abuts the top of the hopper cam follower part 18*e* as shown in FIG. 6B. Accordingly, the hopper holder 18 is rotated on the fulcrum shaft 18*a* clockwise, and the hopper 2 pushed up by the convex part 18*c* is also rotated on the hopper shaft 2*a* clockwise. Consequently, the hopper holder 18 and the hopper 2 are restored to a similar state to the state shown in FIG. 5A. The control shaft 5 is further rotated clockwise and is returned to the rotation reference position shown in FIG. 5A.

Next, the specific configurations and operation of the separation pad unit 30 and the pad cam 31 will be discussed.

Figure 7A:
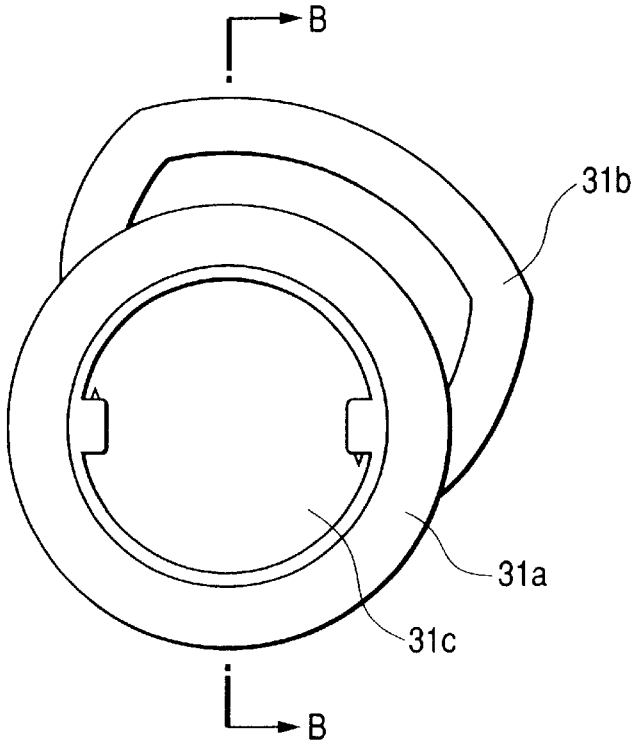
FIG. 7A is a side view of a pad cam.
Figure 7B:
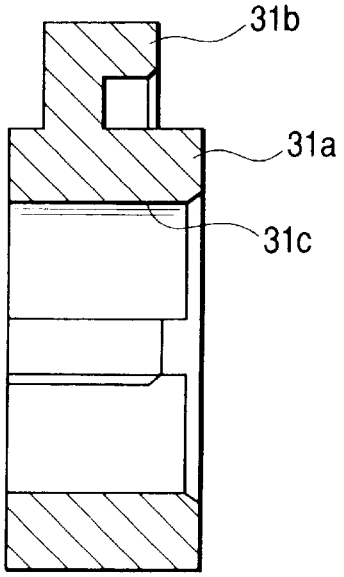
FIG. 7B is a sectional view taken on line B—B in FIG. 7A.

FIGS. 7A and 7B show the pad cam 31; FIG. 7A is a side view of the pad cam 31 and FIG. 7B is a sectional view taken on line B—B in FIG. 7A. The pad cam 31 comprises a cylindrical main body part 31*a* having a through hole 31*c* into which the control shaft 5 is inserted and fixed, and a cam part 31*b*. The cam part 31*b* is formed integrally with the main body part 31*a* and is projected diametrically in a part of the outer peripheral face of the main body part 31*a*. The range in which the cam part 31*b* is formed is the angle range in which the pad holder 11 maintains a state at a distance from the paper feed rollers 3 (see FIG. 26).

Figure 8:
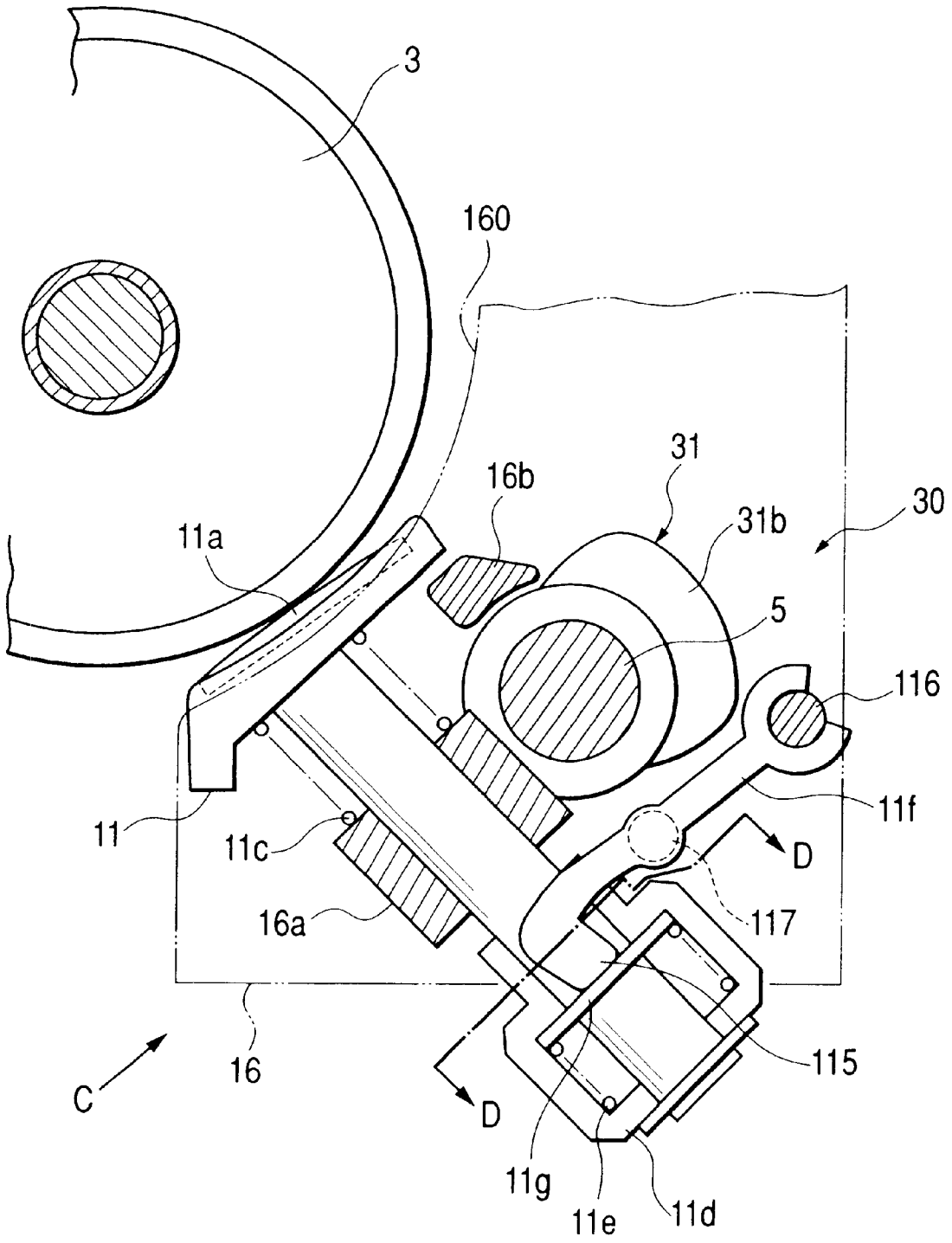
FIG. 8 is a side view to show the detailed configuration of a separation pad unit.
Figure 9:
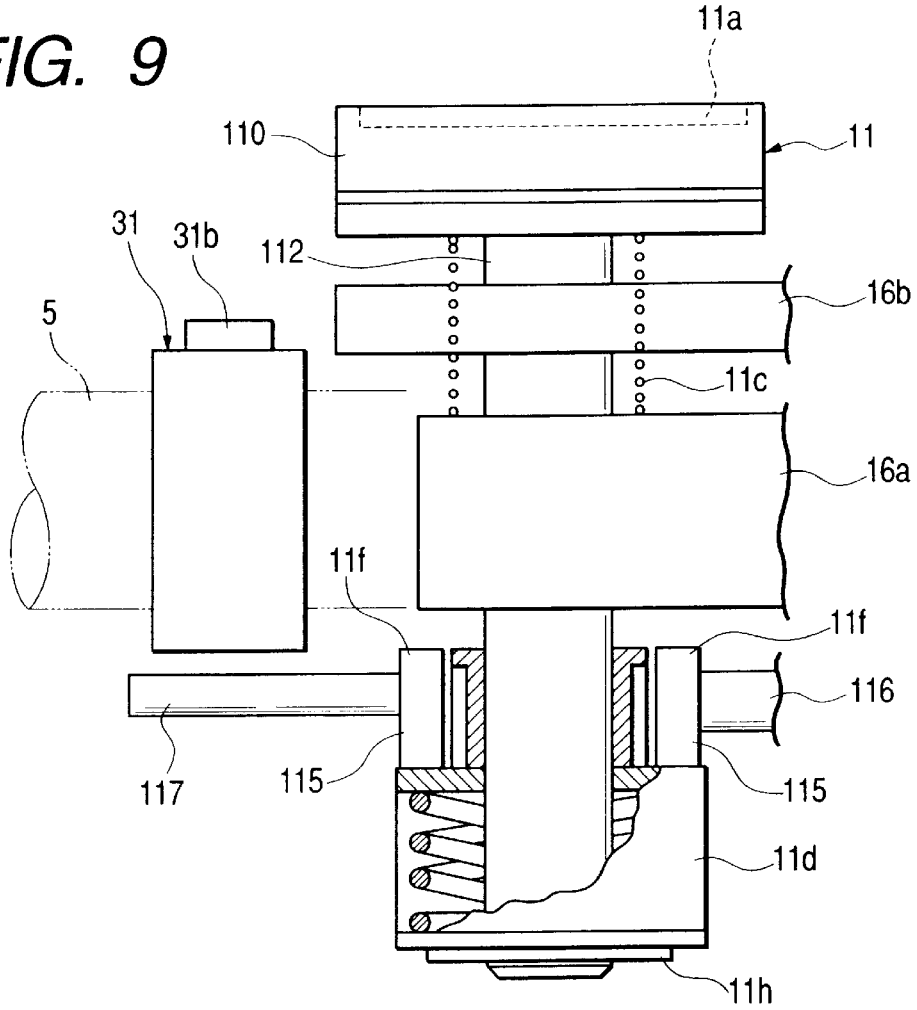
FIG. 9 is a fragmentary sectional view which is viewed from arrow C in FIG. 8.
Figure 10:
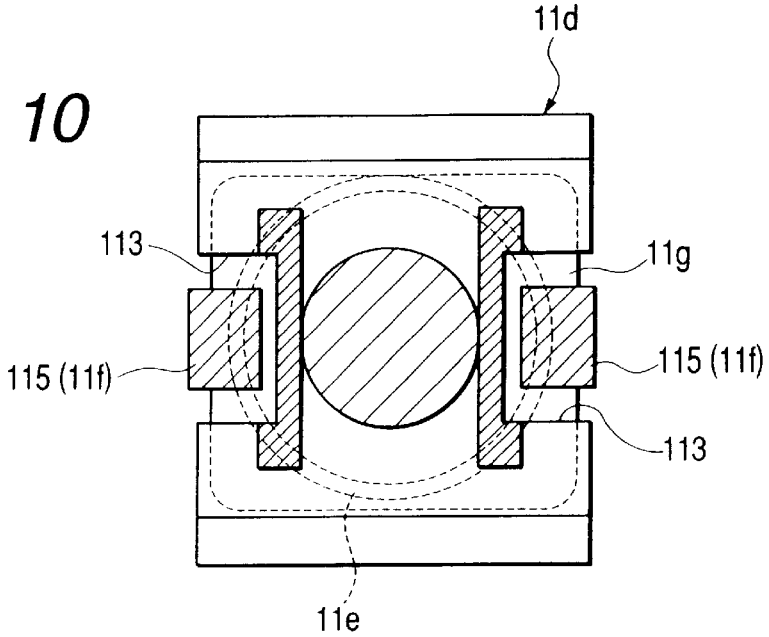
FIG. 10 is a sectional view taken on line D—D in FIG. 8.

FIG. 8 is a side view to show the detailed configuration of the separation pad unit 30, and FIG. 9 is a fragmentary sectional view which is viewed from arrow C in FIG. 8. FIG. 10 is a sectional view taken on line D—D in FIG. 8. The separation pad unit 30 comprises the above-mentioned pad holder 11, the above-mentioned separation pad 11*a*, a first pad spring (helical compression spring) 11*c*, a pad spring holder 11*d*, and a pad release lever 11*f*. The separation pad unit 30 is also provided with a pad base member (not shown) attached to a base frame (not shown) of the printer 100. The pad base member is formed with a pad guide member 16*a* for supporting the pad holder 11 and a rotation shaft 116 of the pad release lever 11*f*. The above-mentioned paper guide member 16 is provided with a stopper 16*b* for defining the distance of the pad holder 11 away from the paper feed rollers 3.

The pad holder 11 is shaped like T having a head part 110 and a shaft part 112. The separation pad 11*a* is attached to the top face of the head part 110. The separation pad 11*a* is formed of a member having the above-mentioned friction coefficient $\mu 2$ (friction coefficient between the separation pad 11*a* and paper P). The shaft part 112 pierces the pad guide member 16*a* and the operation of advancing to or retreating from the paper feed rollers 3 (namely, a move between the abutment position against the paper feed rollers 3 and the position at a distance from the paper feed rollers 3) is guided by the pad guide member 16*a*. The first pad spring 11*c* is placed between the head part 110 and the pad guide member 16*a* in the surroundings of the shaft part 112 for urging the pad holder 11 toward the paper feed rollers 3.

The pad spring holder 11*d* is attached to a lower end part of the shaft part 112 by a fixing member (for example, an E ring) 11*h* so that it can be operated integrally with the shaft part 112. The pad spring holder 11*d* houses a second pad spring (helical compression spring) 11*e* and a spacer 11*g* placed on an upper top end of the second pad spring 11*e* (an end part on the side of the paper feed rollers 3). The second pad spring 11*e* urges the spacer 11*g* toward the paper feed rollers 3 and the urging force of the second pad spring 11*e* is set stronger than that of the first pad spring 11*c*. Two rectangular openings 113 are made in the upper face of the pad spring holder 11*d* and two hook-shaped tip parts 115 of the pad release lever 11*f* can directly press the spacer 11*g* via the openings 113.

The pad release lever 11*f* is attached to the rotation shaft 116 formed on the pad base member (not shown) for rotation. A pad cam follower part 117 extended to the position of the pad cam 31 in parallel with the control shaft is formed integrally with the pad release lever 11*f* at the center thereof.

The stopper 16*b* is placed at a position where the separation pad 11*a* slightly projects to the side of the paper feed rollers 3 from a guide face 160 of the paper guide member 16 (position where the separation pad 11*a* projects 0.5 mm, for example) if the lower face (rear of the top face) of the head part 110 of the pad holder 11 abuts the stopper 16*b* and the pad holder 11 stops. Thus, sheets of paper P below the top sheet are easily separated from the top sheet and overlap sheet feeding of paper (namely, feeding two or more sheets of paper P overlapping each other) is prevented, as described later.

The stopper 16*b* is placed directly in the paper guide member 16 rather than in the pad base member attached to the paper guide member 16, so that the projection dimension of the separation pad 11*a* from the guide face 160 can be set more accurately. If the stopper 16*b* is placed in the pad base member, attachment tolerances when the pad base member is attached to the paper guide member 16 are added, but to place the stopper 16*b* directly in the paper guide member 16, the attachment tolerances can be eliminated.

Figure 11:
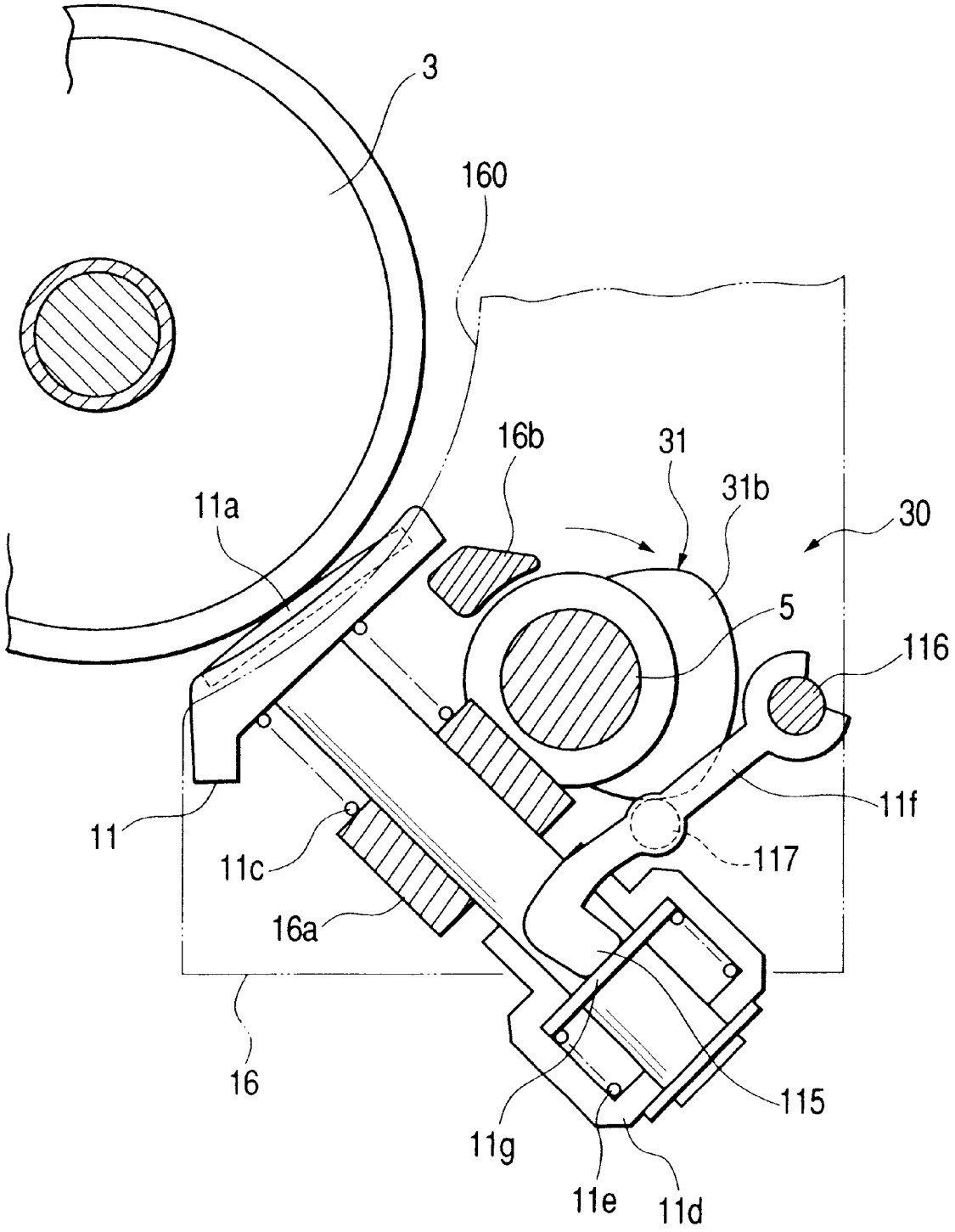
FIG. 11 is a drawing to show an operation flow of a pad holder with rotation of the pad cam.
Figure 12:
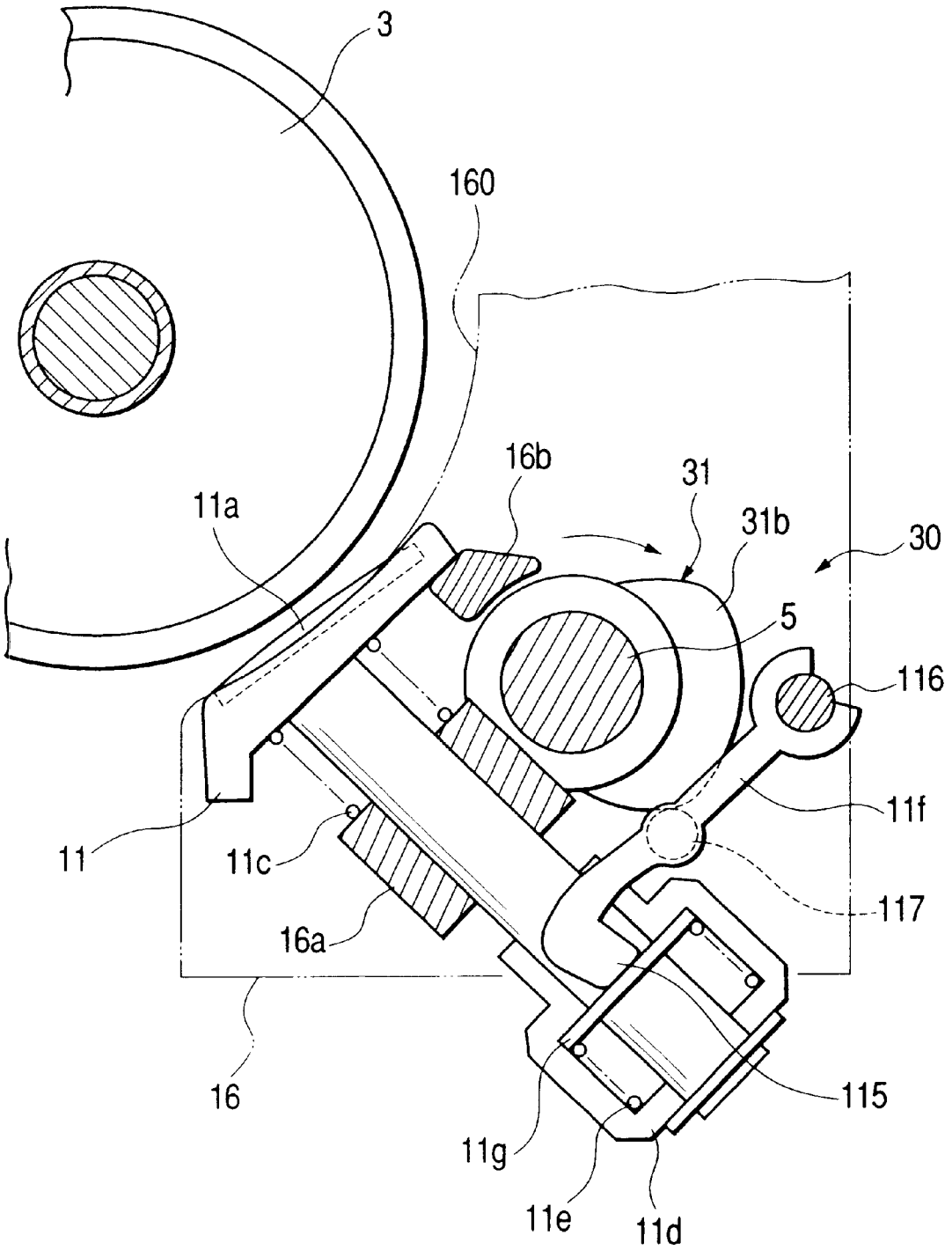
FIG. 12 is a drawing continued from FIG. 11.
Figure 13:
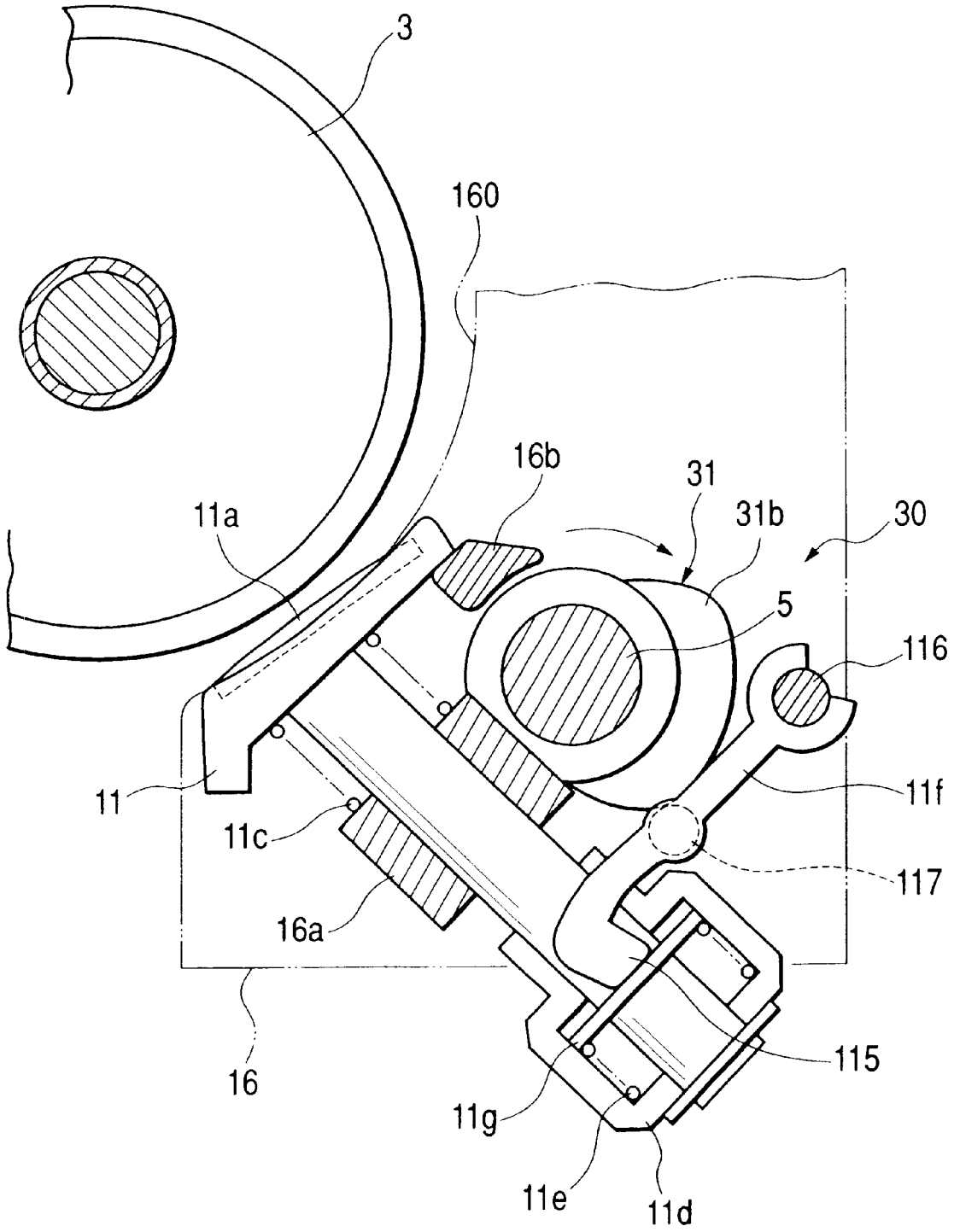
FIG. 13 is a drawing continued from FIG. 12.

Subsequently, the operation of the separation pad unit 30 will be discussed with reference to FIGS. 8 and 11 to 13. FIGS. 11 to 13 are drawings to show an operation flow of the pad holder 11 with rotation of the pad cam 31, continued from FIG. 8. FIG. 13 shows a state at the rotation reference position of the control shaft 5, but for convenience, a description is given starting at referring to FIG. 8.

In the state shown in FIG. 8, the cam part 31*b* of the pad cam 31 does not abut the pad cam follower part 117 and a force for bringing the pad holder 11 away from the paper feed rollers 3 does not act on the pad holder 11. Thus the pad holder 11 moves toward the paper feed rollers 3 by the urging force.of the first pad spring 11*c* and abuts (presses) the separation pad 11*a* against the outer peripheral face of the rubber members 3*b* of the paper feed rollers 3 and stops.

FIG. 11 shows a state in which the control shaft 5 is rotated clockwise from that state and abutment of the cam part 31*b* and the pad cam follower part 117 is started. FIG. 12 shows a state in which the control shaft 5 is further rotated clockwise. The cam part 31*b* presses the pad cam follower part 117 with rotation of the pad cam 31. Accordingly, the pad cam follower part 117 is rotated on the rotation shaft 116 counterclockwise and the tip parts 115 press the spacer 11*g* in the pad spring holder 11*d* in a direction away from the paper feed rollers 3.

At this time, the urging force of the second pad spring 11*e* is stronger than that of the first pad spring 11*c*, so that the second pad spring 11*e* is not compressed and the first pad spring 11*c* is first compressed and the pad holder 11 and the pad spring holder 11*d* are moved in the direction away from the paper feed rollers 3. The head part 110 of the pad holder 11 abuts the stopper 16*b* and moving the pad holder 11 and the pad spring holder 11*d* is stopped. As the pad holder 11 and the pad spring holder 11*d* are thus moved, the separation pad 11*a* is brought away from the roller faces of the paper feed rollers 3 and is placed slightly projecting from the guide face 160 of the paper guide member 16 by the stopper 16*b*.

FIG. 13 shows a state in which the control shaft 5 is further rotated from that state. As the pad cam 31 is rotated with rotation of the control shaft 5, the pad release lever 11*f* further presses the spacer 11*g*. On the other hand, the pad holder 11 and the pad spring holder 11*d* are regulated by the stopper 16*b* so as not to move. Therefore, the rotation displacement of the pad release lever 11*f* at this time is absorbed by the second pad spring 11*e* which is compressed. The stopper 16*b* and the second pad spring 11*e* are thus provided, whereby the precise separated position of the separation pad 11*a* can be defined easily. That is, it becomes unnecessary to make the dimensions of the pad cam 31, the pad spring holder 11*d*, and the pad release lever 11*f* accurate to precisely define the separated position of the separation pad 11*a*.

Figure 14A:
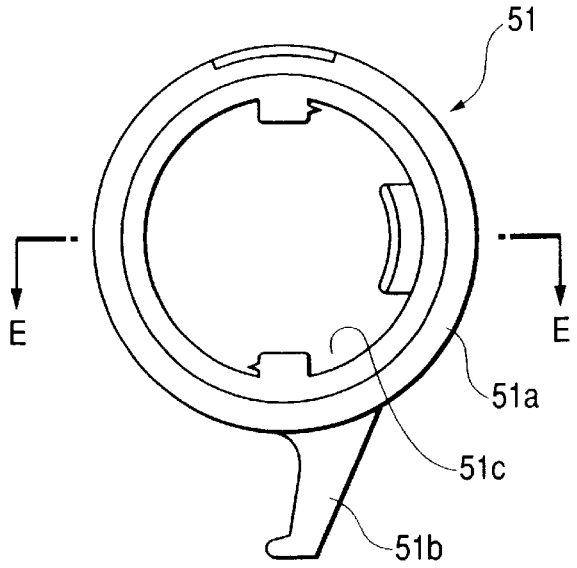
FIG. 14A is a side view of a returner cam.
Figure 14B:
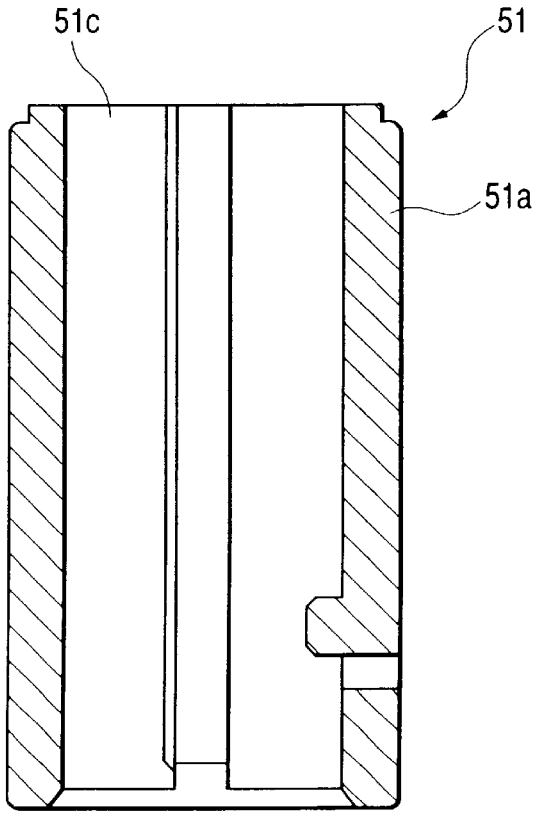
FIG. 14B is a sectional view taken on line E—E in FIG. 14A.

FIG. 14 shows a returner cam 51, FIG. 14A is a side view of the returner cam 51 and FIG. 14B is a sectional view taken on line E—E in FIG. 14A. The returner cam 51 comprises a cylindrical main body part 51*a* having a through hole 51*c* into which the control shaft 5 is inserted and fixed, and a cam part 51*b*. The cam part 51*b* is formed integrally with the main body part 51*a* and is shaped like a hook in a part of the outer peripheral face of the main body part 31*a*.

Figure 15:
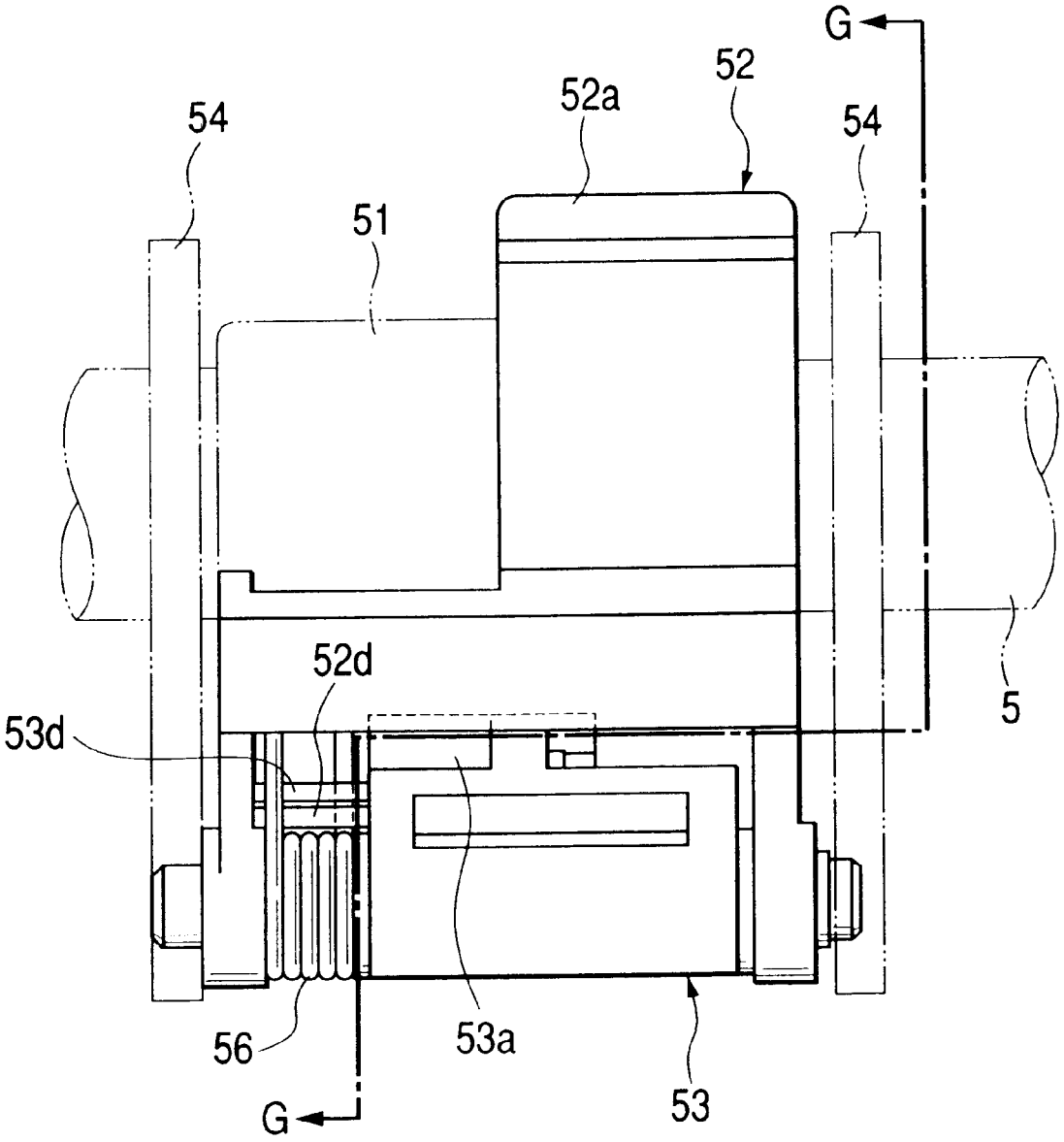
FIG. 15 is a front view of a paper returner unit.
Figure 16:
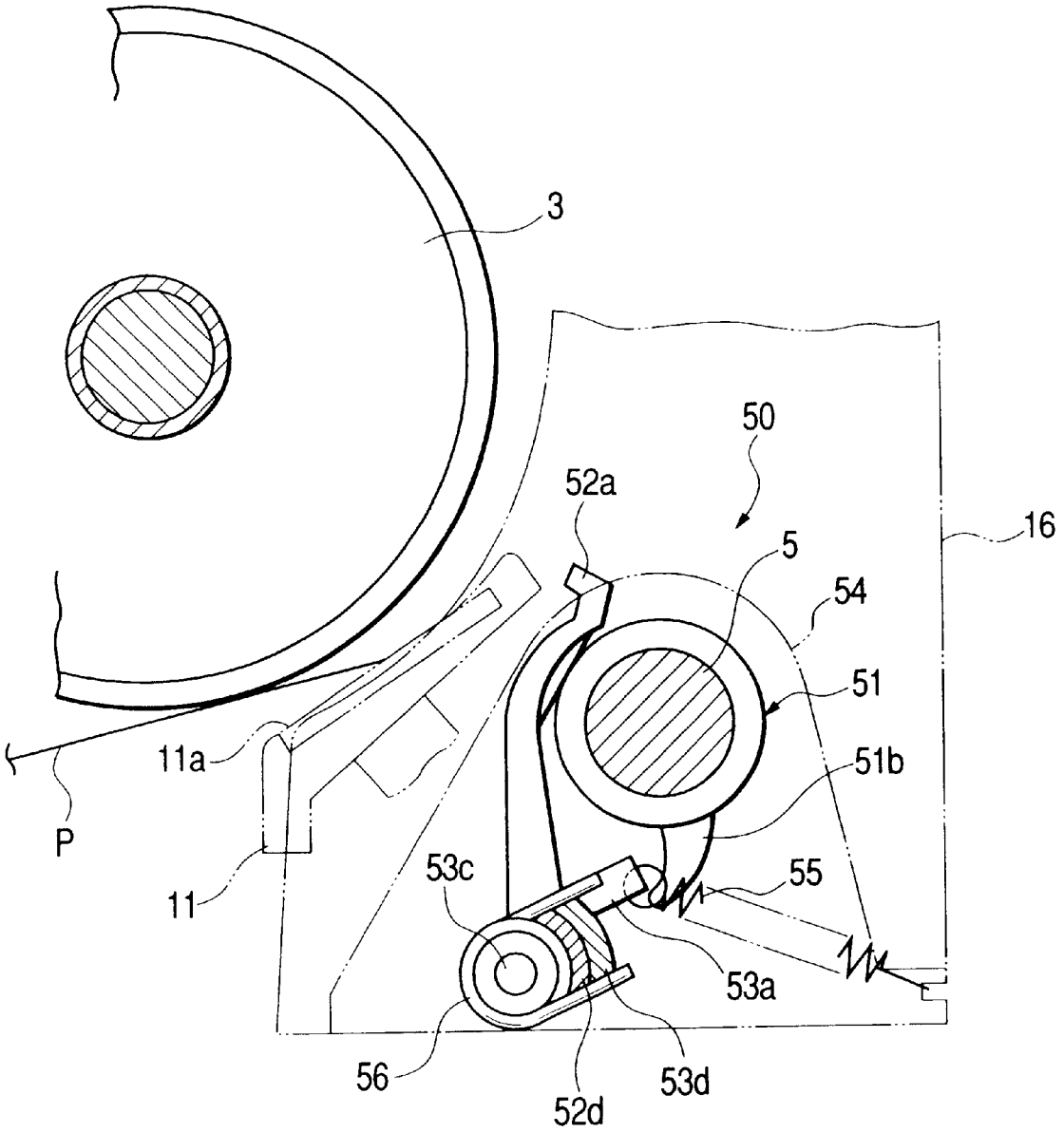
FIG. 16 is a sectional view taken on line G—G in FIG. 15.
Figure 17A:
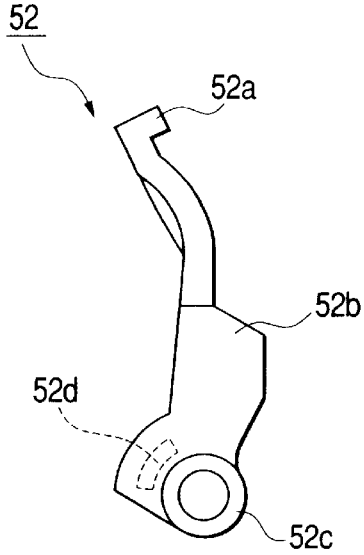
FIG. 17A is a left side view of a main lever.
Figure 17B:
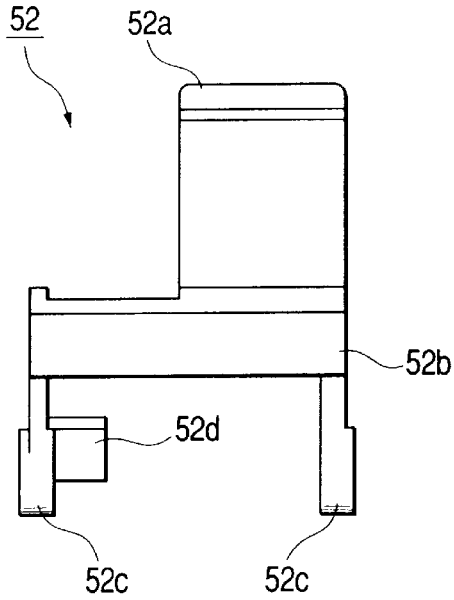
FIG. 17B is a front view of a main lever.
Figure 17C:
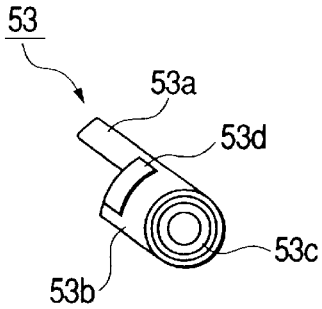
FIG. 17C is a left side view of the sublever shown at the attachment angle for attaching the sublever to the main lever in the state shown in FIG. 17A.
Figure 17D:
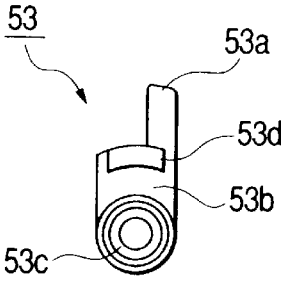
FIG. 17D is a left side view of the sublever.
Figure 17E:
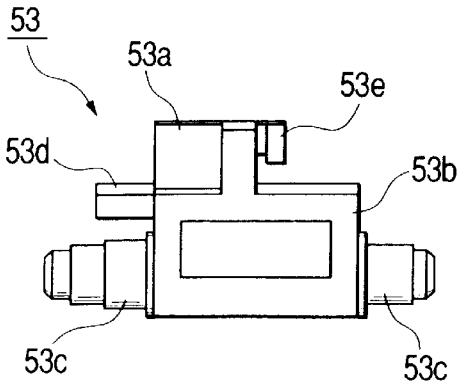
FIG. 17E is a front view of the sublever.

FIG. 15 is a front view of the paper returner unit 50 and FIG. 16 is a sectional view taken on line G—G in FIG. 15. FIGS. 17A to 17E show a main lever 52 and a sublever 53 making up the paper returner unit 50; FIG. 17A is a left side view of the main lever 52, FIG. 17B is a front view of the main lever 52, FIG. 17D is a left side view of the sublever 53, FIG. 17E is a front view of the sublever 53, and FIG. 17C is a left side view of the sublever 53 shown at the attachment angle for attaching the sublever 53 to the main lever 52 in the state shown in FIG. 17A.

As shown in FIGS. 15 and 16, the paper returner unit 50 comprises the main lever 52, the sublever 53, a returner holder 54, a first lever spring (helical tension spring) 55, and a second lever spring (torsion coil spring) 56. The urging force of the first lever spring 55 is set weaker than that of the second lever spring 56. Hereinafter, the main lever 52 and the sublever 53 will be collectively called "returner lever" in some cases .

As shown in FIGS. 17A and 17B, the main lever 52 comprises a hook-shaped lever part 52*a* for hooking the tip of paper and returning the paper to the paper feed tray 1 and a main body part 52*b* for housing the sublever 53 on the base end side of the lever part 52*a*, the lever part 52*a* and the main body part 52*b* being formed in one piece. The lever part 52*a* is set to a length engaging the tip of paper P when the tip is positioned on the separation pad 11*a* of the pad holder 11, as shown in FIG. 16. Through holes into which rotation shafts 53*c* of the sublever 53 are inserted are made in a base end of the main body part 52*b* and bearing parts 52*c* as bearings of the rotation shafts 53*c* are formed integrally. An engagement projection 52*d* shaped like a circular arc projected toward the inside of the main body part 52*b* and formed coaxially with the center axis of the left bearing part 52*c* is formed integrally at the rear of the left bearing part 52*c*.

As shown in FIGS. 17D and 17E, the sublever 53 comprises a cam follower part 53*a* engaging the cam part 51*b* of the returner cam 51 and a main body part 53*b* housed in the main body part 52*b*, the cam follower part 53*a* and the main body part 53*b* being formed in one piece. A spring hook part 53*e* to which one end part of the first lever spring 55 is attached is formed integrally at the right end of the cam follower part 53*a*. An opposite end part of the first lever spring 55 is attached to a rear end part of the returner holder 54, as shown in FIG. 16. The rotation shafts 53*c* inserted into the bearing parts 52*c* for rotation are formed integrally at both side ends of the main body part 53*b*. An engagement projection 53*d* shaped like a circular arc projected toward the outside of the sub body part 53*b* and formed coaxially with the center axis of the rotation shaft 53*c* is formed integrally at the left end to the main body part 53*b* and on the base end side of the cam follower part 53*a*. The engagement projection 53*d* is placed so that it is positioned outside the engagement projection 52*d* when the sublever 53 is attached to the main lever 52.

The main lever 52 and the sublever 53 are formed in one piece as follows: After the coil part of the second lever spring 56 (see FIGS. 15 and 16) is attached to the left rotation shaft 53*c*, the rotation shafts 53*c* are fitted into the bearing parts 52*c*. The sublever 53 is rotated and the attachment angle of the sublever 53 shown in FIG. 17C relative to the main lever 52 shown in FIG. 17A is set, whereby the engagement projection 53*d* is placed overlapping the outside of the engagement projection 52*d*. In this state, both terminals of the second lever spring 56 attached to the left rotation shaft 53*c* are attached so as to sandwich the engagement projection 52*d* and the engagement projection 53*d* overlapping each other.

Figure 18:
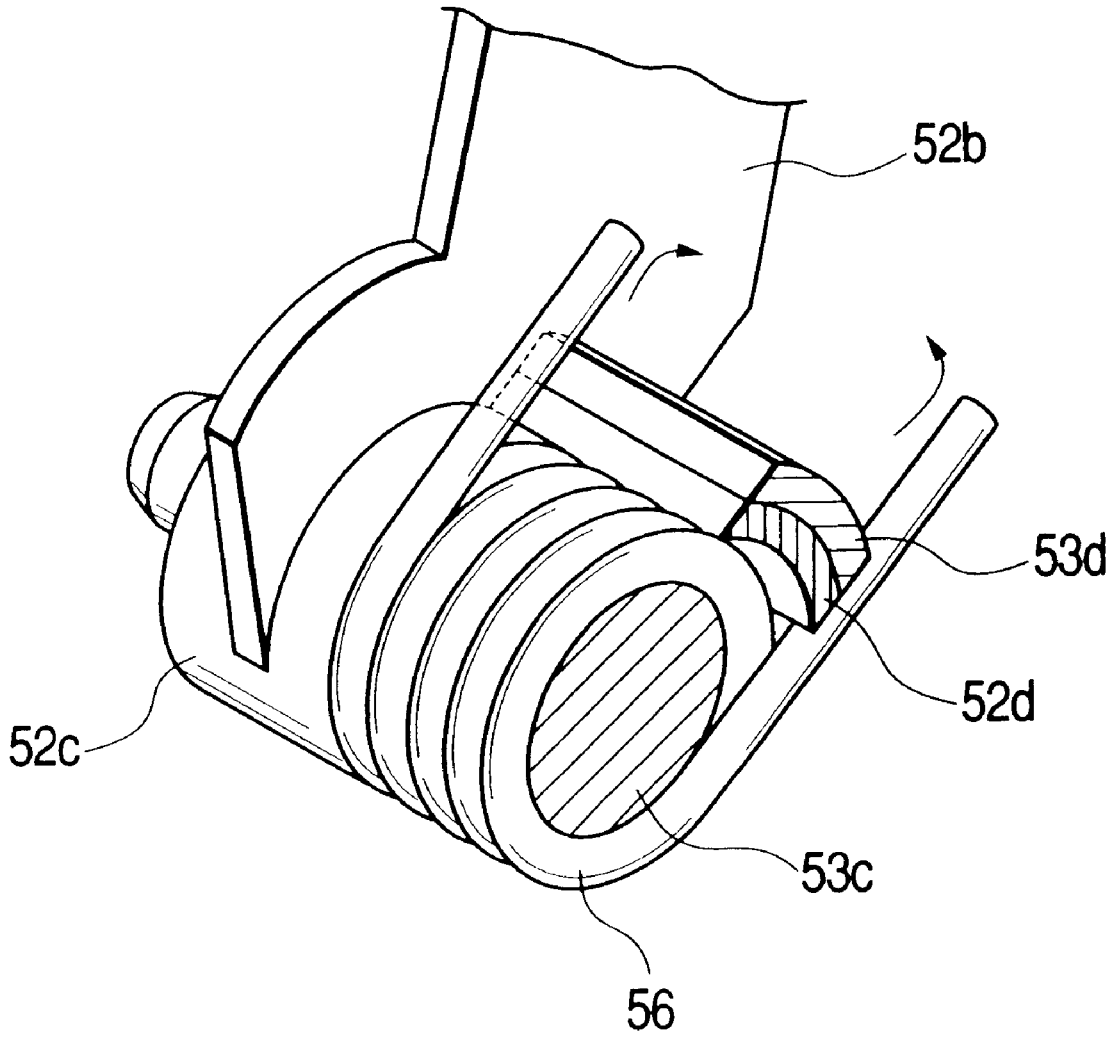
FIG. 18 shows a state in which an engagement projection and an engagement projection are sandwiched between terminals of a second lever spring.

FIG. 18 shows a state in which the engagement projection 52*d* and the engagement projection 53*d* are sandwiched between the terminals of the second lever spring 56. The second lever spring 56 urges the engagement projection 52*d* and the engagement projection 53*d* in the direction of the arrow shown in FIG. 18 for regulating both the engagement projection 52*d* and the engagement projection 53*d*, so that both are not separated from each other. The degree of the urging force of the second lever spring 56 will be discussed later in detail.

After the sublever 53 is attached to the main lever 52, the tip parts of both the rotation shafts 53*c* are attached to the returner holder 54 for rotation and the first lever spring 55 is placed between the spring hook part 53*e* and a rear end part of the returner holder 54 for pulling the sublever 53 to the rear (the right in FIG. 16).

Figure 19:
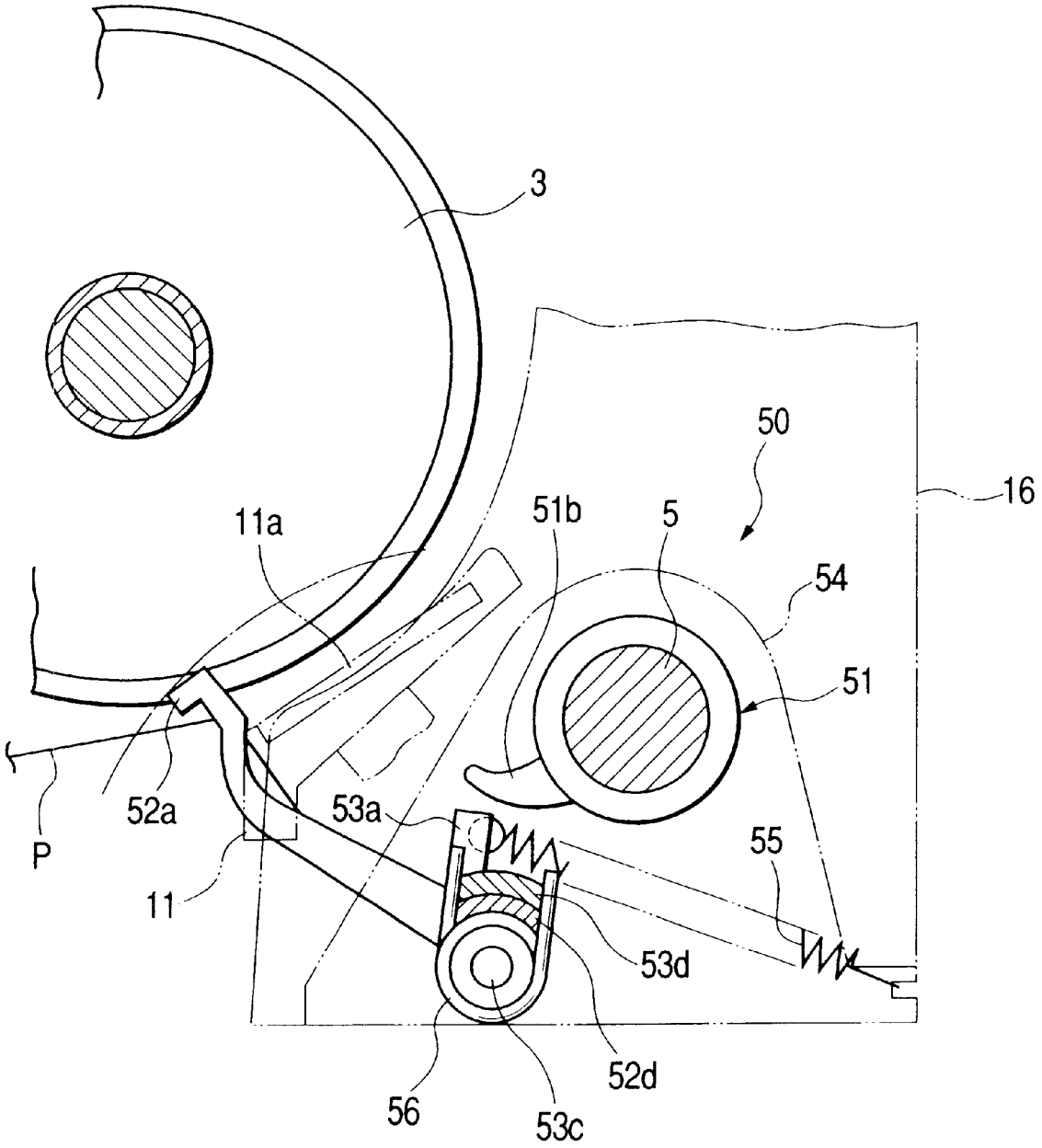
FIG. 19 is a side view to show operation when paper is normally returned to a paper feed tray.

Next, the paper return operation of the paper returner unit 50 will be discussed. FIGS. 16 and 19 show the operation when paper P is normally returned to the paper feed tray 1. The case where the paper P is normally returned to the paper feed tray 1 refers to the case where the tip of the paper P is positioned on the separation pad 11*a* (for example, the vicinity of the abutment center point (nip point) of the roller faces of the paper feed rollers 3 and the separation pad 11*a* and upstream from the vicinity) and the lever part 52*a* engages the tip of the paper P. FIG. 16 shows a state in which the control shaft 5 is at the rotation reference position. The paper returner unit 50 shown in FIG. 19 corresponds to the sectional view taken on line G—G in FIG. 15 like FIG. 16.

At the rotation reference position of the control shaft 5, the lever part 52*a* of the main lever 52 is placed at a standby position which is retreated to the inside of the paper guide member 16 in almost an upright state. The standby position is formed as follows: The sublever 53 is pulled to the rear by the first lever spring 55, whereby the main lever 52 is also pulled to the rear integrally with the sublever 53 by the engagement projection 52*d* and the engagement projection 53*d* sandwiched between the terminals of the second lever spring 56. The main lever 52 is regulated by the outer cylindrical face of the returner cam 51 so as not to rotate to the rear exceeding the standby position, but the sublever 53 is not thus regulated. However, the urging force of the second lever spring 56 is set stronger than that of the first lever spring 55, so that the sublever 53 is stopped at the standby position integrally with the main lever 52 by the urging force of the second lever spring 56.

At the rotation reference position, the cam part 51*b* of the returner cam 51 is positioned in the proximity of the cam follower part 53*a*, and the separation pad 11*a* of the pad holder 11 is at a distance from the paper feed rollers 3.

From this state, as the returner cam 51 is rotated with clockwise rotation of the control shaft 5, the cam part 51*b* abuts the cam follower part 53*a* and pushes the cam follower part 53*a* from the rear to the front. Accordingly, the sublever 53 and the main lever 52 are counterclockwise rotated integrally and the lever part 52*a* is rotated drawing a circular arc indicated by the chain line in FIG. 19 and is displaced to a returned position shown in FIG. 19. Consequently, the lever part 52*a* engages the tip of the paper P positioned on the separation pad 11*a* and returns the paper P to the paper feed tray 1.

Since the lever part 52*a* is placed at a position where it does not come in contact with the paper feed rollers 3 in the width direction of the paper P (namely, also the main scanning direction and the face and back direction of the planes of FIGS. 16 and 19), rotation displacement of the lever part 52*a* is not hindered by the paper feed rollers 3.

On the other hand, as described above, the right paper returner unit 50 shown in FIG. 2 is positioned at almost the center in the width direction of the paper P and thus the lever part 52*a* is operated on the center in the width direction of the paper P and the paper return operation is performed. Accordingly, paper can be returned more effectively than the case where the lever part 52*a* is operated on a side end part of the paper P.

In the state shown in FIG. 19, abutment of the cam part 51*b* and the cam follower part 53*a* is released and the main lever 52 and the sublever 53 are temporarily rotated clockwise by the urging force of the first lever spring 55 and are returned to the standby position.

Figure 20:
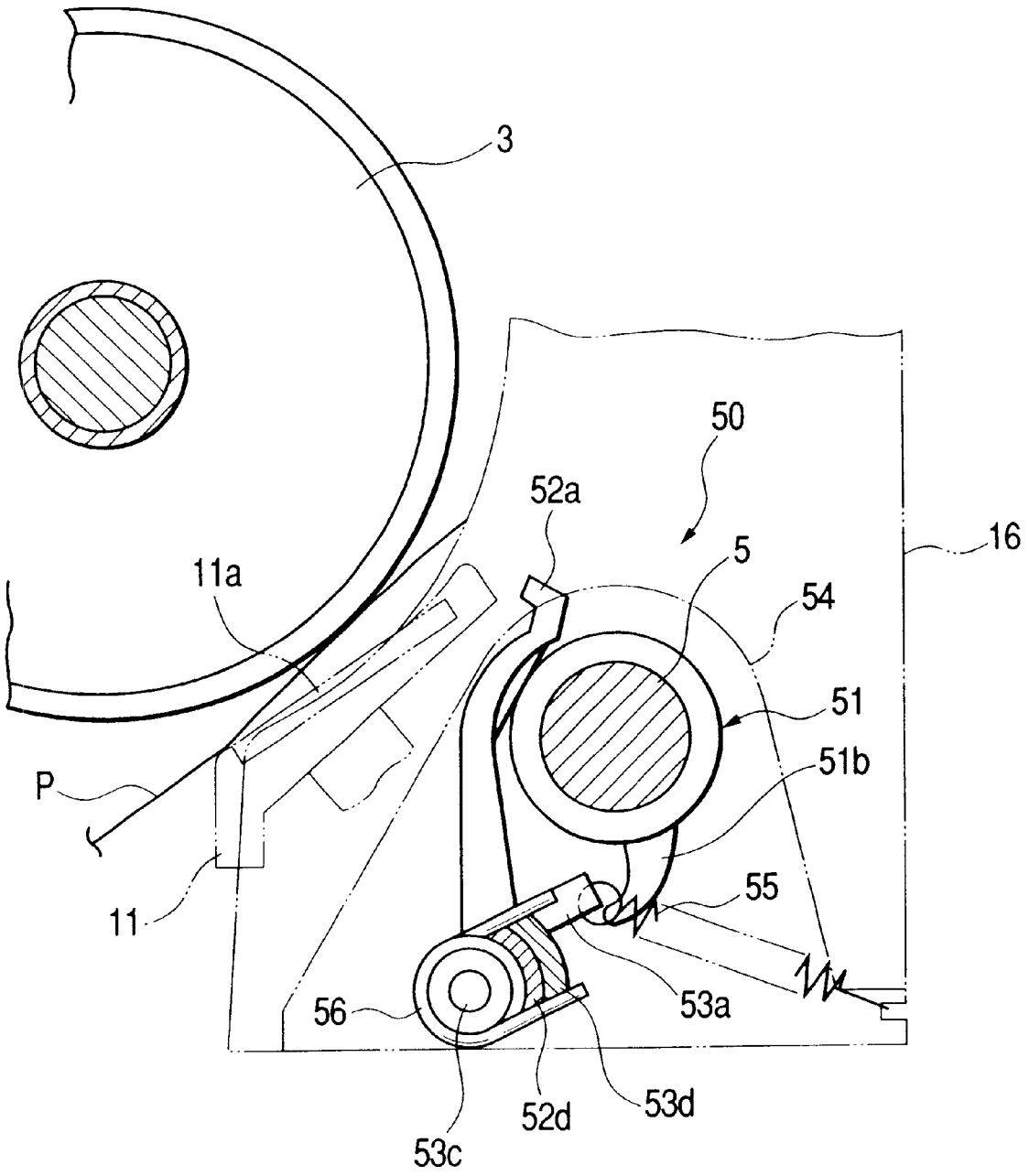
FIG. 20 is a side view to show operation when paper is not normally returned to the paper feed tray.
Figure 21:
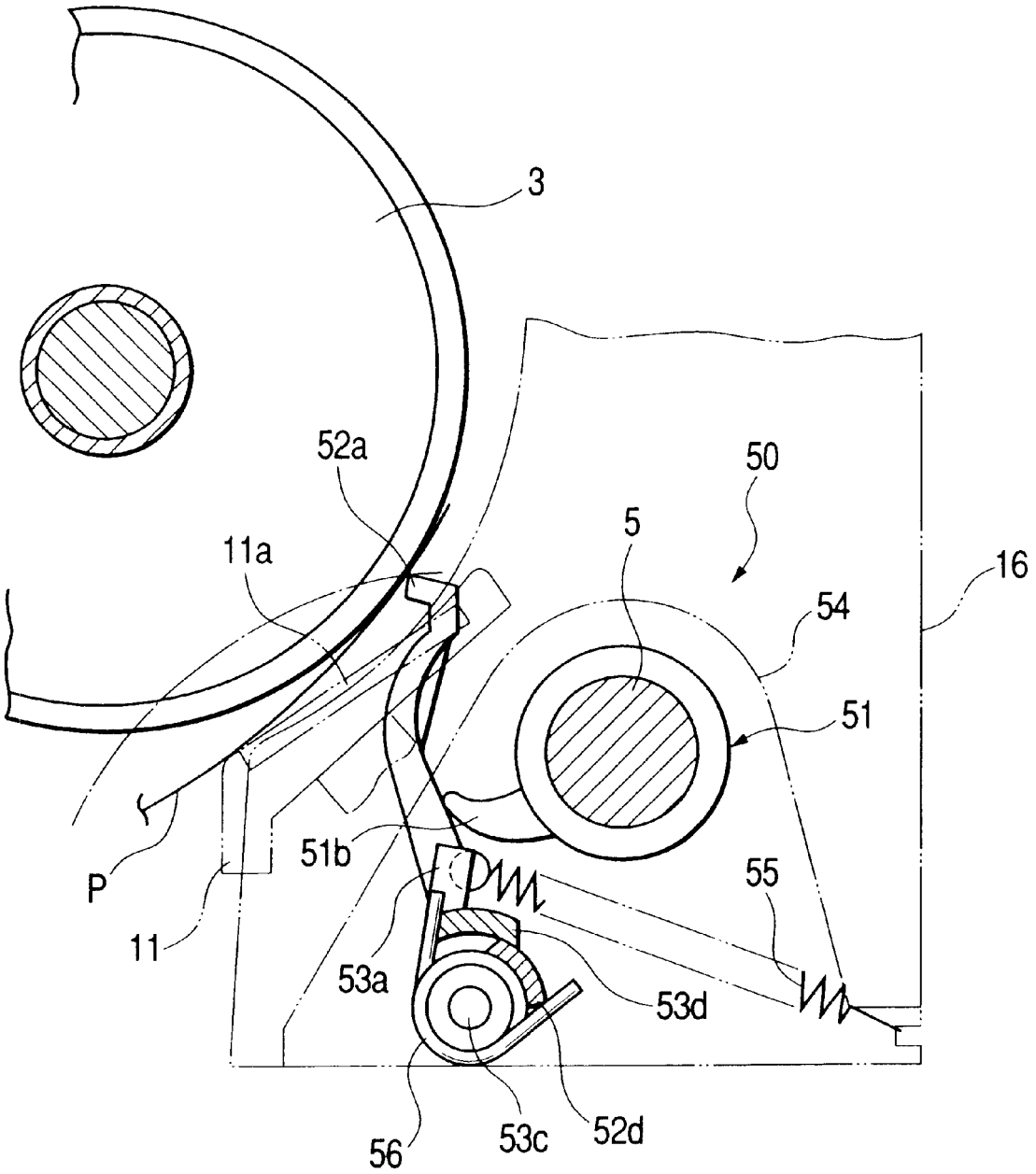
FIG. 21 is a side view to show operation when paper is not normally returned to the paper feed tray.

FIGS. 20 and 21 show the operation when paper P is not normally returned to the paper feed tray 1. The case where the paper P is not normally returned to the paper feed tray 1 refers to the case where the tip of the paper P is positioned downward exceeding the separation pad 11*a* (for example, the vicinity of the nip point) and the lever part 52*a* engages an intermediate point of the paper P rather than the tip thereof. Normally, a sheet of paper P below the top sheet is separated by the separation pad 11*a* and the tip of the sheet of paper P below the top sheet is positioned in the vicinity of the nip point of the separation pad 11*a*; however, if the electrostatic attraction force of the sheet of paper P is strong, etc., the sheet of paper P below the top sheet may be dragged with the top sheet and the tip may be positioned downward exceeding the separation pad 11*a*. A similar state may be entered if the user turns off the power of the printer 100 while paper P is being fed and again turns on the power in this state. FIG. 20 shows a state in which the control shaft 5 is at the rotation reference position. The paper returner unit 50 shown in FIGS. 20 and 21 corresponds to the sectional view taken on line G—G in FIG. 15.

At the rotation reference position of the control shaft 5, the main lever 52, the sublever 53, the returner cam 51, and the separation pad 11*a* of the pad holder 11 are placed at the same positions as those shown in FIG. 16.

From this state, as the returner cam 51 is rotated with clockwise rotation of the control shaft 5, the cam part 51*b* abuts the cam follower part 53*a* and pushes the cam follower part 53*a* from the rear to the front. Accordingly, the sublever 53 and the main lever 52 are counterclockwise rotated integrally and the lever part 52*a* is rotated drawing a circular arc indicated by the chain line in FIG. 21. However, as shown in FIG. 21, the lever part 52*a* abuts an intermediate part of the paper P while it is being rotated. Accordingly, the lever part 52*a* undergoes resistance under the own weight of the paper P and thus rotating the lever part 52*a* is stopped at the position where the lever part 52*a* abuts the paper P. On the other hand, the cam part 51*b* pushes the cam follower part 53*a* and attempts to further rotate the sublever 53. At this time, only the sublever 53 is rotated against the urging force of the second lever spring 56. Consequently, as shown in FIG. 21, both terminals of the second lever spring 56 are opened and the engagement projection 52*d* and the engagement projection 53*d* are displaced to a state in which only parts overlap each other or a state in which the engagement projection 52*d* and the engagement projection 53*d* do not overlap.

That is, the urging force of the second lever spring 56 is set so as to stop the main lever 52 and rotate only the sublever 53 if resistance under the own weight of the paper P is added to the lever part 52*a*. If the lever part 52*a* abuts an intermediate part of the paper P, it is stopped, so that the paper P is not damaged by the lever part 52*a*. That is, if the lever part 52*a* is further rotated in the state shown in FIG. 21, the lower part of the paper P is pushed up and other parts of the paper P are pressed by the paper feed rollers 3 and thus the paper P is sandwiched between the lever part 52*a* and the paper feed rollers 3, causing the paper P to become wrinkled or to be scratched in some cases, but the lever part 52*a* is stopped, whereby wrinkles and scratches are prevented.

In this case, the paper P is not returned to the paper feed tray 1; the paper P not returned can be returned to the paper feed tray 1 by reversely rotating the paper feed rollers 3 clockwise.

In the state shown in FIG. 21, abutment of the cam part 51*b* and the cam follower part 53*a* is released. First, the sublever 53 is rotated clockwise by the urging force of the first lever spring 55 and the engagement projection 53*d* overlaps the engagement projection 52*d* and then the main lever 52 and the sublever 53 are clockwise rotated integrally and are returned to the standby position.

After the paper return operation, the control shaft 5 can be reversely rotated and be returned to the rotation reference position after the main lever 52 and the sublever 53 are returned to the standby position, as described later. At the time, the returner cam 51 is also reversely rotated and consequently the cam part 51*b* abuts the cam follower part 53*a* in an opposite direction to the direction when the paper return operation is performed. In this case, the main lever 52 is attached so as not to retreat from the standby position and thus is not rotated or displaced as described above; the sublever 53 is rotated clockwise in FIG. 16 against the urging force of the second lever spring 56 and escapes from abutment of the cam part 51*b*. Thus, the returner cam 51 can also be returned to the rotation reference position as it is reversely rotated.

After escaping from the abutment of the cam part 51*b*, the sublever 53 is restored to the state shown in FIG. 16 by the urging force of the second lever spring 56.

Next, the specific configurations and operation of the driven roller unit 40 and the driven roller cam 42 will be discussed. The driven roller unit 41 has almost the same configuration as the driven roller unit, 40 except that it comprises only one paper feed driven roller 4, and therefore will not be discussed.

Figure 22A:
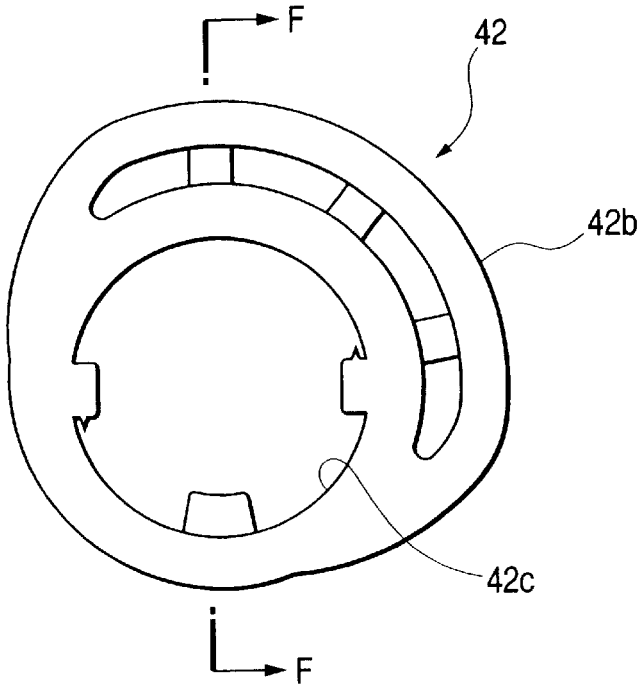
FIG. 22A is a side view of a driven roller cam.
Figure 22B:
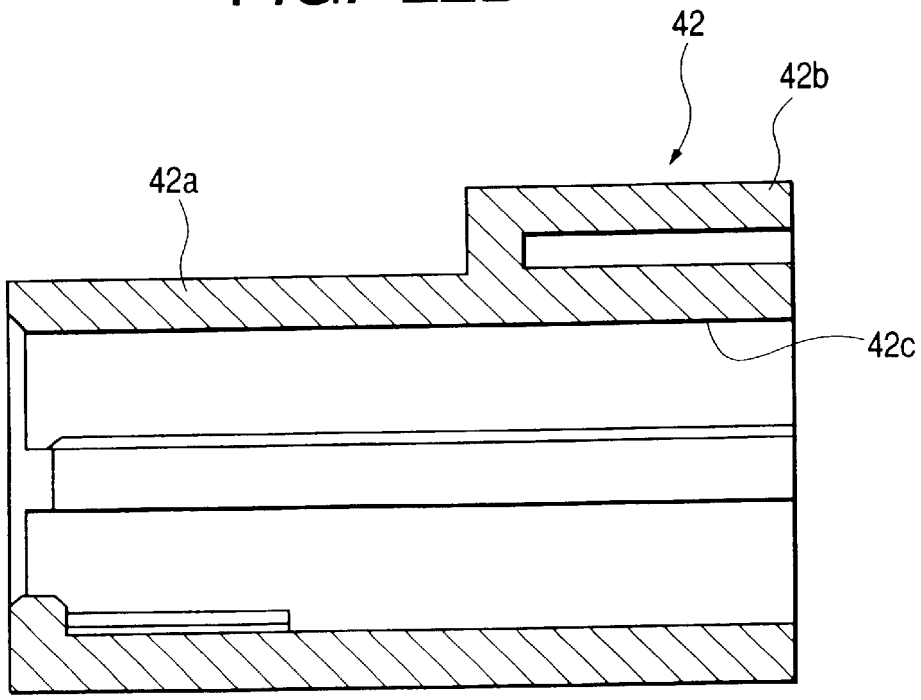
FIG. 22B is a sectional view taken on line F—F in FIG. 22A.

FIGS. 22A and 22B show the driven roller cam 42; FIG. 22A is a side view of the driven roller cam 42 and FIG. 22B is a sectional view taken on line F—F in FIG. 22A. The driven roller cam 42 comprises a cylindrical main body part 42*a* having a through hole 42*c* into which the control shaft 5 is inserted and fixed, and a cam part 42*b*. The cam part 42*b* is formed integrally with the main body part 42*a* and is projected diametrically in a part of the outer peripheral face of the main body part 42*a*. The range in which the cam part 42*b* is formed is the angle range in which the paper feed driven roller 4 maintains a state at a distance from the paper feed rollers 3 (see FIG. 26).

Figure 23:
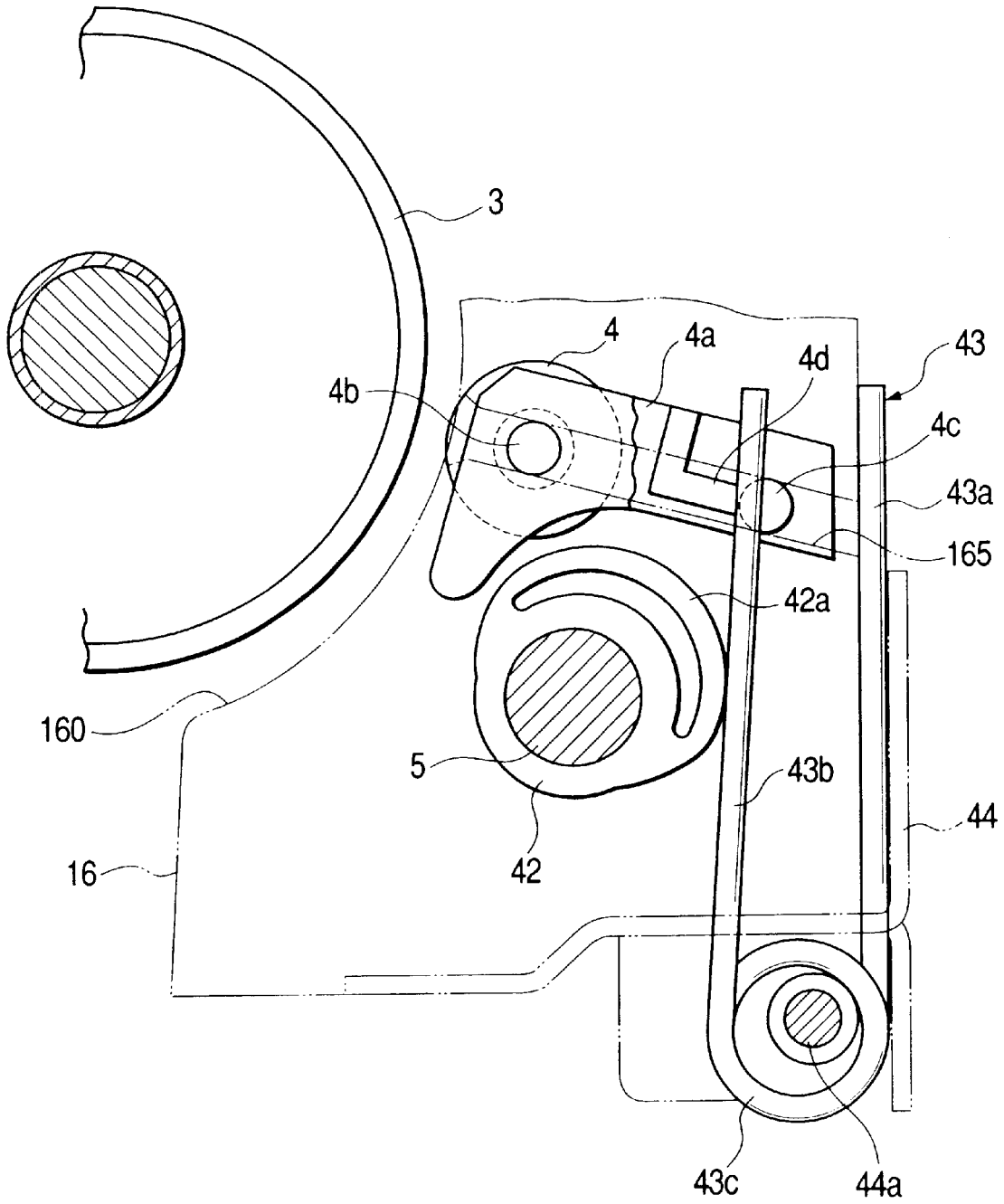
FIG. 23 is a side view to show the detailed configuration of a driven roller unit.
Figure 24:
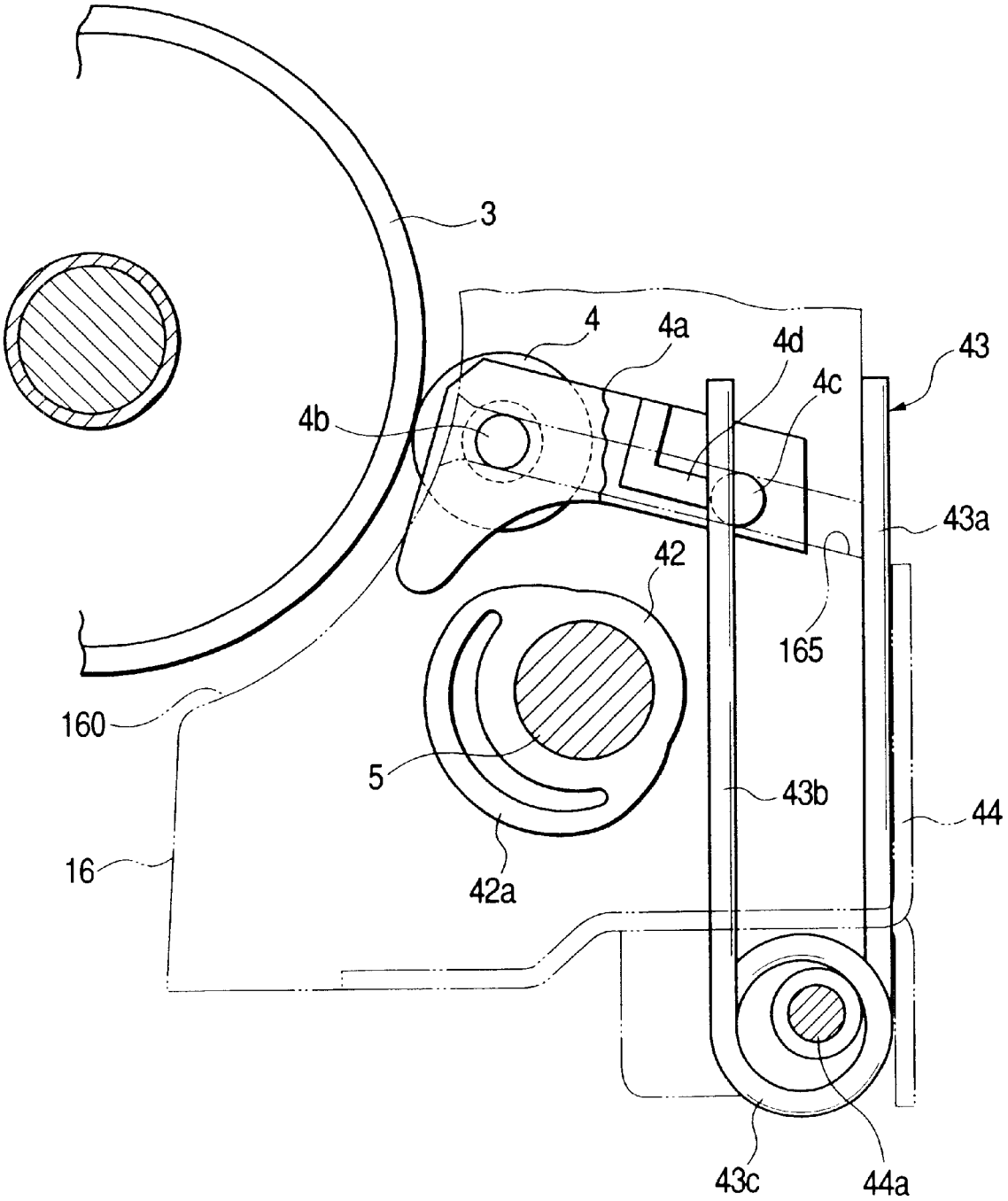
FIG. 24 is a side view to show the detailed configuration of the driven roller unit.
Figure 25:
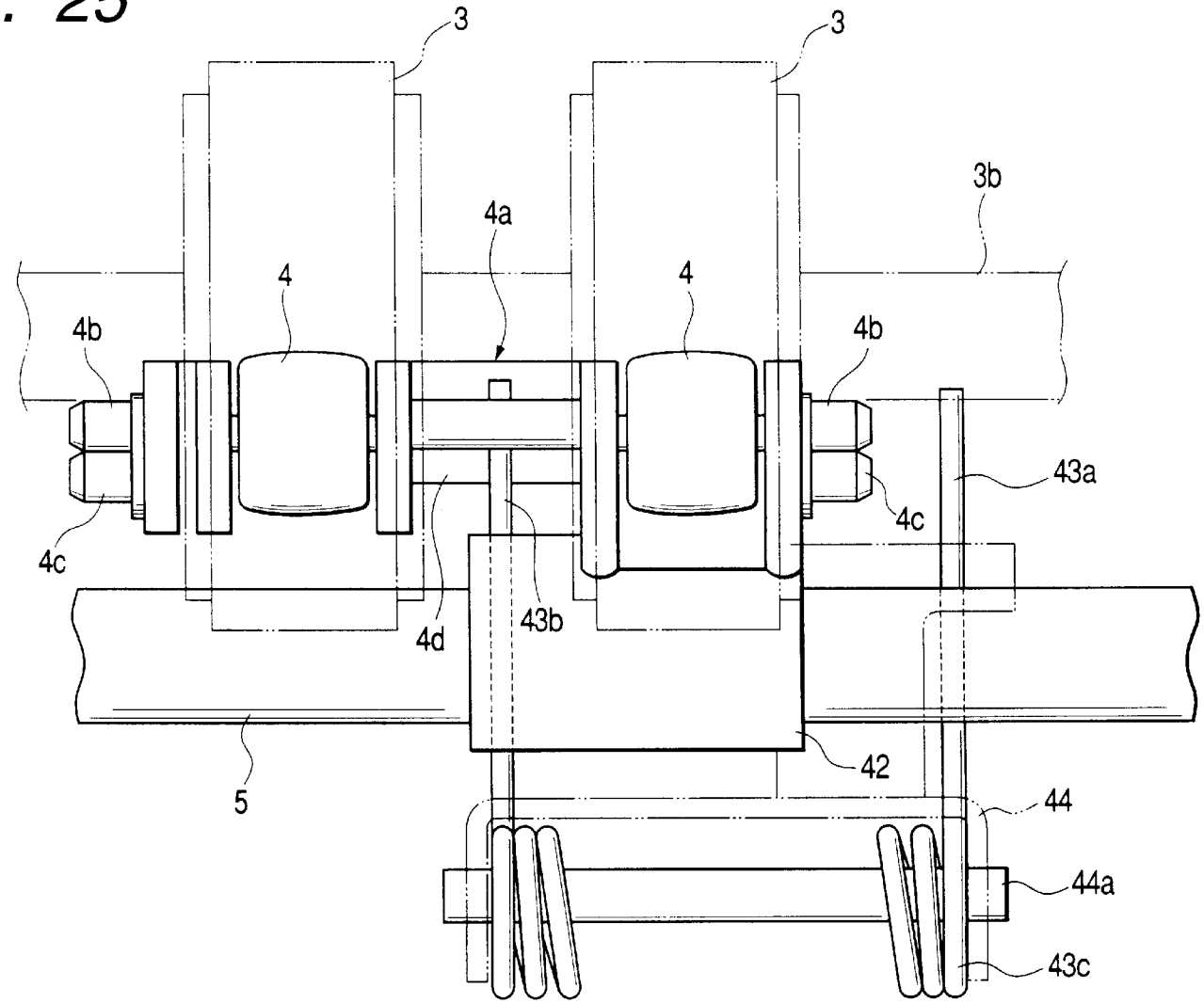
FIG. 25 is a front view to show the detailed configuration of the driven roller unit.

FIGS. 23 and 24 are side views to show the detailed configuration of the driven roller unit 40 and FIG. 25 is a front view to show the detailed configuration of the driven roller unit 40. FIG. 23 shows a state in which the control shaft 5 is at the rotation reference position.

The driven roller unit 40 comprises paper feed driven rollers 4, a slider 4*a* for holding the paper feed driven rollers 4, a driven roller spring (torsion coil spring) 43, and a spring holder 44 for holding the driven roller spring 43.

The slider 4*a* is attached to the paper guide member 16. Two paper feed driven rollers 4 are attached to the slider 4*a* for rotation (on the other hand, one paper feed driven roller 4 is attached to a slider 4*a* of the driven roller unit 41 for rotation).

First slider shafts 4*b* and second slider shafts 4*c* are placed back and forth at left and right end parts of the slider 4*a*. The first slider shafts 4*b* and the second slider shafts 4*c* are fitted into slide grooves 165 formed in two paper guide members 16 (not shown in FIG. 25) placed at the left and the right of the slider 4*a* (namely, back an forth in the main scanning direction) and are guided by the slide grooves 165 for move. Accordingly, the slider 4*a* and the paper feed driven rollers 4 attached to the slider 4*a* can also be guided by the slide grooves 165 for move. The slider grooves 165 descend as they are away from the paper feed rollers 3, namely, as they are toward the rear. The inclination angle of descending is set to 15 degrees relative to the horizontal direction, for example.

An abutment part 4*d* that the driven roller spring 43 abuts is formed integrally at the center of the slider 4*a*.

The spring holder 44 is attached to the lower and rear portions of the paper guide member 16. The driven roller spring 43 is attached to the spring holder 44 in a state in which both terminals 43*a* of the driven roller spring 43 are set upright to the top. A coil shaft 44*a* placed in the spring holder 44 in the main scanning direction is inserted into a coil part 43*c* of the driven roller spring 43 for supporting the driven roller spring 43. The terminal 43*a* of the driven roller spring 43 positioned at the rear (the right in FIG. 23) is supported forward by a rear wall upright on the rear of the spring holder 43. The terminal 43*b* positioned at the front (the left in FIG. 23) urges the support part 4*d* of the slider 4*a* toward the front (namely, the side of the paper feed rollers 3).

The driven roller cam 42 fixed to the control shaft 5 is placed at a position at which it abuts the terminal 43*b* of the driven roller spring 43. At the rotation reference position shown in FIG. 23, the cam part 42*b* of the driven roller cam 42 abuts the terminal 43*b* and presses the terminal 43*b* to the rear, whereby the terminal 43*b* is rotated on the coil part 43*c* clockwise and is displaced. Since the slider groove 16 is formed backward descending, as the terminal 43*b* is rotated and displaced, the slider 4*a* supported on the terminal 43*b* is moved to the rear (namely, away from the paper feed rollers 3) along the slide groove 165 under the own weight of the slider 4*a*. Consequently, each paper feed driven roller 4 is placed at a separated position from the paper feed rollers 3.

At the separated position, the dimensions of the slider 4*a*, the driven roller cam 42, and the driven roller spring 43 are set so that the roller face of each paper feed driven roller 4 projects slightly (for example, 1.0 mm) from the guide face 160 of the paper guide member 16.

When the control shaft 5 rotates clockwise from the rotation reference position and is placed in a state shown in FIG. 24, the abutment (pressing) of the cam part 42*a* against the terminal 43*b* is released, whereby the terminal 43*b* urges the slider 4*a* toward the paper feed rollers 3. Consequently, the slider 4*a* is moved toward the paper feed rollers 3 along the slider groove 165 and the paper feed driven rollers 4 abut the paper feed rollers 3 and are pressed.

Figures 26A, 26B, 26C:
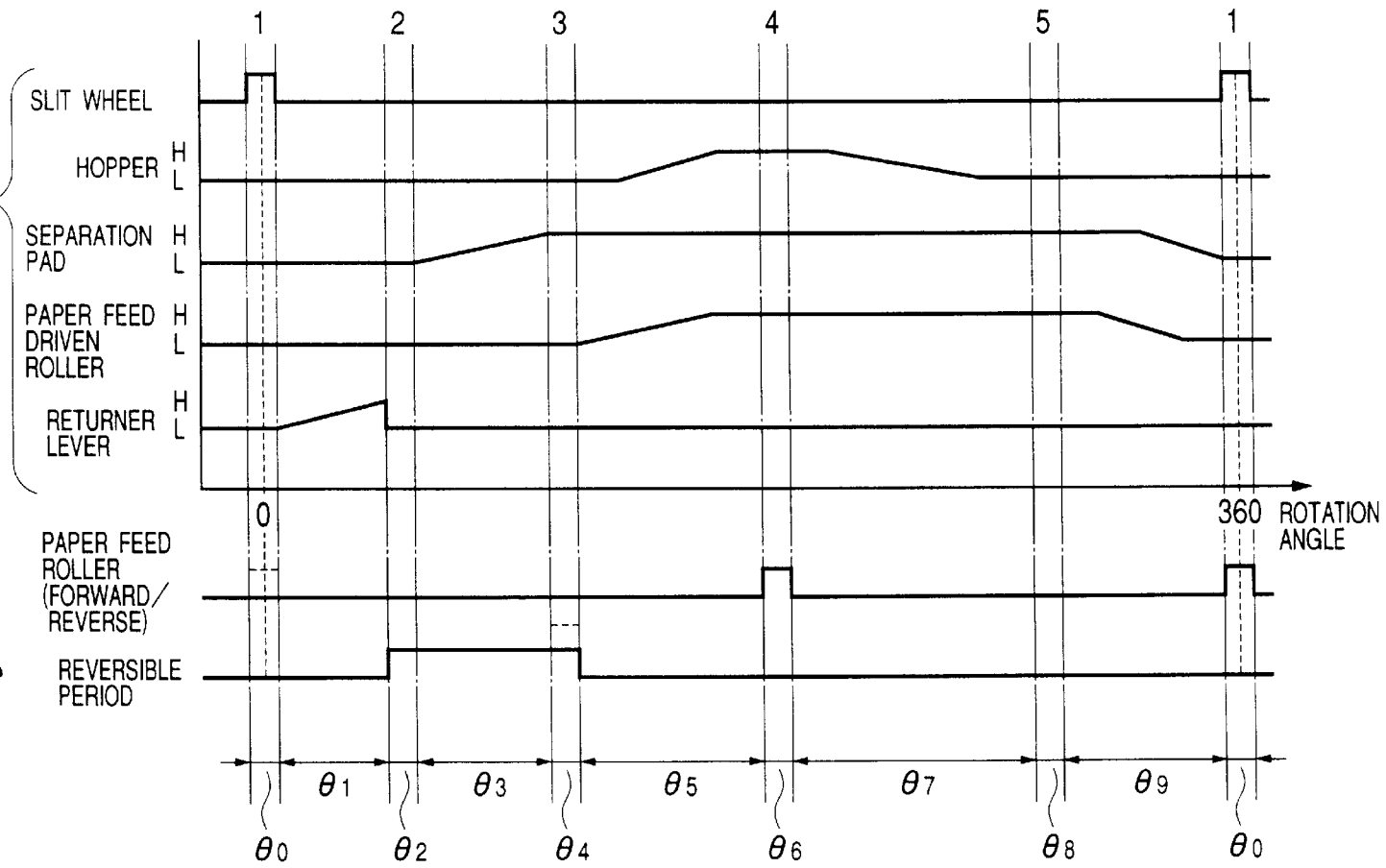
FIG. 26A is a time chart to show the relationship between the rotation angle of control shaft and the operation of each of slit wheel, hopper (hopper holder), separation pad (pad holder), paper feed driven rollers, and returner lever (main lever and sublever)
FIG. 26B is a time chart to show the relationship between the rotation angle of the control shaft and rotation (forward and reverse) of the feed rollers.
FIG. 26C is a time chart to show the relationship between the rotation angle of the control shaft and an area in which the feed rollers can be rotated reversely.

Next, the paper feed operation of the printer 100 will be discussed in the relationship with the rotation angle of the control shaft 5. Rotation of the control shaft 5 and rotation of the paper feed rollers 3, the transport roller 6, and the paper discharge roller 8 are controlled in synchronization with each other by the controller (not shown) as follows:

FIG. 26A is a time chart to show the relationship between the rotation angle of the control shaft 5 and the operation of each of the slit wheel 90, the hopper 2 (and the hopper holder 18), the separation pad 11*a* (and the pad holder 11), the paper feed driven rollers 4, and the returner lever (the main lever 52 and the sublever 53). FIG. 26B is a time chart to show the relationship between the rotation angle of the control shaft 5 and rotation (forward and reverse) of the paper feed rollers 3. FIG. 26C is a time chart to show the relationship between the rotation angle of the control shaft 5 and an area in which the paper feed rollers 3 can be rotated reversely.

In the time chart of FIG. 26A, the rectangular graph of "slit wheel" indicates that the slit in the slit wheel 90 is detected by the optical sensor. "L" in "hopper" indicates that the hopper 2 is at a separated position from the paper feed rollers 3 and "H" indicates that the hopper 2 is at an abutment position with the paper feed rollers 3. "L" in "separation pad" indicates that the separation pad 11*a* is at a separated position from the paper feed rollers 3 and "H" indicates that the separation pad 11*a* is at an abutment position with the paper feed rollers 3. "L" in "paper feed driven roller" indicates that the paper feed driven rollers 4 are at a separated position from the paper feed rollers 3 and "H" indicates that the paper feed driven rollers 4 are at an abutment position with the paper feed rollers 3. "L" in "returner lever" indicates that the returner lever is at a separated position from the paper feed rollers 3 and "H" indicates that the returner lever is at an abutment position with the paper feed rollers 3.

Before the paper feed operation is started, if the optical sensor detects the slit formed in the slit wheel 90, the control shaft 5 is placed at the rotation reference position (position at rotation angle of zero degrees). The slit in the slit wheel 90 has a given width. Since the width is previously known, the rotation angle.of the control shaft 5 is adjusted so that detection light of the optical sensor passes through the center of the slit in the width direction thereof, and the adjusted angle position is set to the rotation reference position. The given width of the slit is $\theta_0$ (for example, 10.57 degrees) in terms of the rotation angle of the control shaft 5, and hereinafter the period will be referred to as "first period."

In the first period, the hopper cam 21 abuts the hopper cam follower part 18*e* of the hopper holder 18 as shown in FIG. 5A, and the hopper holder 18 and the hopper 2 maintain a down state. Accordingly, paper P placed on the hopper 2 is at a separated position from the paper feed rollers 3. As shown in FIG. 13, the pad cam 31 abuts the pad holder 11, and the separation pad 11*a* is at a separated position from the paper feed rollers 3. As shown in FIG. 23, the paper feed driven roller cam 42 abuts the driven roller spring 43, and the paper feed driven rollers 4 are at a separated position from the paper feed rollers 3. As shown in FIG. 16, the returner cam 51 does not push up the returner lever and the returner lever is at a standby position. The paper feed rollers 3 stop.

When the control shaft 5 is rotated forward (namely, clockwise in FIG. 16) at an angle of $\theta_0/2$ from the rotation reference position, abutment of the returner cam 51 and the returner lever shown in FIG. 16 is started and as the control shaft 5 is further rotated forward at an angle $\theta_1$ (for example, 60 degrees), the abutment is released. Accordingly, as shown in FIGS. 16 and 19, the returner lever is displaced from the standby position to the returned position and is restored to the standby position. Consequently, if paper P on the separation pad 11*a* exists, it is returned to the paper feed tray 1. As shown in FIGS. 20 and 21, paper P is not returned in some cases; handling the paper P will be discussed later.

When the control shaft 5 is further rotated forward at an angle $\theta_2$ (for example, 10 degrees; hereinafter, the period will be referred to also as "second period"), releasing of abutment of the pad cam 31 and the pad release lever 11*f* is started and the pad holder 11 is moved toward the abutment position at which it abuts the paper feed rollers 3. As the control shaft 5 is further rotated forward at an angle $\theta_3$ (for example, 30 degrees), the separation pad 11*a* abuts (presses) the paper feed rollers 3. The abutment position state is continued to the sections of angles ($\theta_4+\theta_5+\theta_6+\theta_7+\theta_8$) and a part of the section of an angle $\theta_9$.

In the second period, the period of the angle θ3, and the period of the angle $\theta_4$ (hereinafter, referred to also as "third period"), the paper feed rollers 3 can be rotated reversely (namely, counterclockwise in FIG. 1), as shown in FIG. 26C. The paper feed rollers 3 are rotated reversely in the third period in which the separation pad 11*a* is at the abutment position, whereby the paper P not returned by the returner lever described above (see FIGS. 20 and 21) is returned reliably to the paper feed tray 1 or the vicinity of the nip point of the separation pad 11*a* because the paper P is pressed against the paper feed rollers 3 by the separation pad 11*a*.

The paper feed rollers 3 can also be rotated reversely whenever each sheet of paper is fed or once when several sheets of paper are fed. The angle at which the paper feed rollers 3 are rotated is set to a sufficient angle to return the paper P not returned by the returner lever to the paper feed tray 1 or the vicinity of the nip point of the separation pad 11*a*.

When the paper feed rollers 3 are rotated reversely, then the control shaft 5 is also rotated and is returned to the rotation reference position. It is again rotated and the paper return operation using the returnerlever is started. Thus, the paper P on the separation pad 11*a* is reliably returned to the paper feed tray 1 before paper feed.

When the third period is passed through, releasing of abutment of the paper feed driven roller cam 42 and the driven roller spring 43 is started and the abutment is completely released before the control shaft 5 is rotated at the angle $\theta_5$ (for example, 71.3 degrees). Accordingly, the paper feed driven rollers 4 are displaced to the abutment position and abut (press) the paper feed rollers 3. The abutment position is continued in the period of the angle $\theta_6$ (for example, 10 degrees; hereinafter, referred to also as "fourth period") following the period of the angle $\theta_5$, the period of the angle $\theta_7$, the period of the angle $\theta_8$ (for example, 10 degrees; hereinafter, referred to also as "fifth period"), and a part of the period of the angle $\theta_9$.

In the period of the angle $\theta_5$, abutment of the hopper cam 21 and the hopper holder 18 is released the hopper holder 18 pushes up the hopper 2. Consequently, the hopper 2 is displaced to the abutment position and the paper P placed on the hopper 2 abuts the paper feed rollers 3. The abutment position is continued in the fourth period and a part of the period of the angle $\theta_7$.

Figure 27:
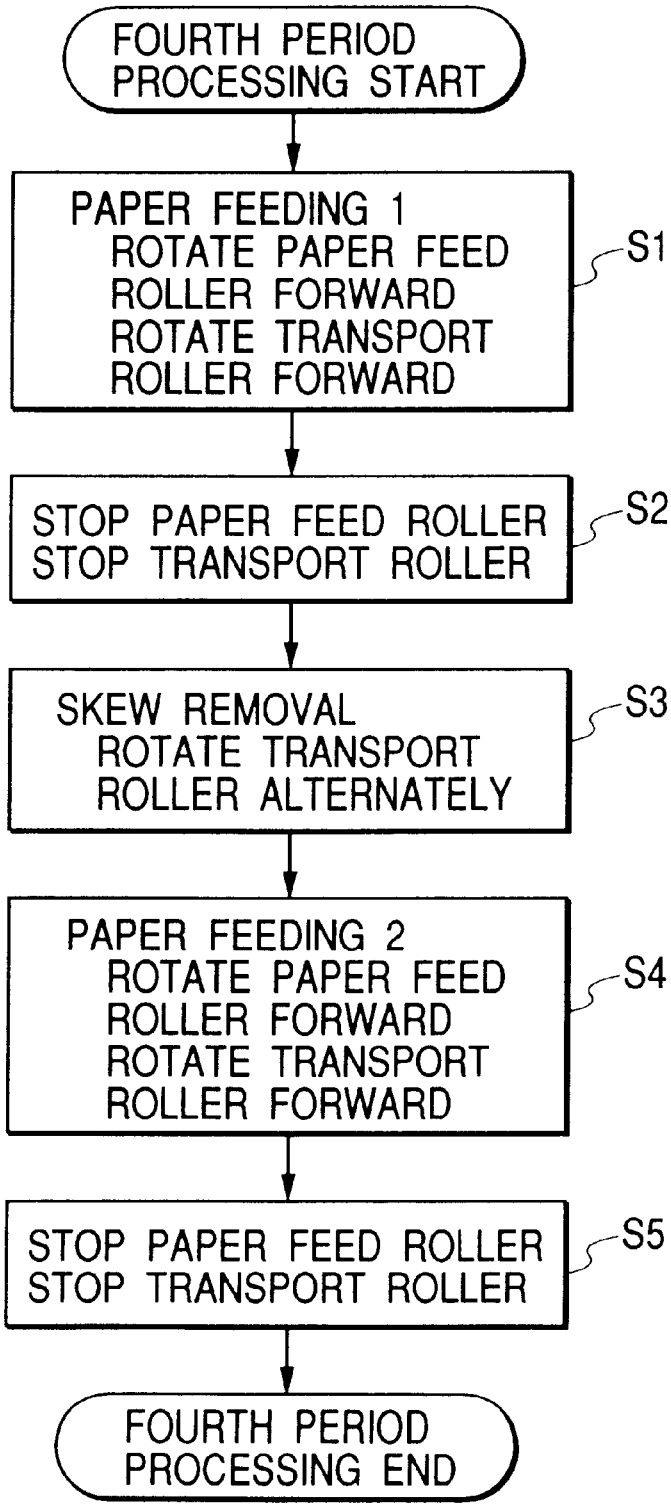
FIG. 27 is a flowchart to show a processing flow of the paper feed operation.

In the fourth period in which the hopper 2, the separation pad 11*a*, and the paper feed driven rollers 4 are at the abutment position, the paper feed rollers 3 and the transport roller 6 are rotated forward for performing the paper feed operation as indicated by the solid line in FIG. 26B. FIG. 27 is a flowchart to show a processing flow of the paper feed operation.

First, the paper feed rollers 3 and the transport roller 6 are rotated forward and paper P is fed from the paper feed rollers 3 to the transport roller 6 (step S1). That is, the hopper 2 is at the abutment position and thus the paper P on the hopper 2 is pressed against the paper feed rollers 3 and is wound around the paper feed rollers 3 for feed. At this time, the paper P is sandwiched between the separation pad 11*a* and the paper feed rollers 3, so that overlap sheet feeding of paper P is prevented because of the relation of the friction coefficients described above ($\mu 1 > \mu 2 > \mu 3$) and only the top sheet of paper P is fed on the U-shaped feeding path to the transport roller 6. Further, the paper feed driven rollers 4 abut (press) the paper feed rollers 3 while the paper P is fed, whereby a transport force of the paper feed rollers 3 is provided and the paper P can be fed to the transport roller 6 rapidly and reliably.

The paper feeding is continued until the tip of the top sheet of paper P is clamped by the transport roller 6 and is slightly projected downward from the transport roller 6. The paper feed rollers 3 and the transport roller 6 once stop in the state in which the tip of the top sheet of paper P is slightly projected downward from the transport roller 6 (step S2).

Subsequently, only the transport roller 6 is rotated reversely and forward for executing skew removal for correcting skew of the paper P (step S3). That is, the transport roller 6 is once rotated reversely and again rotated forward, whereby the tip of the paper P is made parallel with the roller shaft of the transport roller 6.

After the tip is made parallel with the roller shaft, the paper feed rollers 3 and the transport roller 6 are rotated forward and the paper P is further fed downward (step S4). When the paper P is fed downward at a predetermined distance, the paper feed rollers 3 and the transport roller 6 once stop (step S5). The predetermined distance is a transport distance equal to or greater than the length along the feeding path between the abutment center point (nip point) of the paper feed rollers 3 and the separation pad 11*a* and the point at which the tip (front end) of the paper P is positioned in the paper feed tray 1 (namely, S-T length described later with reference to FIG. 29). If the transport roller 6 is rotated reversely at step S6 in FIG. 28, the top sheet of paper returned with the transport roller 6 is rotated reversely may be bent in the feeding path upstream from the transport roller 6; preferably, the predetermined distance is equal to or greater than the bend amount added to the S-T length.

The control shaft 5 is controlled so as to stop in the fourth period until completion of the paper feed operation previously described with reference to FIG. 27.

After completion of the paper feed operation, the control shaft 5 is rotated at the angle $\theta_7$ (for example, 87.8 degrees) and while the control shaft is rotated, the hopper cam 2 again abuts the hopper holder 18 and is displaced to the separated position. Subsequently, the control shaft 5 is further rotated at the angle $\theta_8$ (fifth period) and the angle $\theta_9$ (for example, 60 degrees). While the control shaft 5 is rotated at the angle $\theta_9$, abutment of the pad cam 31 and the pad release lever 11*f* is started and the separation pad 11*a* is displaced to the separated position. Abutment of the driven roller cam 42 and the driven roller spring 43 is started and the paper feed driven rollers 4 are displaced to the separated position.

The control shaft 5 is further rotated at an angle of $\theta_0/2$ and is restored to the rotation reference position. Thus, the control shaft 5 makes one revolution, the operation of feeding one sheet of paper is complete. The above-described angles $\theta_0$ to $\theta_9$ become 360 degrees in total, but some of the angles with the specific values enclosed in parentheses rounded off to the nearest whole number and therefore the total of the angles with the specific values enclosed in parentheses does not become 360 degrees.

Figure 28:
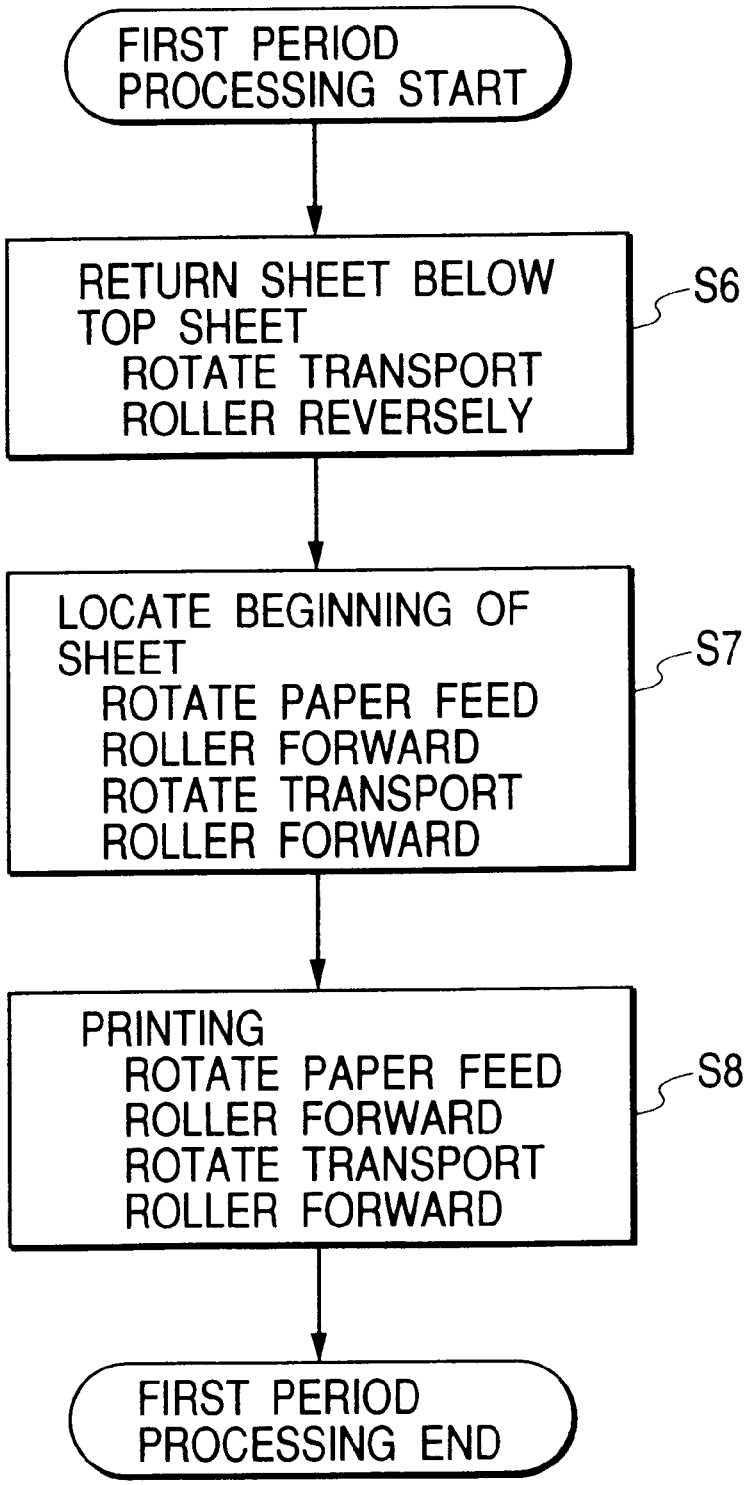
FIG. 28 is a flowchart to show a flow of returning sheets of paper below the top sheet to the paper feed tray and print processing.

At the rotation reference position, namely, in the first period, sheets of paper below the top sheet are returned to the paper feed tray 1 before print processing is performed. FIG. 28 is a flowchart to show a processing flow.

First, only the transport roller 6 is rotated reversely a predetermined rotation amount and the top sheet of paper is returned by the transport distance corresponding to the predetermined rotation amount and the sheets of paper below the top sheet are returned to the paper feed tray 1 together with the top sheet (step S6). The predetermined rotation amount may be the rotation amount required for transporting paper at the predetermined distance at step S5 or may be the rotation amount exceeding that rotation amount and to prevent the tip of the top sheet of paper P from disengaging the transport roller 6. The top sheet of paper returned may be bent in the feeding path upstream from the transport roller 6; preferably, the predetermined rotation amount is equal to or greater than the transport distance resulting from adding the bend amount to the S-T length shown in FIG. 29.

Figure 29:
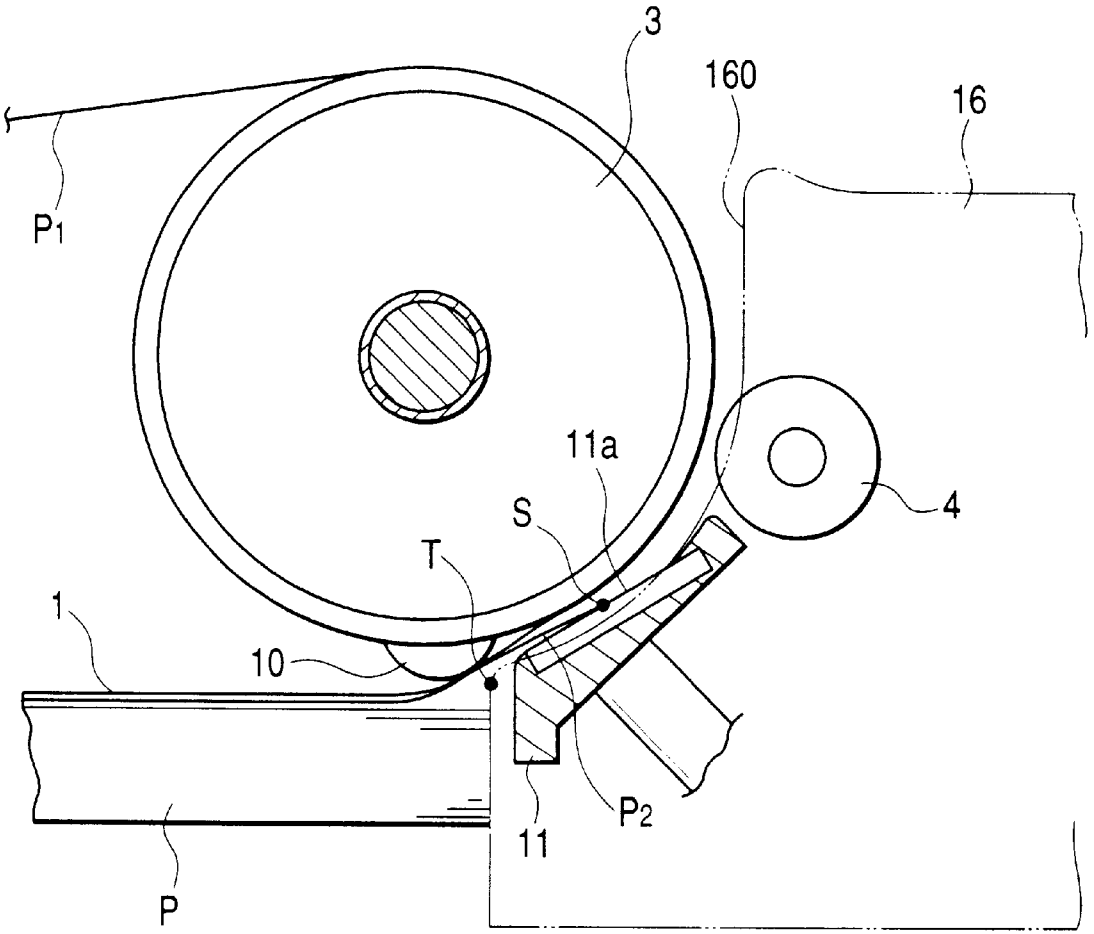
FIG. 29 is a schematic representation to describe the principle of returning sheets of paper below the top sheet to the paper feed tray as a transport roller is rotated reversely a predetermined rotation amount.

FIG. 29 is a schematic representation to describe the principle of returning sheets of paper below the top sheet to the paper feed tray 1 as the transport roller 6 is rotated reversely the predetermined rotation amount. Just before the transports roller 6 is rotated reversely in the first period, the separation pad 11*a* is away from the paper feed rollers 3 and the tip of a sheet $P_2$ of paper below the top sheet $P_1$ is positioned at the vicinity of the nip point on the separation pad 11*a*, as shown in FIG. 29. The upstream auxiliary roller 10 projects downward from the roller faces of the paper feed rollers 3 and presses the top sheet $P_1$ and the sheet $P_2$ downward.

In this state, if the transport roller 6 is rotated reversely, the top sheet $P_1$ is returned to the paper feed tray I because of the rigidity of the sheet $P_1$. In this case, the top sheet $P_1$ may be returned to the paper feed tray 1 while it is bent in the feeding path upstream from the transport roller 6 depending on the rigidity of the sheet $P_1$. At this time, the sheet $P_2$ is in contact with the top sheet $P_1$ as it is pressed by the upstream auxiliary roller 10, and therefore the sheet $P_2$ is returned to the paper feed tray 1 together with the top sheet $P_1$ by the intimate contact force between the sheets in the contact portion (frictional force, electrostatic force, etc.,). Since the return distance is the distance corresponding to the predetermined rotation amount, the sheet $P_2$ is returned to the paper feed tray 1 reliably. The returned sheet $P_2$ drops into the paper feed tray 1 at a separated position under the own weight of the sheet $P_2$. Thus, overlap feeding of the sheet $P_2$ does not occur if the top sheet $P_1$ is later fed downward, as described below.

Subsequently, the paper feed rollers 3 and the transport roller 6 are rotated forward and the tip of the top sheet $P_1$ is sent to a record start position (step S7). That is, the beginning of the sheet is located. Then, while the paper feed rollers 3 and the transport roller 6 are rotated forward at given pitches for feeding paper, printing with the recording head is executes (step S8). The control shaft 5 stops rotation until completion of printing on the top sheet P fed.

The paper feed rollers 3 are also rotated forward during the printing, whereby transport resistance (transport load or back tension) is decreased and the transport accuracy of the transport roller 6 can be enhanced. In the first period, the paper feed driven rollers 4 are at the separated position and thus the back tension caused by the paper feed driven rollers 4 can also be eliminated. That is, if the paper feed driven rollers 4 are at the abutment position, the paper feed driven rollers 4 press the rear end of paper P under printing with the paper feed rollers 3, thus causing back tension to occur. Since the paper feed driven rollers 4 are at the separated position, the back tension can be eliminated. Further, the paper feed driven rollers 4 slightly project from the guide face 160 of the paper guide member 16 even at the separated position as described above (see FIG. 23), so that the contact friction resistance between the guide face 160 and paper P is eliminated and back tension is also decreased accordingly.

Figure 30:
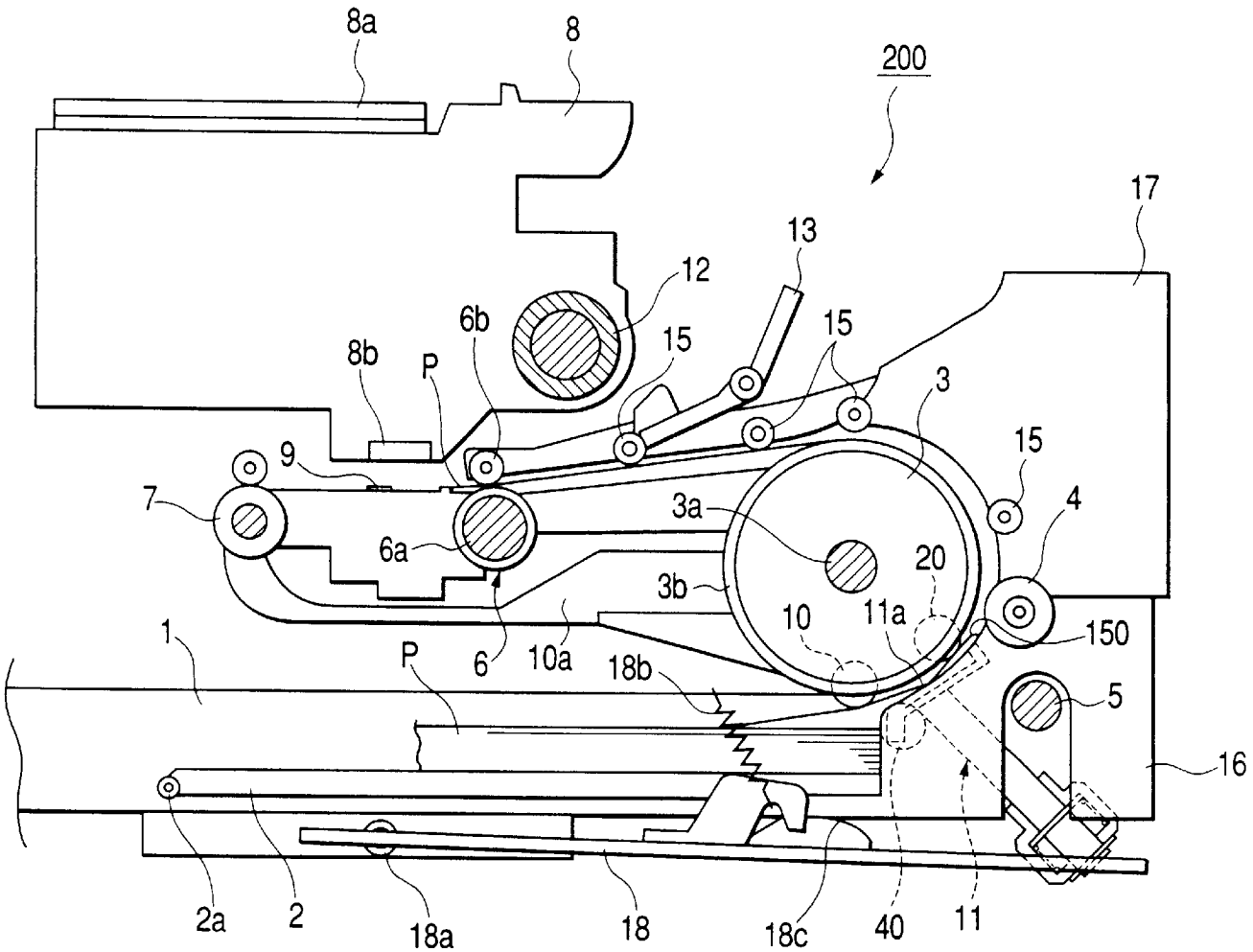
FIG. 30 is a schematic side view of an ink jet printer according to a second embodiment of the invention.

FIG. 30 is a schematic side view of an ink jet printer 200 according to a second embodiment of the invention. Components identical with those of the printer 100 according to the first embodiment previously described with reference to the accompanying drawings are denoted by the same reference numerals in the following drawings. The printer 200 differs from the printer 100 according to the first embodiment only in that a downstream auxiliary roller 20 is added and that a guide pad 150 on which the downstream auxiliary roller 20 is to be abutted is provided as a second separator. Only the differences will be discussed.

The guide pad 150 is placed at a position out of a separation pad la in the paper width direction (face and back direction in FIG. 30) so that paper feed rollers 3 do not come in contact with the guide pad 150; the guide pad 150 is fixed to a paper guide member 16. A pad face of the guide pad 150 slightly projects (for example, 1 mm) from a guide face 160, so that the tip of fed paper P easily comes in contact with the guide pad 150. The guide pad 150 is formed of a friction member having a friction coefficient similar to that of the separation pad 11*a*.

Like upstream auxiliary rollers 10, the downstream auxiliary roller 20 is attached to an auxiliary roller holder 10*a* for free rotation. As a hopper 2 moves up, the downstream auxiliary roller 20 is pushed upward through paper P placed on the hopper 2 and the upstream auxiliary roller 10 and is away from the guide pad 150. On the other hand, as the hopper 2 moves down, the downstream auxiliary roller 20 is moved down under the own weight of the auxiliary roller holder 10*a* and by the urging force of a spring (not shown) attached to the auxiliary roller holder 10*a* and a press spring 131 serving as an urging member described later in detail, and presses paper P with the guide pad 150.

Therefore, the downstream auxiliary roller 20 is away from the guide pad 150 in a fourth period in which the paper P is fed (see FIG. 26) and the downstream auxiliary roller 20 abuts (presses) the guide pad 150 and clamps the paper P in a first period in which printing is executed.

The processing flow previously described with reference to the time chart of FIG. 26, paper feeding in the fourth period (previously described with reference to the flowchart of FIG. 27), and processing in the first period (previously described with reference to the flowchart of FIG. 28) are also performed in the second embodiment in a similar manner and therefore will not be discussed again.

Figure 31:
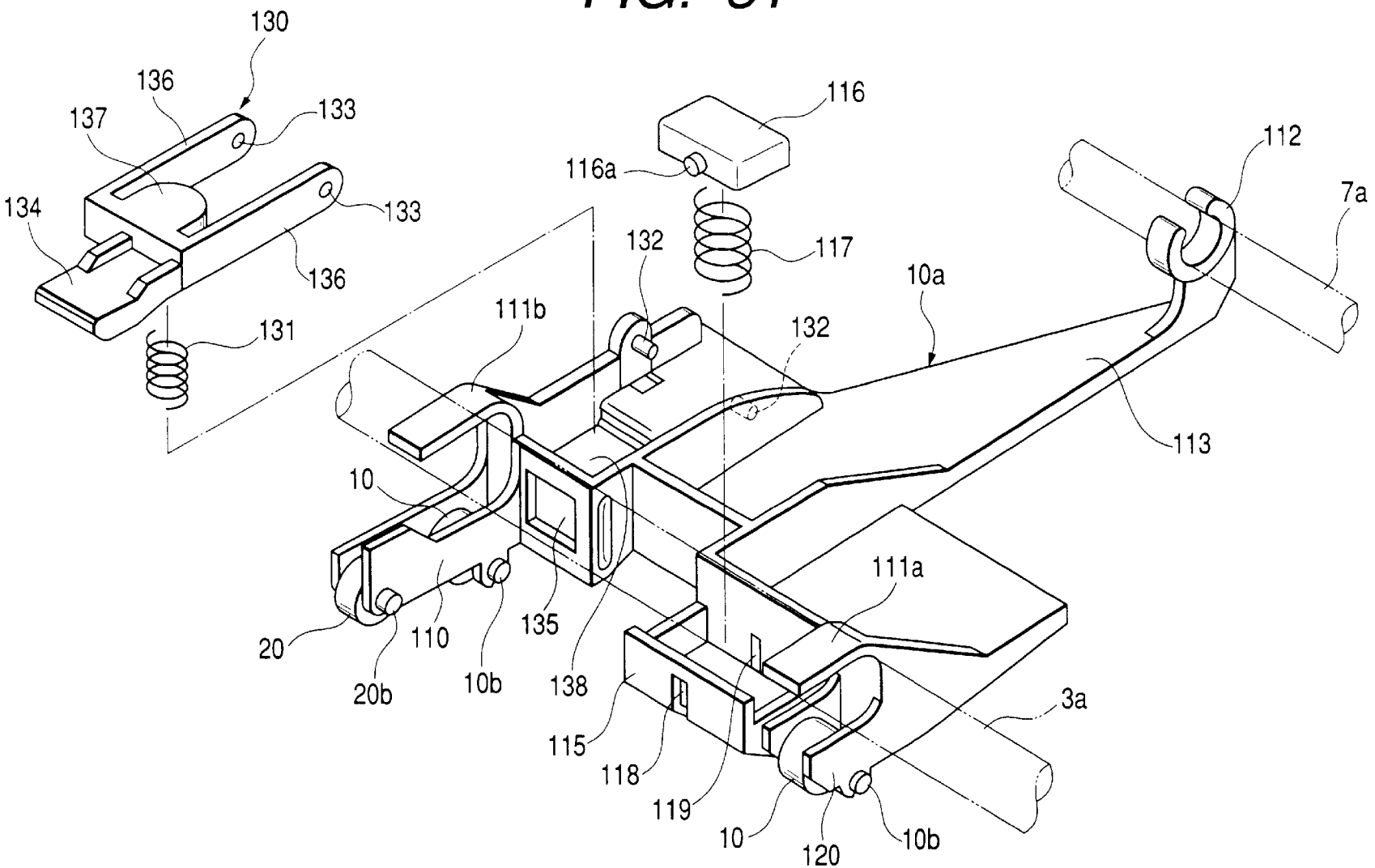
FIG. 31 is a perspective view to show a downstream auxiliary roller, upstream auxiliary rollers, and an auxiliary roller holder for hooding the downstream and upstream auxiliary rollers.
Figure 32:
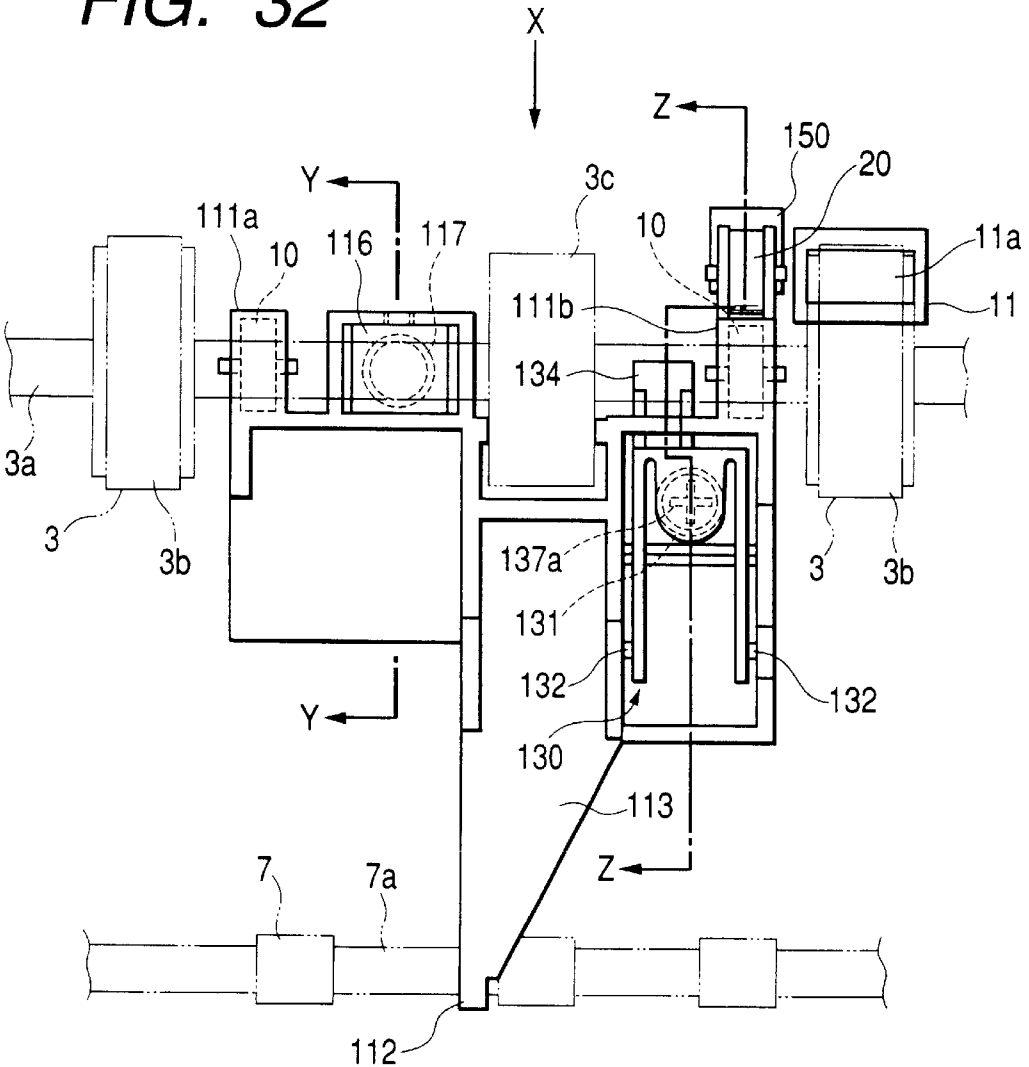
FIG. 32 is a schematic plan view of the auxiliary roller holder attached to the ink jet printer.

FIG. 31 is a perspective view to show the downstream auxiliary roller 20, the upstream auxiliary rollers 10, and the auxiliary roller holder 10*a* for hooding the downstream and upstream auxiliary rollers. FIG. 32 is a schematic plan view of the auxiliary roller holder 10*a* attached to the printer 200. Hereinafter, in the auxiliary roller holder 10*a*, the side of a paper feed roller shaft 3*a* will be "forward," "front," "front end," or the like and the side of a paper discharge roller shaft 7*a* will be "backward," "rear," "rear end," or the like.

The auxiliary roller holder 10*a* is molded of a resin material integrally. It is formed at a front end with holders 110 and 120 placed back and forth in the rotation axis direction of the paper feed roller shaft 3*a* (namely, width direction of paper P).

Figure 35:
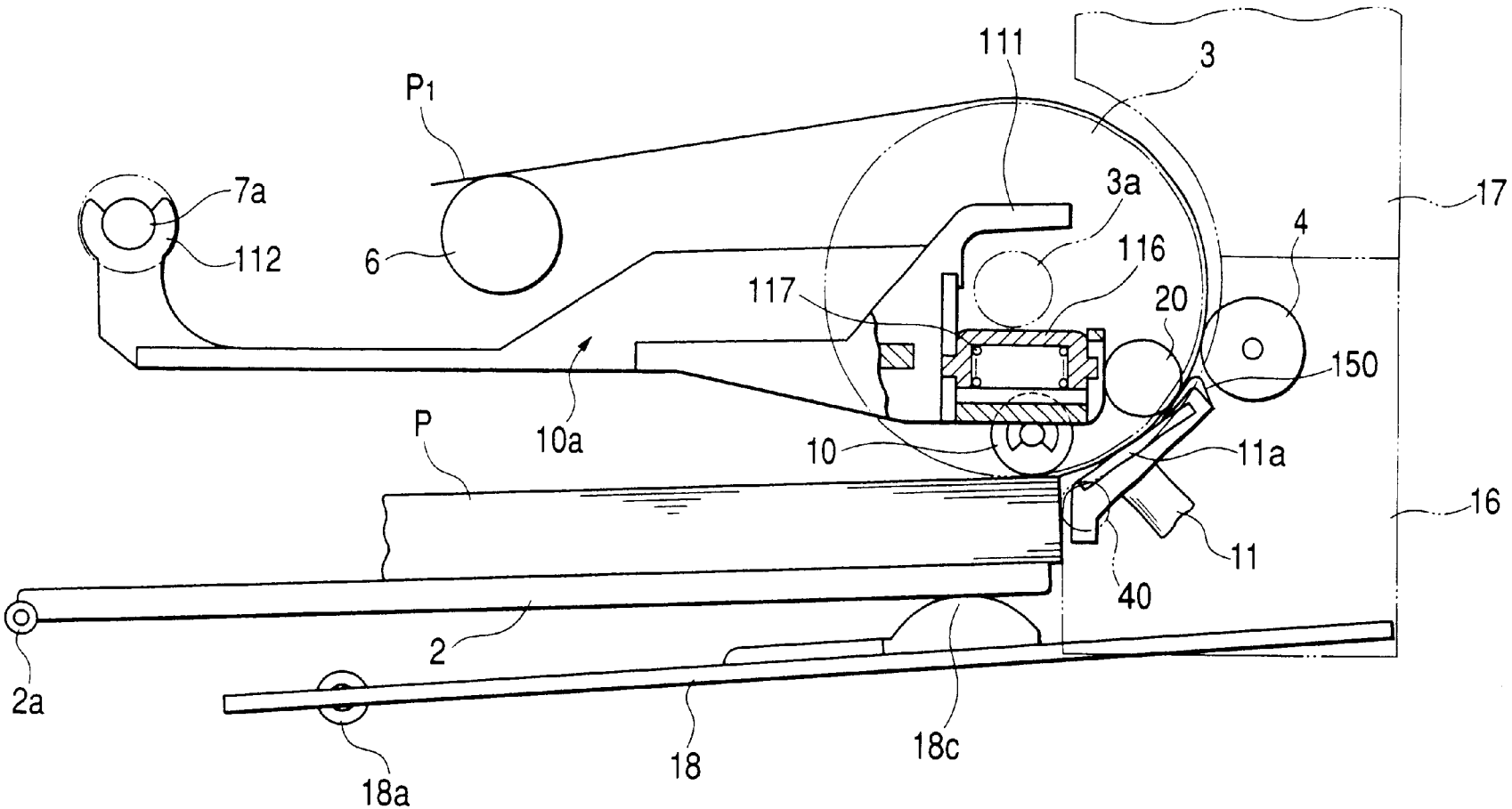
FIG. 35 is a fragmentary sectional side view of the printer at the feed time when paper is taken out from a paper feed tray and is wound around feed rollers and is fed to a transport roller.
Figure 36:
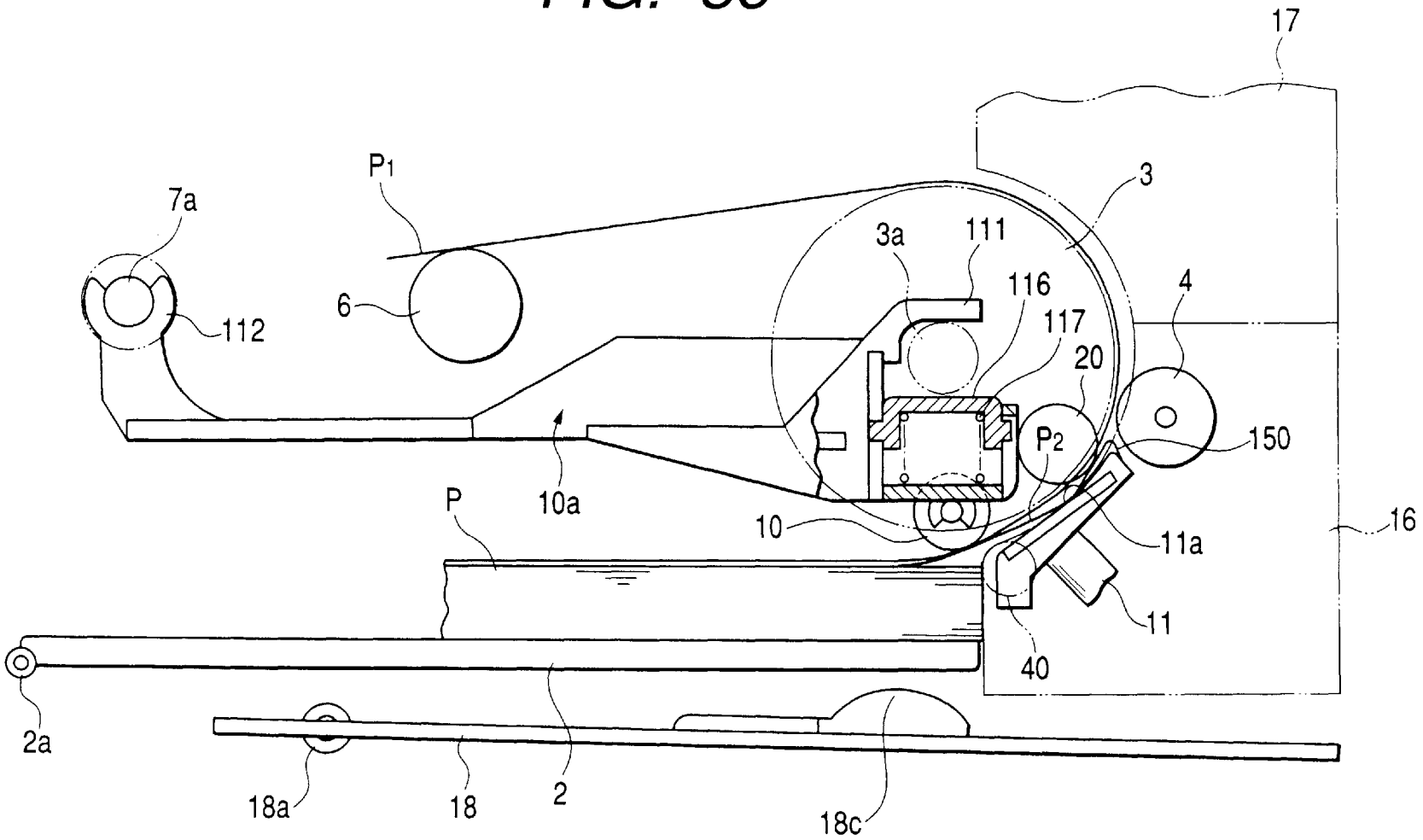
FIG. 36 is a fragmentary sectional side view of the printer at the record time when printing is executed while paper is transported in a subscanning direction at given pitches by the transport roller after the paper feed shown in FIG. 35.

Two upstream auxiliary rollers 10 are attached to the holders 110 and 120 for free rotation via rotation shafts 10*b*. One holder 110 is extended forward longer than the other holder 120, and the downstream auxiliary roller 20 is attached to the tip of the holder 110 for free rotation via a rotation shaft 20*b*. The downstream auxiliary roller 20 is placed at a position in front of one upstream auxiliary roller 10 and slantingly above the other upstream auxiliary roller 10. The specific positional relationship between the downstream auxiliary roller 20 and the upstream auxiliary rollers 10 is as follows: As shown in FIG. 35, if the upstream auxiliary rollers 10 are pushed upward by paper P, the downstream auxiliary roller 20 is away from the guide pad 150 and the roller face of the downstream auxiliary roller 20 is retreated to almost the same position as the roller faces of the paper feed rollers 3 or to an inner position; on the other hand, as shown in FIG. 36, if the roller faces of the upstream auxiliary rollers 10 are moved down below the roller faces of the paper feed rollers 3 by the press force of a holder spring 117, the own weight of the auxiliary roller holder 10*a*, and the press spring 131 as the urging member described later in detail, the downstream auxiliary roller 20 abuts and presses the guide pad 150. The correlation among the above-mentioned three elements for pressing the downstream auxiliary roller 20 will be described later in detail.

The holders 110 and 120 are placed at positions where the center axis of the upstream auxiliary roller 10 held in the holder almost matches the center axis of the paper feed roller shaft 3*a* or where the former center axis slightly leaning to the depth of the printer 200 (the upper side in FIG. 32, the right in FIG. 30) from the latter center axis. The spacing between the holders 110 and 120 is set to the distance where the upstream auxiliary rollers 10 are placed in the proximity of the side parts of two paper feed rollers 3. In addition to the paper feed rollers 3 each to which a rubber member 3*b* is attached, a paper feed roller 3*c* to which no rubber member 3*b* is attached (a roller for aiding the paper feed operation of the paper feed rollers 3) is also fixed to the paper feed roller shaft 3*a*, and the auxiliary roller holder 10*a* clamps the paper feed roller 3*c* to such an extent that it slightly comes in contact with the paper feed roller 3*c*, whereby the auxiliary roller holder 10*a* is held so that it does not slide along the paper feed roller shaft 3*a* (from side to side in FIG. 32).

First support parts 111*a* and 111*b* almost horizontally extended to the front are formed above the holders 110 and 120. If the auxiliary roller holder 10*a* is attached to the paper feed roller shaft 3*a*, the first support parts 111*a* and 111*b* are placed above the paper feed roller shaft 3*a*. The first support part 111*a* is form ed so as to hang the auxiliary roller holder 10*a* on the paper feed roller shaft 3*a* for support. If the paper feed roller shaft 3*a* comes in Contact with the first support part 111*a*, the first support part 111*a* is formed so that the roller face of each of the upstream auxiliary rollers 10 slightly projects (for example, several mm) from the roller face of each paper feed roller 3 (outer peripheral face of the rubber member 3*b*), as shown in FIG. 31.

The spacing between the first support part 111*a* and the holder 120 opposed thereto is set to a dimension for enabling the paper feed roller shaft 3*a* to be displaced a predetermined amount, in other words, a dimension for enabling the auxiliary roller holder 10*a* to be displaced a predetermined amount relative to the paper feed roller shaft 3*a*. The predetermined amount is an amount for enabling the roller face of each of the upstream auxiliary rollers 10 to be retreated to the same position as the roller face of each paper feed roller 3 (outer peripheral face of the rubber member 3*b*) or to an inner position if the upstream auxiliary rollers 10 are pushed upward by paper P, as shown in FIG. 35.

On the other hand, the first support part 111*b* is placed above the first support part 111*a* and the spacing between the first support part 111*b* and the holder 110 opposed thereto is formed larger than the spacing between the first support part 111*a* and the holder 120 opposed thereto. Therefore, even if the first support part 111*a* is in contact with the paper feed roller shaft 3*a*, the first support part 111*b* does not come in contact with the paper feed roller shaft 3*a* and a gap can be formed therebetween for preventing the auxiliary roller holder 10*a* from being broken, etc., by an external forcible force if the external forcible force acts because of a jam of paper P or the like.

The auxiliary roller holder 10*a* is formed at the rear with a tail part 113 extended to the position of the paper discharge roller shaft 7*a* and the tail part 113 is formed at a tip with a second support part 112 for holding the paper discharge roller shaft 7*a* for rotation and hanging the auxiliary roller holder 10*a* on the paper discharge roller shaft 7*a* for support.

The auxiliary roller holder 10*a* is attached to the printer 200 in a state in which it is hung on the paper feed roller shaft 3*a* and the paper discharge roller shaft 7*a* by the first support part 111*a* and the second support part 112.

A spring housing part 115 is formed in the proximity of one side of the holder 120. After a holder spring (helical compression spring) 117 is housed in the spring housing part 115, a spring cap 116 is placed on the top of the spring housing part 115. The spring cap 116 is formed at the front and the rear with projections 116*a* (the rear projection 116*a* is not shown in the figure). The projections 116*a* are fitted into slits 118 and 119 formed in a front wall and a rear wall of the spring housing part 115, whereby the spring cap 116 and the holder spring 117 do not come out of the spring housing part 115. If the auxiliary roller holder 10*a* is attached to the paper feed roller shaft 3*a*, the holder spring 117 urges the paper feed roller shaft 3*a* upward through the spring cap 116 and urges the auxiliary roller holder 10*a* downward (namely, to the side of paper P placed in a paper feed tray 1).

An urging member for urging the downstream auxiliary roller 20 against the guide pad 150 is placed at the rear of the first support part 111*b*. In FIGS. 31 and 32, numerals 130 and 131 denote a press member and a press spring (helical compression spring) making up the urging member. To attach the press member 130 to the auxiliary roller holder 10*a*, fitting holes 133 made in the tips of arms 136 formed in the press member 130 and projections 132 formed on the auxiliary roller holder 10*a* are fitted.

The press member 130 is molded of a resin material integrally. It is formed with a spring holder 137 for holding the press spring 131. The press spring 131 is sandwiched between the spring holder 137 and a spring press part 138 formed in the auxiliary roller holder 10*a*.

On the other hand, the press member 130 is formed at the front with a tongue piece 134. After the press member 130 is placed so that the tongue piece 134 is projected through a window 135 formed in the auxiliary roller holder 10*a*, the fitting holes 133 are fitted into the projections 132, whereby the press member 130 is attached. Therefore, the press member 130 can be rotated with the projections 132 as rotation fulcrums and within the range in which the tongue piece 134 abuts the upper and lower parts of the window 135. The tongue piece 134 has dimensions and a shape such that it can abut the paper feed roller shaft 3*a* from downward in a state in which the tongue piece 134 is projected through the window 135.

Figure 33:
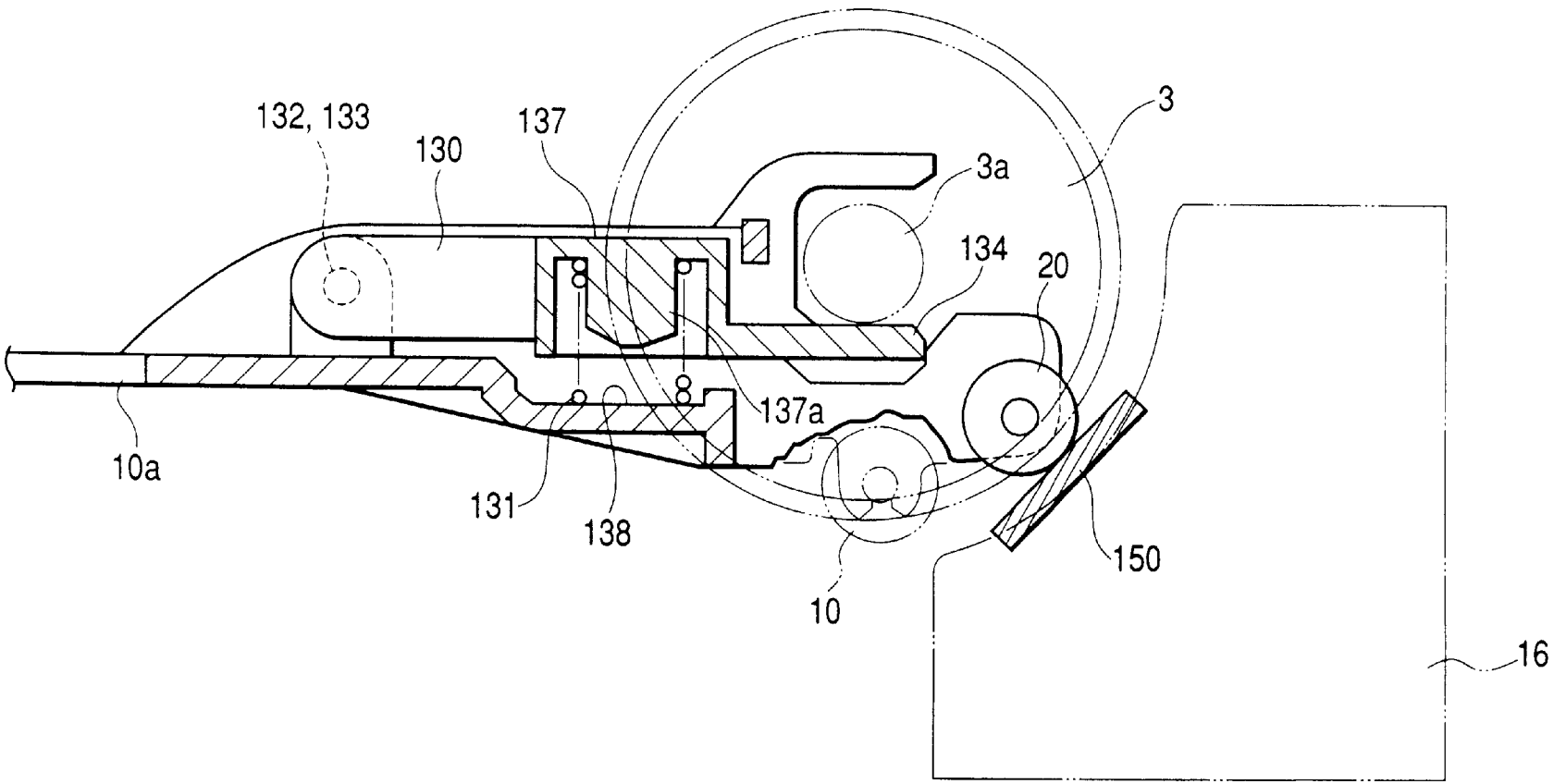
FIG. 33 is a sectional view of the auxiliary roller holder and a press member, taken on line Z—Z in FIG. 32.

FIG. 33 shows how the tongue piece 134 presses the paper feed roller shaft. 3*a* from downward (how the downstream auxiliary roller 20 is pressed against the guide pad 150); it is a sectional view taken on line Z—Z in FIG. 32. In FIG. 33, a projection 137*a* is formed inside the spring holder 137 for holding the press spring 131. The press spring 131 is fitted into the projection 137*a*, whereby it is held without a position shift. As described above, the press spring 131 is sandwiched between the spring holder 137 and the spring press part 138 and thus the tongue piece 134 undergoes an upward press force in FIG. 33 by the press force of the press spring 131 of a helical compression spring. Accordingly, the tongue piece 134 produces a force for pushing up the paper feed roller shaft 3*a* from downward. However, the paper feed roller shaft 3*a* is fixed by a bearing (not shown) and thus the auxiliary roller holder 10*a* undergoes a downward press force in FIG. 33, whereby the downstream auxiliary roller 20 is pressed against the guide pad 150 placed downward from the downstream auxiliary roller 20.

In the auxiliary roller holder 10*a*, the holder spring 117 is placed in the vicinity of the first support part 111*a*. Since the holder spring 117 produces a force for pushing up the paper feed roller shaft 3*a* from downward, the downstream auxiliary roller 20 also undergoes a force for pressing against the guide pad 150 by the holder spring 117.

Figure 34:
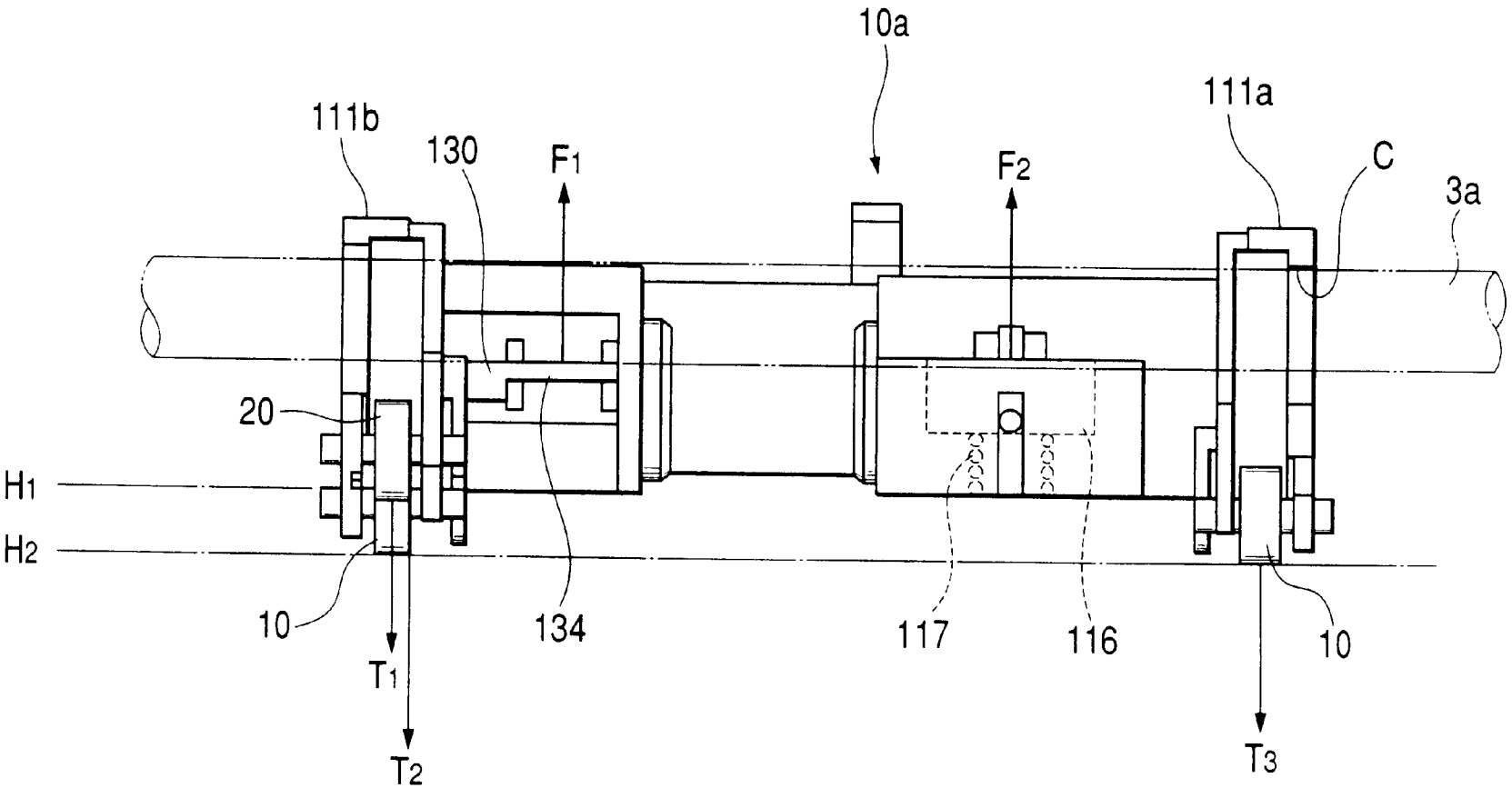
FIG. 34 is a front view of the auxiliary roller holder which is viewed from arrow X in FIG. 32.

FIG. 34 shows how load is imposed on the downstream auxiliary roller 20 by the holder spring 117 and the press spring 131; it is viewed from arrow X in FIG. 32. FIG. 34 shows the state in which the downstream auxiliary roller 20 is pressed against the guide pad 150; horizontal position $H_1$ indicates a press position against the guide pad 150. Horizontal position $H_2$ indicates positions at which the upstream auxiliary rollers 10 should come in contact with paper P under printing. The upstream auxiliary rollers 10 undergo an upward press force of paper P under printing from the positions indicated by the horizontal position $H_2$, whereby the auxiliary roller holder 10*a* is moved up.

In FIG. 34, the holder spring 117 applies an upward press force $F_2$ to the paper feed roller shaft 3*a* through the spring cap 116, whereby the first support part 111*a* is pressed against the upper part of the paper feed roller shaft 3*a* (indicated by a symbol C in FIG. 34). The first support part 111*b* is positioned above the first part 111*a* as described above, so that a moment force rotating counterclockwise in FIG. 34 with the press point C as the rotation fulcrum acts on the auxiliary roller holder 10*a* and consequently the press force $F_2$ presses the downstream auxiliary roller 20 against the guide pad 150.

Likewise, the downstream auxiliary roller 20 also undergoes the force for pressing against the guide pad 150 by an upward press force $F_1$ applied by the tongue piece 134 to the paper feed roller shaft 3*a* by the press spring 131 (not shown in FIG. 34). The press force $F_1$ is placed in the proximity of the downstream auxiliary roller 20 and thus can press the downstream auxiliary roller 20 more directly, so that it is made possible to impose load with a small error and with high accuracy. Further, the downstream auxiliary roller 20 also undergoes the force for pressing against the guide pad 150 by the own weight of the auxiliary roller holder 10*a*. Thus, a resultant force $T_1$ for pressing the downstream auxiliary roller 20 against the guide pad 150 is provided by the three elements of the holder spring 117, the press spring 131, and the own weight of the auxiliary roller holder 10*a*.

The three elements are distributed so that presses forces $T_2$ and $T_3$ that the upstream auxiliary rollers 10 give to paper P under printing by the three elements becomes almost the relation of $T_2=T_3$. That is, the spring constants of the holder spring 117 and the press spring 131 and the weight of the auxiliary roller holder 10*a* are determined so that the press force relation of $T_2=T_3$ holds.

The press force of the holder spring 117, the own weight of the auxiliary roller holder 10*a*, and the press force of the press spring 131 are set, to magnitudes sufficient to project the roller faces of the upstream auxiliary rollers 10 from the roller faces of the paper feed rollers 3 and bring paper P fed by the paper feed rollers 3 away from the paper feed rollers 3 at the print time and prevent overlap feeding of the sheet of paper P below the top sheet dragged with the top sheet with the downstream auxiliary roller 20 pressed against the guide pad 150 for sandwiching paper P therebetween.

A weight added to the auxiliary roller holder 10*a* can also be used in place of the holder spring 117, the press spring 131; however, preferably springs are used from the viewpoints of the weight reduction of the whole apparatus and enhancing shock resistance against shock of drop, etc.

Next, the functions of the downstream auxiliary roller 20, the upstream auxiliary rollers 10, and the auxiliary roller holder 10*a* will be discussed.

First, the function when the paper feed tray 1 is attached will be discussed. When the upstream auxiliary rollers 10 do not undergo an upward press force from downward produced by paper P stacked in the paper feed tray 1, the upstream auxiliary rollers 10 are slightly projected from the paper feed rollers 3 by the press force of the holder spring 117, the own weight of the auxiliary roller holder 10*a*, and the press force of the press spring 131. The downstream auxiliary roller 20 is pressed against the guide pad 150 by the press force of the holder spring 117, the own weight of the auxiliary roller holder 10*a*, and the press force of the press spring 131. That is, the state is almost the same as the state of the downstream auxiliary roller 20 and the upstream auxiliary rollers 10 shown in FIG. 30.

In this state, when the paper feed tray 1 in which sheets of paper P are stacked is attached, if the amount of the paper P is small (for example, a number of sheets of paper equal to or less than the stipulated number of sheets for the paper feed tray 1 are placed), the paper P is attached without coming in contact with the upstream auxiliary roller 10. In this case, the paper P does not come in contact with any paper feed rollers 3 either. On the other hand, if the amount of the paper P is large (for example, a number of sheets of paper exceeding the stipulated number of sheets for the paper feed tray 1 are placed), the top sheet of paper may come in contact with the upstream auxiliary rollers 10 at the attachment time. Even in this case, the upstream auxiliary rollers 10 can be freely rotated and can be retreated upward as the holder spring 117 is compressed, so that the upstream auxiliary rollers 10 come in contact with the top sheet and is rotated and retreated, whereby the paper feed tray 1 and the whole paper P are guided in the attachment direction. Thus, the paper P first comes in contact with the upstream auxiliary rollers 10 and is guided, so that bending (buckling), wrinkling, and breaking the paper P as the paper P comes in direct contact with the paper feed rollers 3 and is blocked can be prevented.

Next, the function at the feed time and the print time of paper P will be discussed. FIG. 35 is a fragmentary sectional side view of the printer 200 at the feed time when paper P is taken out from the paper feed tray 1 and is wound around the paper feed rollers 3 and is fed to a transport roller 6. FIG. 36 is a fragmentary sectional side view of the printer 200 at the record time (print time) when printing is executed while the paper P is transported in a subscanning direction at given pitches by the transport roller 6 after the paper feed shown in FIG. 35. In FIGS. 35 and 36, the front part of the auxiliary roller holder 10*a* is shown as a sectional view taken on line Y—Y in FIG. 32.

First, referring to FIG. 35, the hopper 2 and the paper P are pushed up by the hopper holder 18 at the feed time. Accordingly, the upstream auxiliary rollers 10 are pushed upward by the paper P. Consequently, the auxiliary roller holder 10*a* is displaced upward against the press force of the holder spring 117 until the roller faces of the upstream auxiliary rollers 10 are placed at the same positions as the roller faces of the paper feed rollers 3. Accordingly, the upstream auxiliary rollers 10 are displaced to positions where the roller faces of the upstream auxiliary rollers 10 match the roller faces of the paper feed rollers 3, and the tip of the paper P is brought into contact with and pressed by the roller faces of the paper feed rollers 3 (and the roller faces of the upstream auxiliary rollers 10). On the other hand, the downstream auxiliary roller 20 is brought away from the guide pad 150 as the auxiliary roller holder 10*a* is moved up, and the roller face of the downstream auxiliary roller 20 is retreated to almost the same position as the roller faces of the paper feed rollers 3 or to an inner position.

At this time, the separation pad 11*a* and paper feed driven rollers 4 are placed in a state in which they are pressed by the roller faces of the paper feed rollers 3.

Then, in this state, the paper feed rollers 3 start to rotate counterclockwise. Accordingly, the top sheet $P_1$ of the paper P brought into contact with and pressed by the paper feed rollers 3 is wound around the paper feed rollers 3, passes through the nip between the paper feed rollers 3 and the separation pad 11*a* and the nip between the paper feed rollers 3 and the paper feed driven rollers 4, and makes almost half a round of the roller faces of the paper feed rollers 3, then is fed to the transport roller 6 downstream from the paper feed rollers 3.

On the other hand, if sheets $P_2$ of paper below the top sheet $P_1$ (containing the sheets just below the sheet just below the top sheet $P_1$) are about to be fed together with the top sheet $P_1$, the separation pad 11*a* clamps the sheets $P_1$ and $P_2$ with the paper feed rollers 3 and separates the sheets $P_1$ and $P_2$ using the differences among the friction coefficients $\mu 1 > \mu 2 > \mu 3$. That is, only the sheet $P_1$ is wound around the paper feed rollers 3 and is fed by the separation pad 11*a*. The sheet $P_2$ stops on the separation pad 11*a* in a state in which the tip of the sheet $P_2$ is positioned in the vicinity of the abutment center (nip point) of the paper feed rollers 3 and the separation pad 11*a*.

At the feed time, the upstream auxiliary rollers 10 are in contact with the sheet $P_1$ and thus are driven for rotation as the sheet $P_1$ is fed. On the other hand, the downstream auxiliary roller 20 is away from the guide pad 150 and thus the top sheet $P_1$ is smoothly fed without being sandwiched between the downstream auxiliary roller 20 and the guide pad 150.

Upon completion of feeding the top sheet $P_1$ to the transport roller 6, the hopper 2 falls as shown in FIG. 36, whereby pressing the paper P against the paper feed rollers 3 is released. Consequently, pressing the paper P against the upstream auxiliary rollers 10 is also released, so that the auxiliary roller holder 10*a* is moved down by the press force of the holder spring 117, the own weight, and weight. The roller faces of the upstream auxiliary rollers 10 are projected slightly downward from the roller faces of the paper feed rollers 3 and urge the-top sheet $P_1$ (and the sheets $P_2$ below the top sheet $P_1$) from above. The press force of the holder spring 117, the own weight of the auxiliary roller holder 10*a*, and the press force of the press spring 131 (see FIG. 33) are uniformly distributed to the two upstream auxiliary rollers 10, so that urging the top sheet $P_1$ (and the sheets $P_2$ below the top sheet $P_1$) from above is executed by the uniform press force from the two upstream auxiliary rollers 10. Thus, the sheet $P_1$ is prevented from being fed in a skew condition.

On the other hand, the downstream auxiliary roller 20 presses the guide pad 150 as the auxiliary roller holder 10*a* is moved down, whereby the top sheet $P_1$ is sandwiched between the downstream auxiliary roller 20 and the guide pad 150.

The separation pad 11*a* and the paper feed driven rollers 4 are brought away from the paper feed rollers 3 for decreasing back tension imposed on the transport roller 6 as the separation pad 11*a* and the paper feed driven rollers 4 press the rear end of the sheet $P_1$ with the paper feed rollers 3.

Subsequently, in this state, the sheet $P_1$ is printed (recorded) by a recording head 8*b* while it is transported at given pitches by the transport roller 6. At the print time (record time), to reduce the back tension produced by the paper feed rollers 3, the paper feed rollers 3 are rotated counterclockwise with the transport roller 6. Accordingly, the rear part of the sheet $P_1$ is transported by the paper feed rollers 3.

At this time, the upstream auxiliary rollers 10 are placed upstream from the auxiliary roller holder 10*a* and do not press the sheet $P_1$ with the auxiliary roller holder 10*a*, so that back tension is reduced.

On the other hand, the upstream auxiliary rollers 10 are projected from the roller faces of the paper feed rollers 3 and downward urge the top sheet $P_1$ and the sheets $P_2$ below the top sheet $P_1$ and thus the sheets $P_1$ and $P_2$ are brought away from the paper feed rollers 3 in the portions of the upstream auxiliary rollers 10. The top sheet $P_1$ has a downstream portion wound around the paper feed rollers 3 and thus is once brought away from the paper feed rollers 3 in the portions of the upstream auxiliary rollers 10, and again is brought into contact with and wound around the paper feed rollers 3. On the other hand, the sheet $P_2$ below the top sheet $P_1$ has a downstream portion (tip portion) not wound around the paper feed rollers 3 and on the separation pad 11*a* and thus is directed toward the separation pad 11*a* by the rigidity of the sheet $P_2$ in a state in which it is away from the paper feed rollers 3. The separation pad 11*a*, which has the above-mentioned friction coefficient, holds the tip portion of the sheet $P_2$ below the top sheet in the vicinity of the abutment center point according to the friction coefficient. Thus, at the print time, while the paper feed rollers 3 are rotated and the top sheet $P_1$ is transported, overlap feeding of the sheet $P_2$ below the top sheet is also prevented by the upstream auxiliary rollers 10 and the separation pad 11*a*.

On the other hand, the intimate contact force between sheets of paper is large depending on the paper type and overlap feeding of the sheet $P_2$ may be executed beyond the separation pad 11*a*. The abutment center point of the downstream auxiliary roller 20 and the guide pad 150 is positioned downward from the abutment center point of the separation pad 11*a* and the paper feed rollers 3, and the downstream auxiliary roller 20 presses the guide pad 150. Therefore, if overlap feeding of the sheet $P_2$ is executed beyond the separation pad 11*a*, the sheet $P_2$ is stopped by the downstream auxiliary roller 20 and the guide pad 150 and overlap feeding of the sheet $P_2$ is prevented. Particularly, the guide pad 150 is formed of the friction member having the friction coefficient mentioned above and thus a large overlap sheet feeding prevention effect is produced. Overlap sheet feeding is thus prevented at the two stages of the upstream auxiliary rollers 10 and the separation pad 1la and the downstream auxiliary roller 20 and the guide pad 150 and therefore is prevented reliably.

As described above, the angle between the tip of the sheet $P_2$ and the guide pad 150 when the tip abuts the guide pad 150 is set larger than the angle between the tip and the separation pad 11*a* when the tip abuts the separation pad 11*a* at a separated position. Therefore, the load (contact resistance) when the tip abuts the guide pad 150 becomes larger than the load (contact resistance) when the tip abuts the separation pad 11*a*. Thus, if the press force of the downstream auxiliary roller 20 pressing the guide pad 150 is smaller than the press force of pressing the separation pad 11*a*, overlap sheet feeding prevention can be accomplished sufficiently. Consequently, overlap sheet feeding can be prevented by a smaller press force than the press force of pressing the separation pad 11*a* and the press force can be lessened, so that back tension produced by pressing can be reduced.

The downstream auxiliary roller 20 is attached for free rotation and thus is rotated as the sheet $P_1$ is transported.

If the printing proceeds and the rear end part of the top sheet $P_1$ is brought away from winding of the paper feed rollers 3, the sheet $P_2$ below the top sheet is away from the paper feed rollers 3 and thus is not wound around the rotating paper feed rollers 3 for transport. Particularly, both the upstream auxiliary rollers 10 are placed in the proximity of the sides of the two paper feed rollers 3, so that the effect of bringing the sheet $P_2$ below the top sheet away from the paper feed rollers 3 is large. The sheet $P_2$ reaching the position of the downstream auxiliary roller 20 is also placed at a separated position from the paper feed rollers 3 by the downstream auxiliary roller 20 and thus is not transported. Thus, overlap feeding of the sheet $P_2$ below the top sheet $P_1$ when the top sheet $P_1$ is printed is prevented reliably.

Since the upstream auxiliary rollers 10 are brought into elastic contact with paper by the holder spring 117, vibration of paper caused by transport at the print time can be absorbed and paper can be kept from becoming wrinkled and can be protected. Since the two upstream auxiliary rollers 10 also perform rolling operation with the point supported by the holder spring 117 as the support point, vibration of paper can also be absorbed and paper can also be protected accordingly.

In the embodiment, the two upstream auxiliary rollers 10 are provided, but the number of the upstream auxiliary rollers may be one or three or more. Although a plurality of the downstream auxiliary rollers 20 can also be provided, preferably a fewer number of the downstream auxiliary rollers 20 are provided from the viewpoint of lessening back tension as much as possible.

Figure 37:
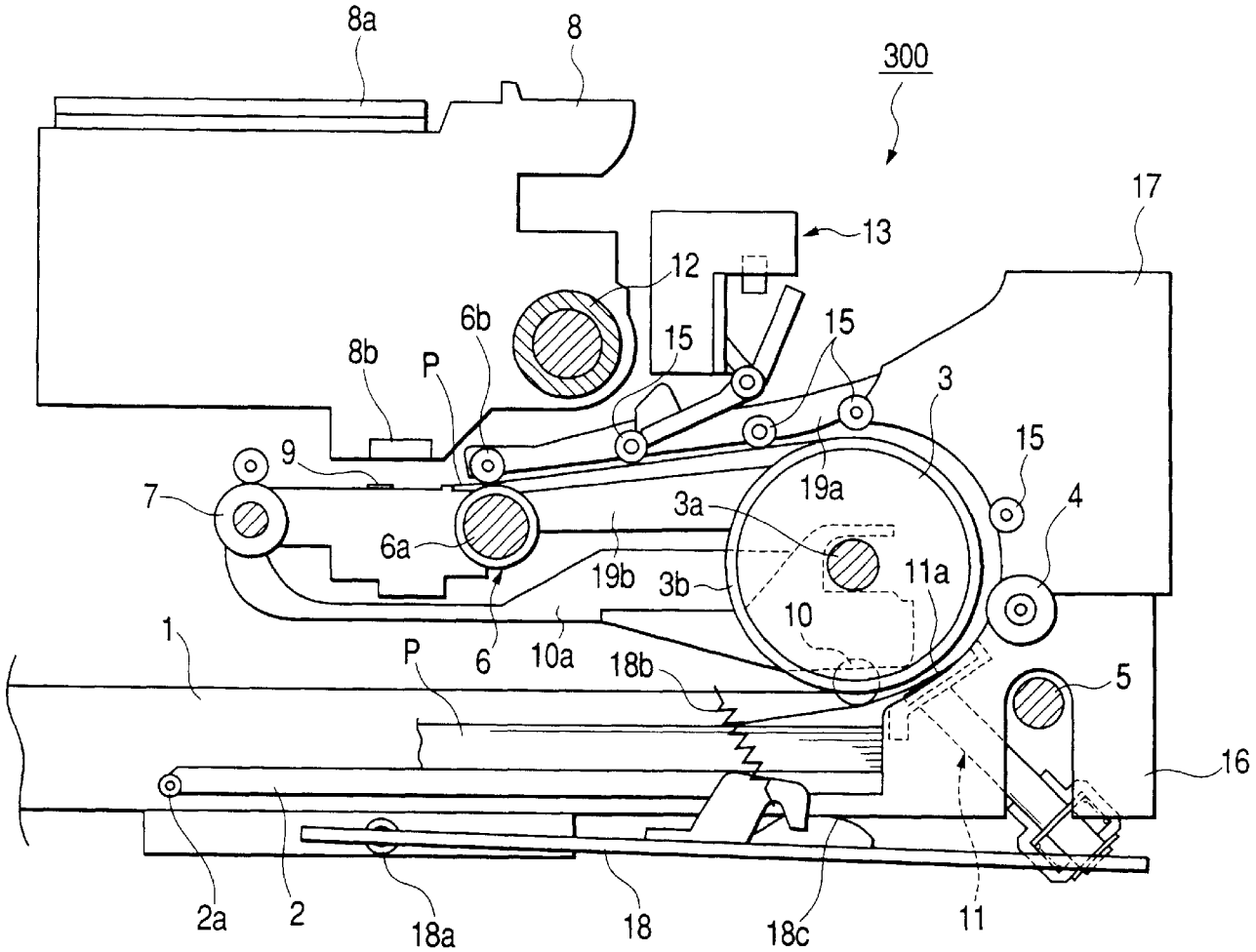
FIG. 37 is a schematic side view of an ink jet printer according to a third embodiment of the invention.

FIG. 37 is a schematic side view of an ink jet printer 300 according to a third embodiment of the invention. The basic configuration of the ink jet printer is similar to that of the ink jet printer of the first embodiment and therefore components identical with those of the printer previously described with reference to the accompanying drawings are denoted by the same reference numerals in the following drawings and will not be discussed again. The description to follow centers around the configuration and function of upstream auxiliary rollers 10 which prevents overlap recording material feeding.

Figure 38:
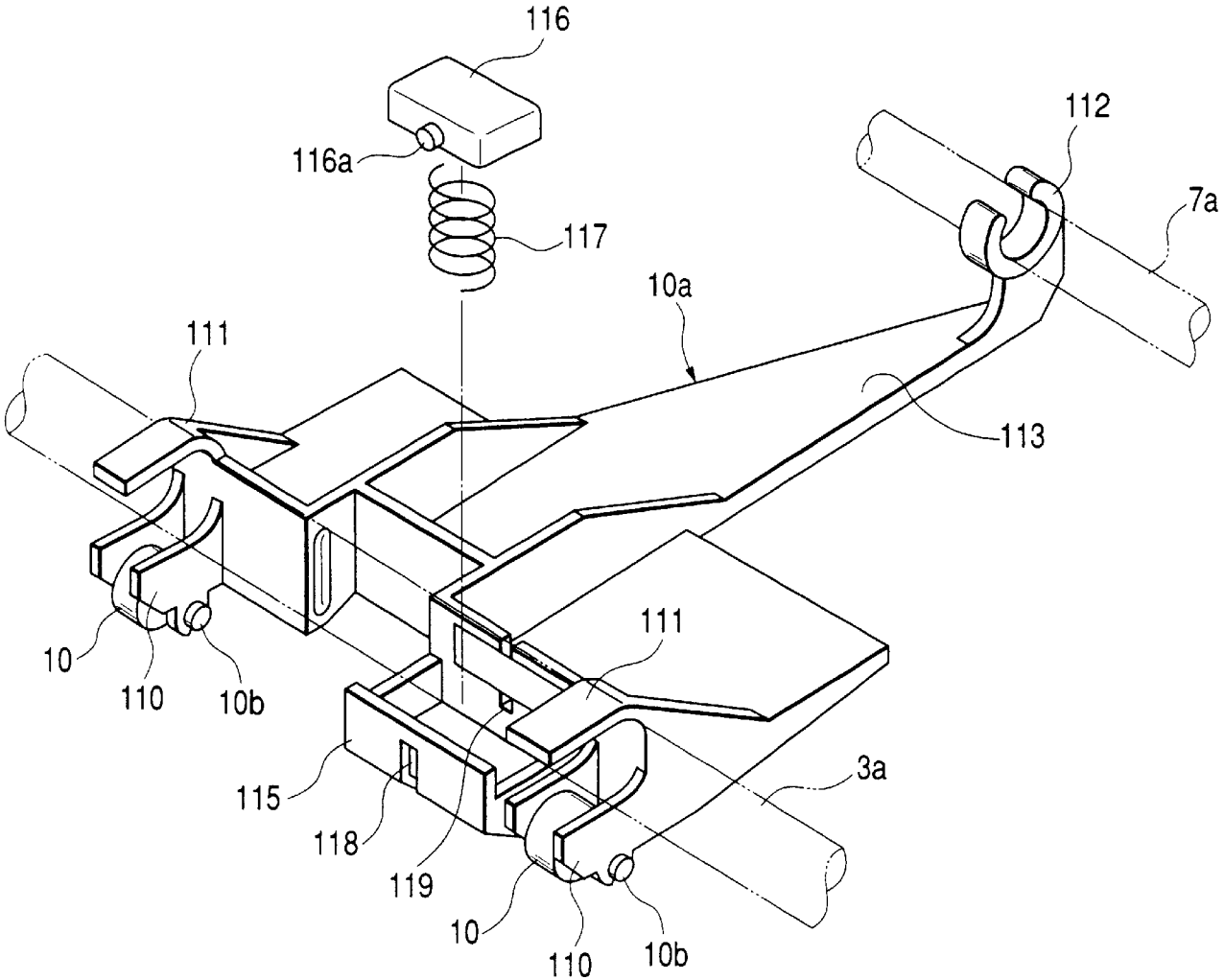
FIG. 38 is a perspective view to show upstream auxiliary rollers and an auxiliary roller holder for hooding the upstream auxiliary rollers.
Figure 39:
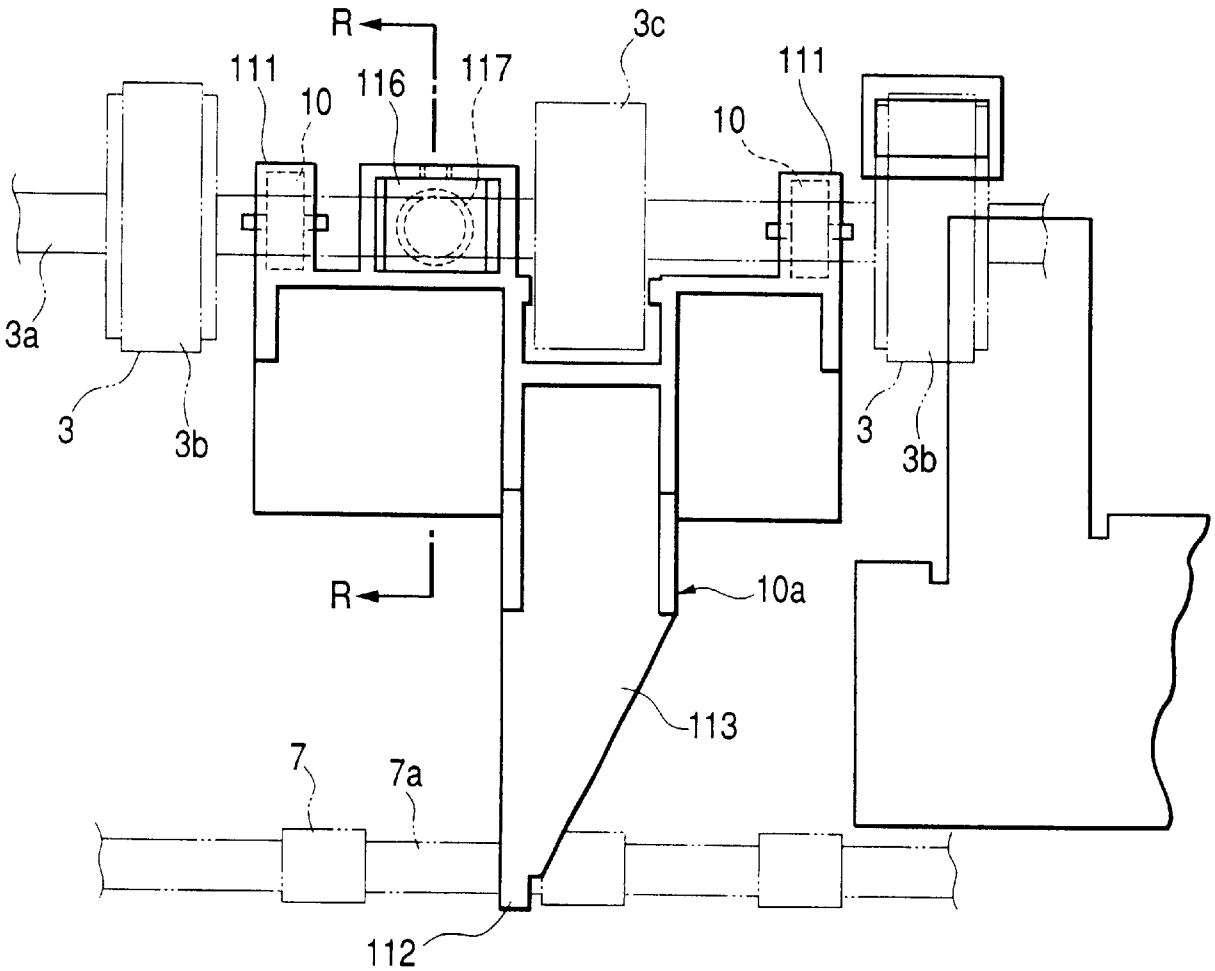
FIG. 39 is a schematic plan view of the auxiliary roller holder attached to the ink jet printer.

FIG. 38 is a perspective view to show the upstream auxiliary rollers 10 and an auxiliary roller holder 10*a* for hooding the upstream auxiliary rollers. FIG. 39 is a schematic plan view of the auxiliary roller holder 10*a* attached to the printer 300.

The auxiliary roller holder 10*a* is molded of a resin material integrally. The auxiliary roller holder 10*a* is formed at a front end part (an end part on the side of a paper feed roller shaft 3*a*) with holders 110 placed back and forth in the axial direction of the paper feed roller shaft 3*a*. Two upstream auxiliary rollers 10 are attached to the holders 110 for free rotation via rotation shafts 10*b*. The holders 110 are placed at positions where the center axis of the upstream auxiliary roller 10 held in the holder almost matches the center axis of the paper feed roller shaft 3*a* or where the former center axis slightly leaning to the front of the printer 300 from the latter center axis. The spacing between the holders 110 is set to the distance where the upstream auxiliary rollers 10 are placed in the proximity of the side parts of two paper feed rollers 3. In addition to the paper feed rollers 3 each to which a rubber member 3*b* is attached, a paper feed roller 3*c* to which no rubber member 3*b* is attached (a roller for aiding the paper feed operation of the paper feed rollers 3) is also fixed to the paper feed roller shaft 3*a*, and the auxiliary roller holder 10*a* clamps the paper feed roller 3*c* to such an extent that it slightly comes in contact with the paper feed roller 3*c*, whereby the auxiliary roller holder 10*a* is held so that it does not slide along the paper feed roller shaft 3*a* (from side to side in FIG. 39).

First support parts 111 almost horizontally extended to the front (the side of the paper feed roller shaft 3*a*) are formed above the holders 110. If the auxiliary roller holder 10*a* is attached to the paper feed roller shaft 3*a*, the first support parts 111 are placed above the paper.feed roller shaft 3*a* so as to hang the auxiliary roller holder 10*a* on the paper feed roller shaft 3*a* for support. If the paper feed roller shaft 3*a* comes in contact with the first support part 111, the first support part 111 is formed so that the roller face of each of the upstream auxiliary rollers 10 slightly projects (for example, 1 mm) from the roller face of each paper feed roller 3 (outer peripheral face of the rubber member 3*b*), as shown in FIG. 37.

Figure 40:
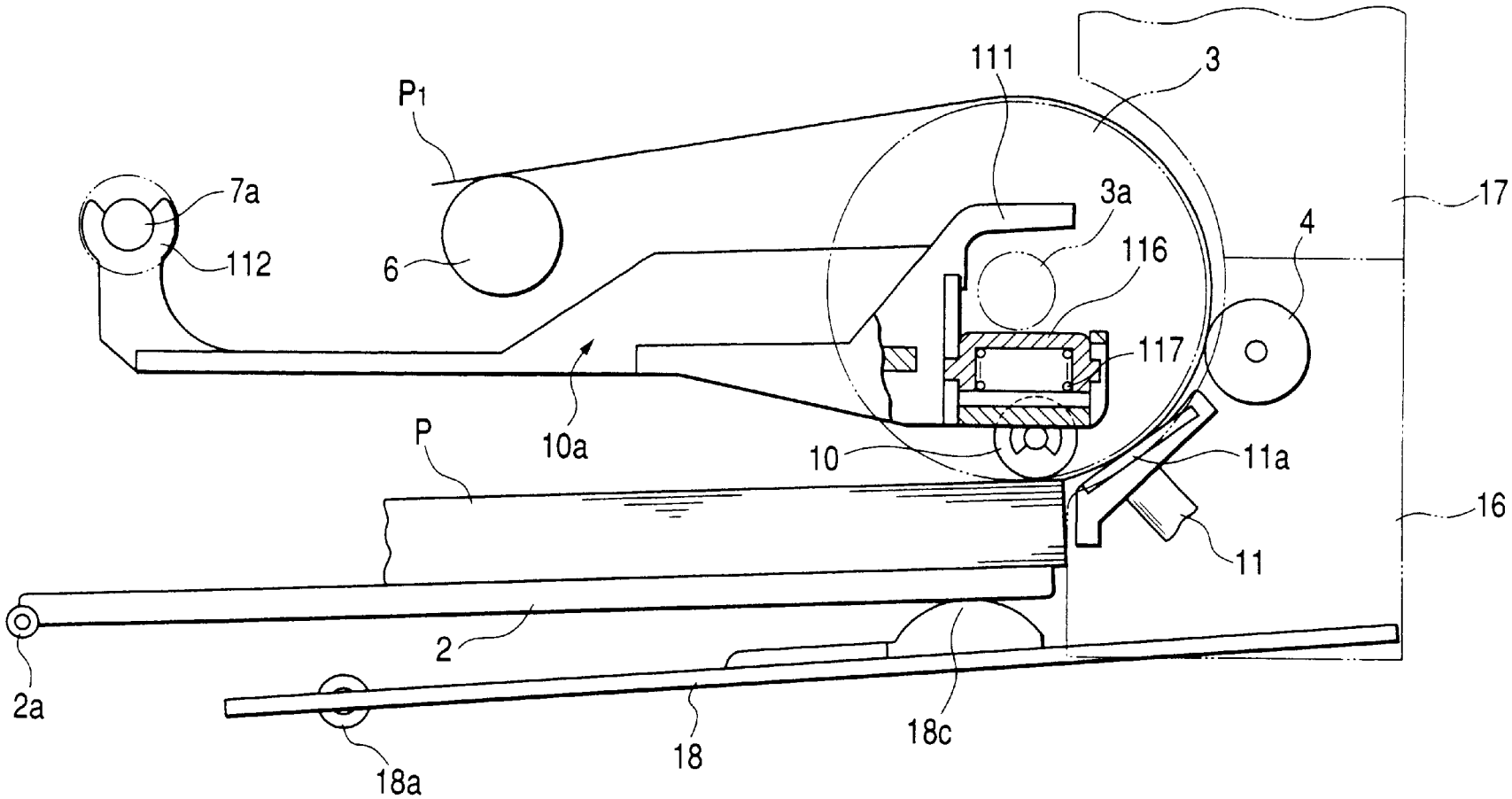
FIG. 40 is a fragmentary sectional side view of the printer at the feed time when paper is taken out from a paper feed tray and is wound around feed rollers and is fed to a transport roller.

The spacing between the first support part 111 and the holder 110, 110 opposed thereto is set to a dimension for enabling the paper feed roller shaft 3*a* to be displaced a predetermined amount, in other words, a dimension for enabling the auxiliary roller holder 10*a* to be displaced a predetermined amount relative to the paper feed roller shaft 3*a*. The predetermined amount is an amount for enabling the roller face of each of the upstream auxiliary rollers 10 to be retreated to the same position as the roller face of each paper feed roller 3 (outer peripheral face of the rubber member 3*b*) or to an inner position if the upstream auxiliary rollers 10 are pushed upward by paper P, as shown in FIG. 40.

The auxiliary roller holder 10*a* is formed at the rear with a tail part 113 extended to the position of a paper discharge roller shaft 7*a* and the tail part 113 is formed at a tip with a second support part 112 for holding the paper discharge roller shaft 7*a* for rotation and hanging the auxiliary roller holder 10*a* on the paper discharge roller shaft 7*a* for support.

The auxiliary roller holder 10*a* is attached to the printer 300 in a state in which it is hung on the paper feed roller shaft 3*a* and the paper discharge roller shaft 7*a* by the first support parts 111 and the second support part 112.

A spring housing part 115 is formed in the proximity of one side of one of the holders 110 (front in FIG. 38). After a holder spring (helical compression spring) 117 is housed in the spring housing part 115, a spring cap 116 is placed on the top of the spring housing part 115. The spring cap 116 is formed at the front and the rear with projections 116*a* (the rear projection 116*a* is not shown in the figure). The projections 116*a* are fitted into slits 118 and 119 formed in a front wall and a rear wall of the spring housing part 115, whereby the spring cap 116 and the holder spring 117 do not come out of the spring housing part 115. If the auxiliary roller holder 10*a* is attached to the paper feed roller shaft 3*a*, the holder spring 117 urges the paper feed roller shaft 3*a* upward through the spring cap 116 and urges the auxiliary roller holder 10*a* downward (namely, to the side of paper P placed in a paper feed tray 1).

The urging force of the holder spring 117 is set to a magnitude sufficient to project the roller face of the upstream auxiliary roller 10 from the roller faces of the paper feed rollers 3 and bring paper P fed by the paper feed rollers 3 away from the paper feed rollers 3 at the print time.

Figure 41:
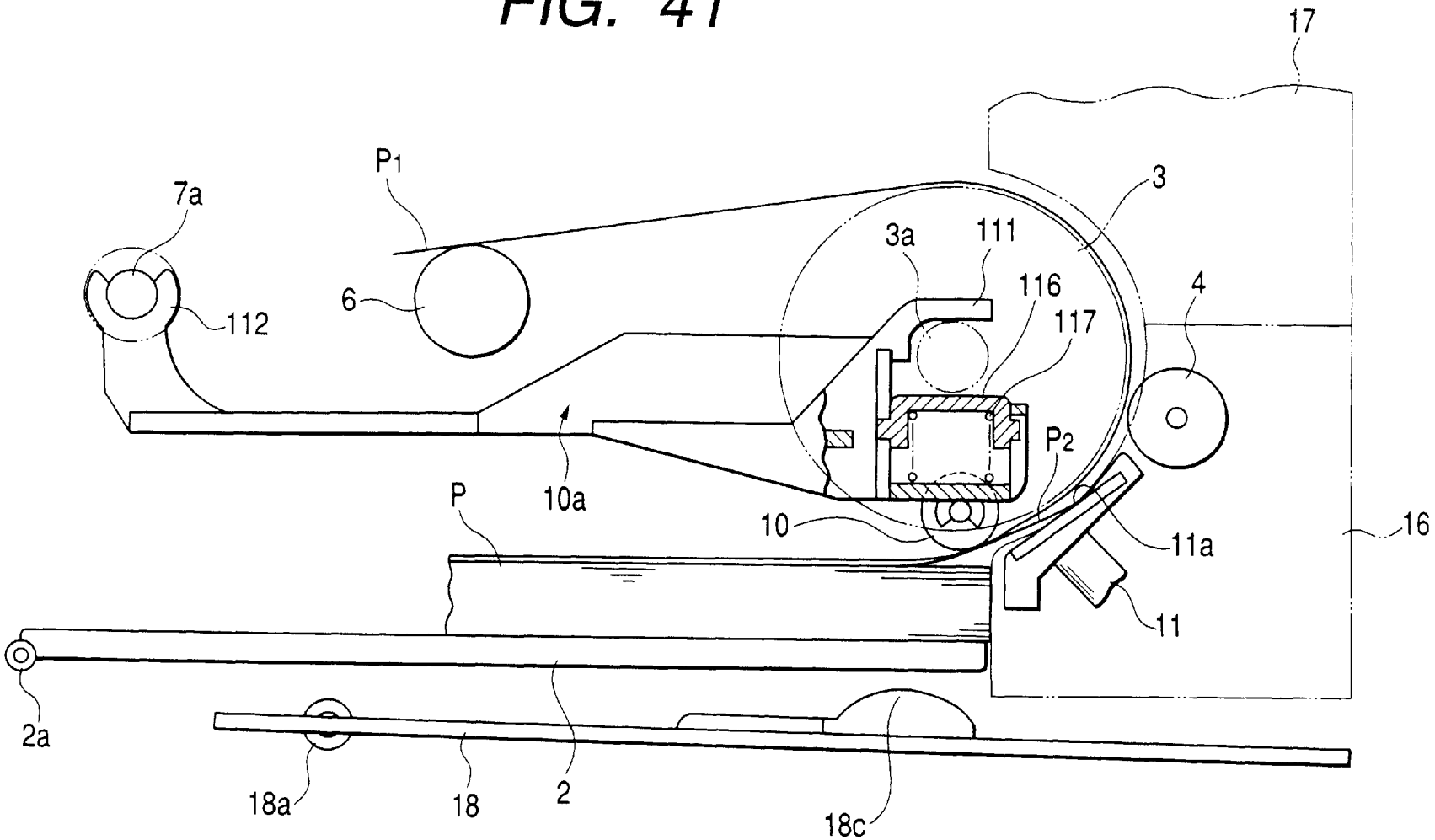
FIG. 41 is a fragmentary sectional side view of the printer at the record time when printing is executed while paper is transported in a subscanning direction at given pitches by the transport roller after the paper feed shown in FIG. 40.

FIG. 40 is a fragmentary sectional side view of the printer 300 at the feed time when paper P is taken out from the paper feed tray 1 and is wound around the paper feed rollers 3 and is fed to a transport roller 6. FIG. 41 is a fragmentary sectional side view of the printer 300 at the record time (print time) when printing is executed while the paper P is transported in a subscanning direction at given pitches by the transport roller 6 after the paper feed shown in FIG. 40.

In FIGS. 40 and 41, the front part of the auxiliary roller holder 10*a* is shown as a sectional view taken on line R—R in FIG. 39. The functions of the upstream auxiliary rollers 10 and the auxiliary roller holder 10*a* are the same as those of the upstream auxiliary rollers and the auxiliary roller holder in the second embodiment and therefore components identical with those previously described with reference to the accompanying drawings are denoted by the same reference numerals in FIGS. 40 and 41 and will not be discussed again.

In the first to third embodiments described above, the invention is applied to the printers, but can also be applied to recording apparatuses such as copiers and facsimiles, needless to say.

What is claimed is:

1. A method of feeding a recording material, comprising the steps of:

providing a feeder, which includes:

a storage section, in which a plurality of recording materials are stacked;

a feed roller, for feeding a top one of the recording materials in the storage section by rotating forwardly;

a transport roller, for transporting the fed recording material by rotating forwardly, the transport roller being rotatable reversely;

an abutment driver, for moving the storage section between an abutment position and a separated position, the abutment position at which the recording materials are abutted onto the feed roller, the separated position being separated from the feed roller; and a separator, provided with an abutment part, the separator being movable between an abutment position and a separated position, the abutment position at which the abutment part is abutted onto the feed roller to separate the top one of the recording material from a subsequent recording material, the separated position at which the abutment part is separated from the feed roller, moving the abutment driver and the separator to the respective abutment position;

rotating the feed roller and the transport roller forwardly until a leading end of the fed recording material, which is transported by the transport roller, is transported therefrom by a first predetermined length which is not less than a feeding path length between a leading end of the recording material stacked in the storage section and an abutment center point of the separator and the feed roller;

stopping the rotations of the feed roller and the transport roller;

moving the abutment driver and the separator to the respective separated positions; and rotating the transport roller reversely by a predetermined rotation amount which corresponds to a second predetermined length which is not less than the first predetermined length.

2. The feeding method as set forth in claim 1, wherein the second predetermined length is a length in which the first predetermined length is added to a bendable amount of the recording material at a feeding path between the feed roller and the transport roller.

3. A feeder for feeding a recording material, comprising:

a storage section, in which a plurality of recording materials are stacked;

a feed roller, for feeding a top one of the recording materials in the storage section by rotating forwardly, the feed roller being rotatable reversely;

a transport roller, for transporting the fed recording material by rotating forwardly, the transport roller being rotatable reversely;

an abutment driver, for moving the storage section between an abutment position and a separated position, the abutment position at which the recording materials are abutted onto the feed roller, the separated position being separated from the feed roller;

a first separator, provided with a first abutment part, the separator being movable between an abutment position and a separated position, the abutment position at which the first abutment part is abutted onto the feed roller to separate the top one of the recording material from a subsequent recording material, the separated position at which the first abutment part is separated from the feed roller; and a controller for controlling the feed roller, the transport roller, the abutment driver and the first separator such that:

the abutment driver and the separator are moved to the respective abutment position;

the feed roller and the transport roller are rotated forwardly until a leading end of the fed recording material, which is transported by the transport roller, is transported therefrom by a first predetermined length which is not less than a feeding path length between a leading end of the recording material stacked in the storage section, and an abutment center point of the first separator and the feed roller;

the rotations of the feed roller and the transport roller are stopped;

the abutment driver and the separator are moved to the respective separated positions; and the transport roller is rotated reversely by a predetermined rotation amount which corresponds to a second predetermined length which is not less than the first predetermined length.

4. The feeder as set forth in claim 3, further comprising:

a second separator, disposed at a downstream side of the first separator which is disposed at a downstream side of the storage section, the second separator provided with a second abutment part on which the fed recording material is abutted, the second abutment part being separated from the feed roller; and a first auxiliary roller, being rotatable freely and abutable onto the second abutment part, an abutment center point between the first auxiliary roller and the second abutment part being disposed at a downstream side of the abutment center point of the first separator and the feed roller, wherein an angle defined between the recording material and the second abutment part, when a leading end of the recording material is abutted onto the second abutment part, is larger than an angle defined between the recording material and the first abutment part, when the leading end of the recording material is abutted onto the first abutment part in the separated position; and wherein while recording is performed, the first abutment part is moved to the separated position, and the first auxiliary roller abuts onto the second abutment part to separate the top recording material from the subsequent recording material.

5. The feeder as set forth in claim 4, wherein the first auxiliary roller is separated from the second abutment part while the recording material is fed to the transport roller.

6. The feeder as set forth in claim 4, further comprising a second auxiliary roller disposed such that a roller face thereof is protruded from a roller face of the feed roller toward the storage section, while the recording is performed.

7. The feeder as set forth in claim 4, further comprising an urging member for urging the first auxiliary roller toward the second abutment part.

8. The feeder as set forth in claim 7, wherein the urging member is a spring member.

9. A recording apparatus, comprising the feeder as set forth in claim 4.

10. A feeder, comprising:

a detachable storage section in which a plurality of recording material are stacked;

a feeder roller, for feeding a top one of the recording materials in the storage section; and an auxiliary roller being rotatable freely, the auxiliary roller disposed such that a roller face thereof is protruded from a roller face of the feed roller toward the attached storage section, the auxiliary roller disposed such that it is moved by the recording material in accordance with a displacement of the recording material in the stacking direction thereof.

11. The feeder as set forth in claim 10, wherein the auxiliary roller is disposed in the vicinity of a side end portion of the feed roller.

12. A recording apparatus, comprising the feeder as set forth in claim 10.

13. The feeder as recited in claim 10, wherein the auxiliary roller moves in response to the displacement of the recording material in the stacking direction.

14. The feeder as recited in claim 13, wherein the auxiliary roller is resiliently urged towards the plurality of recording materials such that the displacement of the recording materials in a first direction causes the auxiliary roller to move in the first direction and such that the displacement of the recording materials in a second direction causes the auxiliary roller to move in the second direction, and wherein the first direction is substantially opposite to the second direction.

15. The feeder as recited in claim 13, wherein the auxiliary roller contacts a portion of the top most sheet of the recording materials while the portion is contained in the storage section.

16. A feeder comprising:

a storage section in which a plurality of recording materials are stacked;

a feed roller, for feeding a top one of the recording materials in the storage section;

a transport roller, for transporting the recording material fed by the feed roller while recording is performed;

a separator, being movable between an abutment position and a separated position with respect to the feed roller, the separator being moved to the abutment position to separate the top recording material from a subsequent recording material when the feed roller feeds the top recording material toward the transport roller, the separator being moved to the separated position while the recording is performed, wherein a stopper is provided so that the separated position of the separation pad is defined, and at least one auxiliary roller, disposed at an upstream side of the separator, the auxiliary roller being abutted onto the fed recording material to guide the top recording material toward the separator, after separating the subsequent recording material from the top recording material.

17. The feeder as set forth in claim 16, wherein a roller face of the auxiliary roller is protruded from a roller face of the feed roller toward the storage section, while the recording is performed.

18. The feeder as set forth in claim 17, wherein the auxiliary roller is retreatable from a position in which the roller face thereof is protruded from the roller face of the feed roller.

19. The feeder as set forth in claim 18, wherein a plurality of auxiliary rollers are arranged in a widthwise direction of the recording material while being supported rotatably.

20. The feeder as set forth in claim 16, wherein the auxiliary roller abuts onto the recording material elastically.

21. The feeder as set forth in claim 16, wherein the auxiliary roller is disposed in the vicinity of a side end portion of the feed roller.

22. A recording apparatus, comprising the feeder as set forth in claim 16.

23. The feeder as recited in claim 16, wherein at least a portion of the auxiliary roller is disposed upstream of an upstream-most side of the separator.

24. The feeder as recited in claim 23, wherein the auxiliary roller is entirely disposed upstream of the upstream-most side of the separator.

25. A feeder, comprising:

an auxiliary roller;

a detachable storage section in which a plurality of recording materials are stacked; and a feed roller, for feeding a top one of the recording materials in the attached storage section;

wherein the auxiliary roller is rotatable freely;

wherein the auxiliary roller is disposed such that a roller face thereof is protruded from a roller face of the feed roller toward the attached storage section; and wherein the auxiliary roller is disposed such that it is moved by the recording material in accordance with a displacement of the recording material in the stacking direction thereof.

26. The feeder as recited in claim 25, wherein the auxiliary roller moves in response to the displacement of the recording material in the stacking direction.

27. The feeder as recited in claim 26, wherein the auxiliary roller is resiliently urged towards the plurality of recording materials such that the displacement of the recording materials in a first direction causes the auxiliary roller to move in the first direction and such that the displacement of the recording materials in a second direction causes the auxiliary roller to move in the second direction, and wherein the first direction is substantially opposite to the second direction.

28. The feeder as recited in claim 27, wherein the auxiliary roller contacts a portion of the top-most sheet of the recording materials while the portion is contained in the storage section.

29. The feeder as recited in claim 25, wherein the roller face of the feed roller comprises a continuous curved surface, and wherein the auxiliary roller protrudes from the continuous curved surface when the continuous curved surface is disposed on each side of the auxiliary roller and passes through a cylindrical plane containing an outer circumference of the auxiliary roller.

30. A feeder comprising:

an auxiliary roller;

a storage section in which a plurality of recording materials are stacked;

a feed roller, for feeding a top one of the recording materials in the storage section;

a transport roller, for transporting the recording material fed by the feed roller while recording is performed; and a separator, being movable between an abutment position and a separated position with respect to the feed roller, the separator being moved to the abutment position to separate the top recording material from a subsequent recording material when the feed roller feeds the top recording material toward the transport roller, the separator being moved to the separated position while the recording is performed, wherein a stopper is provided so that the separated position of the separation pad is defined, wherein the auxiliary roller is disposed at an upstream side of the separator; and wherein the auxiliary roller is abutted onto the fed recording material to guide the top recording material toward the separator, after separating the subsequent recording material from the top recording material.

31. The feeder as recited in claim 30, wherein at least a portion of the auxiliary roller is disposed upstream of an upstream-most side of the separator.

32. The feeder as recited in claim 31, wherein the auxiliary roller is entirely disposed upstream of the upstream-most side of the separator.

33. A feeder for feeding a recording material, comprising:

a storage section, in which a plurality of recording materials are stacked;

a feed roller, for feeding a top one of the recording materials in the storage section by rotating forwardly, the feed roller being rotatable reversely;

a transport roller, for transporting the fed recording material by rotating forwardly, the transport roller being rotatable reversely;

an abutment driver, for moving the storage section between an abutment position and a separated position, the abutment position at which the recording materials are abutted onto the feed roller, the separated position being separated from the feed roller;

a first separator, provided with a first abutment part, the separator being movable between an abutment position and a separated position, the abutment position at which the first abutment part is abutted onto the feed roller to separate the top one of the recording material from a subsequent recording material, the separated position at which the first abutment part is separated from the feed roller;

a second separator, disposed at a downstream side of the first separator which is disposed at a downstream side of the storage section, the second separator provided with a second abutment part on which the fed recording material is abutted, the second abutment part being separated from the feed roller; and a first auxiliary roller, being rotatable freely and abutable onto the second abutment part, an abutment center point between the first auxiliary roller and the second abutment part being disposed at a downstream side of the abutment center point of the first separator and the feed roller, wherein an angle defined between the recording material and the second abutment part, when u leading end of the recording material is abutted onto the second abutment part, is larger than an angle defined between the recording material and the first abutment part, when the leading end of the recording material is abutted onto the first abutment part in the separated position; and wherein the first auxiliary roller abuts onto the second abutment part to separate the top recording material from the subsequent recording material, while recording is performed.

34. The feeder as set forth in claim 33, wherein the first auxiliary roller is separated from the second abutment part while the recording material is fed to the transport roller.

35. The feeder as set forth in claim 33, further comprising an urging member for urging the first auxiliary roller toward the second abutment part.

36. The feeder as set forth in claim 35, wherein the urging member is a spring member.

37. The feeder as set forth in claim 33, further comprising at least one second auxiliary roller disposed at an upstream side of the first separator, the second auxiliary roller being abutted onto the fed recording material to guide the top recording material toward the first separator, after separating the subsequent recording material from the top recording material.

38. The feeder as set forth in claim 37, wherein the second auxiliary roller is disposed such that a roller face thereof is protruded from a roller face of the feed roller toward the storage section, while the recording is performed.

39. The feeder as set forth in claim 38, wherein the second auxiliary roller is retreatable from a position in which the roller face thereof is protruded from the roller face of the feed roller.

40. The feeder as set forth in claim 37, wherein the second auxiliary roller abuts onto the recording material elastically.

41. The feeder as set forth in claim 37, wherein a plurality of second auxiliary rollers are arranged in a widthwise direction of the recording material while being supported rotatably.

42. A recording apparatus, comprising the feeder as set forth in claim 33.

* * * * *